US007151538B2

(12) United States Patent
Yamashita et al.

(10) Patent No.: US 7,151,538 B2
(45) Date of Patent: Dec. 19, 2006

(54) DISPLAY DEVICE AND PROJECTION TYPE DISPLAY DEVICE

(75) Inventors: Junichi Yamashita, Tokyo (JP); Tamaki Harano, Tokyo (JP)

(73) Assignee: Sony Corporation (JP)

( * ) Notice: Subject to any disclaimer, the term of this patent is extended or adjusted under 35 U.S.C. 154(b) by 538 days.

(21) Appl. No.: 10/781,782

(22) Filed: Feb. 20, 2004

(65) Prior Publication Data

US 2004/0196272 A1 Oct. 7, 2004

(30) Foreign Application Priority Data

Feb. 28, 2003 (JP) ..... P2003-054540
Feb. 28, 2003 (JP) ..... P2003-054577
Feb. 28, 2003 (JP) ..... P2003-054632

(51) Int. Cl.
*G09G 5/00* (2006.01)
*G09G 3/36* (2006.01)

(52) U.S. Cl. ..... 345/213; 345/98; 345/99; 345/100; 345/204

(58) Field of Classification Search ..... 345/87–100, 345/204–215

See application file for complete search history.

(56) References Cited

U.S. PATENT DOCUMENTS

2005/0024352 A1* 2/2005 Sano ..... 345/204
2005/0168602 A1* 8/2005 Sumi et al. ..... 348/294

* cited by examiner

*Primary Examiner*—Vijay Shankar
(74) *Attorney, Agent, or Firm*—Rader Fishman & Grauer PLLC; Ronald P. Kananen

(57) ABSTRACT

A display device and a projection type display device, able to realize an image display having a high precision regardless of the scanning direction of operation without a change of a phase of an output potential change, receiving a horizontal start pulse and a switch signal at a first scanning operation to sample a clock different from a clock sampled by a first shift stage of a horizontal scanner by a selector portion of a monitor circuit, setting a potential of a pulled up monitor line at a ground potential in response to this sample-and-hold pulse, receiving the horizontal start pulse and the switch signal to sample a clock different from the clock sampled by a fourth shift stage of the horizontal scanner by the selector portion of the monitor circuit at the second scanning operation, and setting the potential of the pulled up monitor line at the ground potential in response to this sample-and-hold pulse.

42 Claims, 33 Drawing Sheets

T1
(T1=T2)
t1
FIG. 3A HCK
t1
FIG. 3B HCKX
T2
t2
FIG. 3C DCK
t2
FIG. 3D DCKX
T2

FIG. 5A VDO
FIG. 5B DRVP−N
FIG. 5C DRVP−N+1
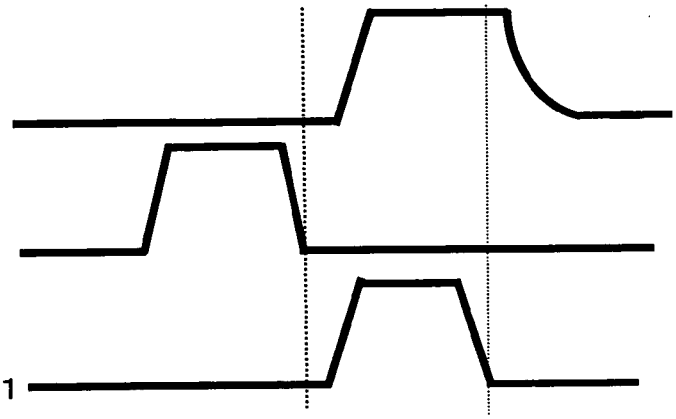
FIG. 5D
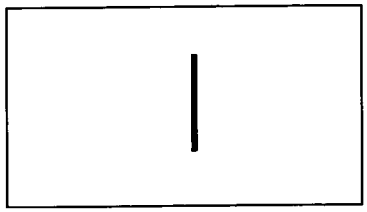

FIG. 6A VDO
FIG. 6B DRVP−N
FIG. 6C DRVP−N+1
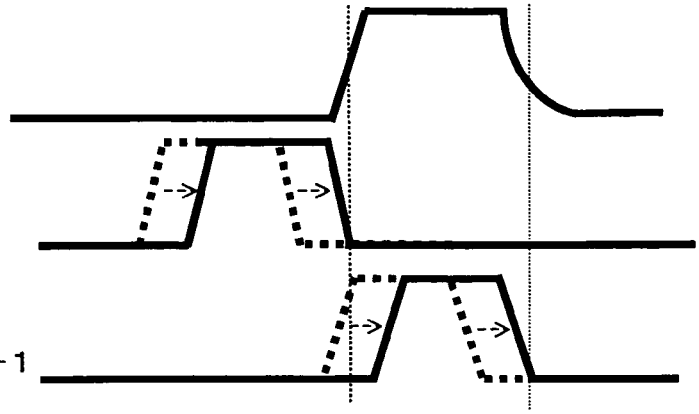
FIG. 6D
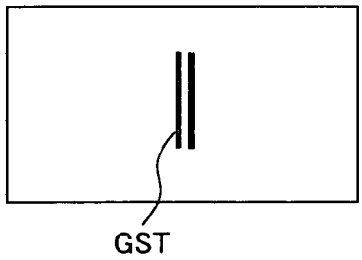

FIG. 9A HST

FIG. 9B HCK

FIG. 9C HCKX

FIG. 9D DCK1

FIG. 9E DCKX

FIG. 9F SFTP17

FIG. 9G SFTP1

FIG. 9H SFTP2

FIG. 9I SHP17

FIG. 9J SHP1

FIG. 9K SHP2

FIG. 10A HST

FIG. 10B HCK

FIG. 10C HCKX

FIG. 10D DCK1

FIG. 10E DCKX

FIG. 10F SFTP17

FIG. 10G SFTP1

FIG. 10H SFTP2

FIG. 10I SHP17

FIG. 10J SHP1

FIG. 10K SHP2

◎AT SCANNING FROM LEFT TO RIGHT
FIG. 15A HST
FIG. 15B HCK
FIG. 15C HCKX
FIG. 15D DCK
FIG. 15E DCKX
FIG. 15F SLP241
FIG. 15G SFTP231
FIG. 15H SFTP232
FIG. 15I SHP241
FIG. 15J SHP231
FIG. 15K SHP232
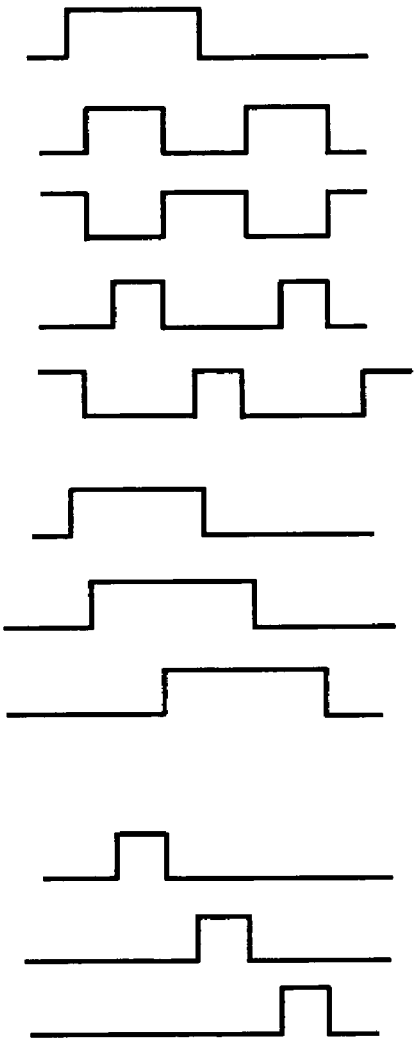

◎AT SCANNING FROM RIGHT TO LEFT

FIG. 16A HST

FIG. 16B HCK

FIG. 16C HCKX

FIG. 16D DCK

FIG. 16E DCKX

FIG. 16F SLP242

FIG. 16G SFTP234

FIG. 16H SFTP233

FIG. 16I SHP241

FIG. 16J SHP234

FIG. 16K SHP233

INITIAL STATE

AFTER AGING DRIFT
30ns
15ns

AFTER DRIFT CORRECTION
15ns
ΔV
(1) VDO
(2) DRVP – N–1
(3) DRVP – N
(4) DRVP – N+1
(5) POTENTIAL OF N+1–TH STAGE SIGNAL LINE
(6)
GST
GST

INITIAL STATE

AFTER AGING DRIFT

AFTER FEEDBACK
(1) VDO
(2) DRVP - N-1
(3) DRVP - N
(4) DRVP - N+1
(5) POTENTIAL OF N+1-TH STAGE SIGNAL LINE
(6)
30ns
15ns
15ns
POTENTIAL OF N+1-TH STAGE SIGNAL LINE
GST

◎AT SCANNING FROM LEFT TO RIGHT
FIG. 24A HST
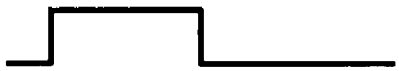
FIG. 24B HCK
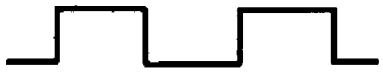
FIG. 24C HCKX
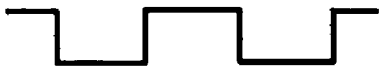
FIG. 24D DCK
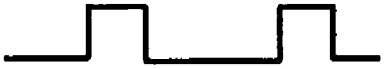
FIG. 24E DCKX
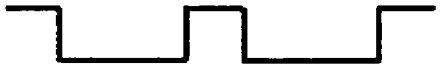
FIG. 24F SLP241
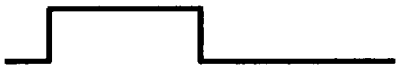
FIG. 24G SFTP231
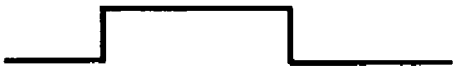
FIG. 24H SFTP232
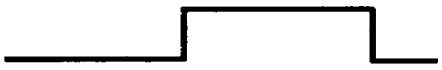
FIG. 24I SHP241
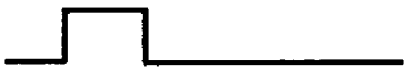
FIG. 24J SHP231
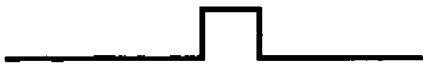
FIG. 24K SHP232
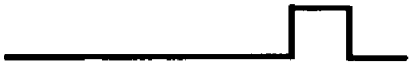

◎AT SCANNING FROM RIGHT TO LEFT

FIG. 25A HST

FIG. 25B HCK

FIG. 25C HCKX

FIG. 25D DCK

FIG. 25E DCKX

FIG. 25F SLP242

FIG. 25G SFTP234

FIG. 25H SFTP233

FIG. 25I SHP241

FIG. 25J SHP234

FIG. 25K SHP233

3311(3312～3314)

FIG. 29A HST
FIG. 29B HCK
FIG. 29C HCKX
FIG. 29D DCK
FIG. 29E DCKX
FIG. 29F SFTP331
FIG. 29G SFTP332
...
FIG. 29H SFTP334
FIG. 29I SFT351
FIG. 29J SHP331
FIG. 29K SHP332
...
FIG. 29L SHP334
FIG. 29M SHP351

FIG. 30A HST
FIG. 30B HCK
FIG. 30C HCKX
FIG. 30D DCK
FIG. 30E DCKX
FIG. 30F SFTP334
FIG. 30G SFTP333
...
FIG. 30H SFTP331
FIG. 30I SFT341
FIG. 30J SHP334
FIG. 30K SHP333
...
FIG. 30L SHP331
FIG. 30M SHP341

DISPLAY DEVICE AND PROJECTION TYPE DISPLAY DEVICE

BACKGROUND OF THE INVENTION

1. Field of the Invention

The present invention relates to a display device and a method for driving the same, more particularly relates to an active matrix type display device and a projection type display device of the point sequential drive system employing the so-called clock drive method for a horizontal drive circuit (horizontal scanner).

2. Description of the Related Art

Display devices, for example, active matrix type liquid crystal display devices using liquid crystal cells for display elements (electrooptic elements) of the pixels employ the point sequential drive system for the horizontal drive circuits (horizontal scanner portions).

FIG. 1 is a circuit diagram showing the configuration of an active matrix type liquid crystal display device employing the general point sequential drive system (refer to for example Japanese Patent Application No. 2001-109460).

This liquid crystal display device (LCD panel) 10 has, as shown in FIG. 1, a valid pixel portion (PXLP) 11, a vertical scanner (VSCN) 12, a horizontal scanner (HSCN) 13, a first clock generation circuit (GEN1: timing generator) 14, and a second clock generation circuit (GEN2) 15 as principal components. Note that, as shown in FIG. 2, the vertical scanner is sometimes arranged at not only one side portion of the pixel portion 11, but at both side portions, and is provided with a signal line precharge circuit (PRCG) 16.

The pixel portion 11 is comprised of a plurality of pixels PXL arrayed in a matrix of n number of rows and m number of columns. Here, for simplification of the figure, a case of a pixel array consisting of 4 rows and 4 columns will be shown as an example. Each of the pixels PXL arranged in the matrix is comprised of a pixel transistor constituted by a thin film transistor (TFT) 11, a liquid crystal cell LC with a pixel electrode connected to a drain electrode of this TFT 11, and a storage capacitor Cs with one electrode connected to the drain electrode of the TFT 11. With respect to each of these pixels PXL, has signal lines SGNL1 to SGNL4 are laid along the pixel array direction for every column and gate lines GTL1 to GTL4 are laid along the pixel array direction for every row. In each of the pixels PXL, a source electrode (or a drain electrode) of the TFT 11 is connected to each of the corresponding signal lines SGNL1 to SGNL4. The gate electrode of the TFT 11 is connected to each of the gate lines GTL1 to GTL4. The counter electrode of the liquid crystal cell LC and the other electrode of the storage capacitor Cs are connected to a Cs line CsL1 common to adjacent pixels. This Cs line CsL1 is given a predetermined DC voltage as a common voltage Vcom. In this pixel portion 11, first side ends of the gate lines GTL1 to GTL4 are connected to for example output ends of rows of the vertical scanner 12 arranged on the left side in the figure of the pixel portion 11.

The vertical scanner 12 performs processing for scanning pixels in the vertical direction (row direction) for every field period and sequentially selecting the pixels PXL connected to the gate lines GTL1 to GTL4 in units of rows. Namely, pixels of columns of the first row are selected when a scanning pulse SP1 is given from the vertical scanner 12 to the gate line GTL1, and pixels of the columns of the second row are selected when a scanning pulse SP2 is given to the gate line GTL2. Below, in the same way, scanning pulses SP3 and SP4 are sequentially given to the gate lines GTL 3 and GTL4.

For example an upper side in the figure of the pixel portion 11 is provided with the horizontal scanner 13. The horizontal scanner 13 performs processing for sequentially sampling input video signals VDO for every 1H (H is a horizontal scanning period) and writing them to the pixels PXL selected in units of rows by the vertical scanner 12. The horizontal scanner 13 employs a clock drive system as shown in FIG. 1 and has a register 131, a clock sampling switch group 132, a phase adjust circuit (PAC) group 133, and a sampling switch group 134.

The shift register 131 has four shift stages (S/R stages) 131-1 to 131-4 corresponding to the pixel columns (four columns in the present example) of the pixel portion 11 and performs a shift operation in synchronization with horizontal clocks HCK and HCKX having inverse phases to each other when the horizontal start pulse HST is given from the first clock generation circuit 14. Due to this, the shift stages 131-1 to 131-4 of the shift register 131 sequentially output shift pulses SFTP1 to SFTP4 having the same pulse width as the periods of the horizontal clocks HCK and HCKX.

The clock sampling switch group 132 has four switches 132-1 to 132-4 corresponding to the pixel columns of the pixel portion 11. First side ends of these switches 132-1 to 132-4 are alternately connected to the clock lines DKL1 and DKXL1 for sending the clocks DCKX and DCK of the second clock generation circuit 15. Namely, first side ends of the switches 132-1 and 132-3 are connected to the clock line DXL, and first side ends of the switches 132-2 and 132-4 are connected to the clock line DKL1. The switches 132-1 to 132-4 of the clock sampling switch group 132 are given the shift pulses SFTP1 to SFTP4 sequentially output from the shift stages 131-1 to 131-4 of the shift register 131. The switches 132-1 to 132-4 of the clock sampling switch group 132 respond to these shift pulses SFTP1 to SFTP4 and sequentially enter the ON state when the shift pulses SFTP1 to SFTP4 are given from the shift stages 131-1 to 131-4 of the shift register 131 and thereby alternately sample the second clocks DCKX and DCK having inverse phases to each other.

The phase adjust circuit group 133 has four phase adjust circuits 133-1 to 133-4 corresponding to the pixel columns of the pixel portion 11, adjust the phases of the second clocks DCKX and DCK sampled at the switches 132-1 to 132-4 of the clock sampling switch group 132, and then supply them to the corresponding sampling switches of the sampling switch group 134.

The sampling switch group 134 has four sampling switches 134-1 to 134-4 corresponding to the pixel columns of the pixel portion 11. First side ends of these sampling switches 134-1 to 134-4 are connected to a video line VDL1 for receiving as input the video signals VDO. The sampling switches 134-1 to 134-4 are given the clocks DCKX and DCK sampled by the switches 132-1 to 132-4 of the clock sampling switch group 132 and adjusted in phase at the phase adjust circuit group 133 as the sample-and-hold pulses SHP1 to SHP4. The sampling switches 134-1 to 134-4 of the sampling switch group 134 respond to the sample-and-hold pulses SHP1 to SHP4 and sequentially enter the ON state when the sample-and-hold pulses SHP1 to SHP4 are given and thereby sequentially sample the video signals VDO input through the video line VDL1 and supply them to the signal lines SGNL1 to SGNL4 of the pixel portion 11.

Further, the first clock generation circuit 14 generates a vertical start pulse VST for instructing the start of the vertical scan, vertical clocks VCK and VCKX having inverse phases to each other and acting as reference of the vertical scan, a horizontal start pulse HST for instructing the start of the horizontal scan, and horizontal clocks HCK and HCKX having inverse phases to each other and acting as reference of the horizontal scan, supplies the vertical start pulse VST and the vertical clocks VCK and VCKX to the vertical scanner 12, and supplies the horizontal clocks HCK and HCKX to the horizontal scanner 13 and the second clock generation circuit 15.

The second clock generation circuit 15 generates second clocks DCK and DCKX having inverse phases to each other which have the same period as the horizontal clocks (first clocks) HCK and HCKX generated at the first clock generation circuit 14 (T1=T2) and have a small duty ratio and supply them to the horizontal scanner 13. Here, the duty ratio means the ratio between a pulse width t and a pulse repetition period T in the pulse waveform. For example, as shown in FIGS. 3A to 3D, a duty ratio (t1/T1) of the horizontal clocks HCK and HCKX is 50%, and a duty ratio (t2/T2) of the clocks DCK and DCKX is smaller than this, that is, the pulse width t2 of the clocks DCK and DCKX is set narrower than the pulse width t1 of the horizontal clocks HCK and HCKX.

In the horizontal scanner 13, the shift pulses SFTP1 to SFTP4 sequentially output from the shift register 131 are not used as the sample-and-hold pulses. The clocks DCKX and DCK having inverse phases to each other are alternately sampled in synchronization with the shift pulses SFTP1 to SFTP4. These clocks DCKX and DCK are used as the sample-and-hold pulses SHP1 to SHP4 via the phase adjust circuit. By this, fluctuation of the sample-and-hold pulses SHP1 to SHP4 can be suppressed. As a result, ghosts caused by fluctuation of the sample-and-hold pulses SHP1 to SHP4 can be eliminated.

In addition, in the horizontal scanner 13, the horizontal clocks HCKX and HCK serving as the reference of the shift operation of the shift register 131 are not sampled and used as the sample-and-hold pulses. The clocks DCKX and DCK having the same period as the horizontal clocks HCKX and HCK and having a small duty ratio are separately generated. These clocks DCKX and DCK are sampled and used as the sample-and-hold pulses SHP1 to SHP4. Therefore, at the time of horizontal driving, complete nonoverlap sampling between sampling pulses can be realized, so generation of vertical stripes due to overlap sampling can be suppressed.

Here, for example, as shown in FIG. 4, an explanation will be given of the operation when writing video signals VDO at the corresponding pixels at the adjacent N-th stage and N+1-th stage in relation to FIGS. 5A to 5D. In this case, for example, when the video signal VDO, a drive signal DRVP-N of the N-th stage signal line SGNL-N, and a drive pulse DRVP-N+1 of the N+1-th stage signal line SGNL-N+1 have the timing relationships as shown in FIGS. 5A to 5C, ideally, a white signal is written into the N-th stage, and a black signal is written into the N+1-th stage, whereby an image without a ghost as shown in FIG. 5D is obtained.

In an LCD using TFTs, however, generally a change occurs in the characteristics of the transistors due to panel aging. Due to this change of characteristics, a pulse delay occurs in each transistor. Finally, the sample-and-hold pulse SHP drifts with respect to its initial state. Due to this drift, the optimum sample-and-hold position with respect to a ghost ends up shifting. With the sample-and-hold position setting at the time of the initial shipment as it is, the video signal of the adjacent stage ends up being sampled and held and a ghost is generated. Specifically, as shown in FIGS. 6A to 6C., the drive signal DRVP-N of the N-th stage signal line SGNL-N and the drive pulse DRVP-N+1 of the N+1-th stage signal line SGNL-N+1 are delayed as indicated by a solid line after aging from the initial state indicated by a broken line. As a result, as shown in FIG. 6D, the black signal is written at the N-th stage, and a ghost GST is generated.

In order to prevent the generation of a ghost due to this drift, the measure of providing a monitor circuit (dummy scanner), outputting the output of the sampling switches thereof to the outside of the panel, monitoring the change of the phase from the initial state of the output by an external IC, and feeding back the amount of change of the phase to the clock of the panel input has become the general practice (refer to for example Japanese Unexamined Patent Publication (Kokai) No. 11-119746 and Japanese Unexamined Patent Publication (Kokai) No. 2000-298459).

FIG. 7 is a block diagram of an example of the configuration of a conventional liquid crystal display provided with a monitor circuit 17. FIG. 8 is a circuit diagram of a concrete example of the configuration of the monitor circuit 17 of FIG. 7 and part of the peripheral horizontal scanner 13.

The monitor circuit 17 of FIG. 8 is provided adjacent to the first stage of the horizontal scanner 13, that is, the stage to which the horizontal start pulse HST is input at first to start the shift operation. The monitor circuit 17 is ideally configured in the same way as the configuration of each stage of the horizontal scanner 13 for making the amounts of delay of the output pulses of the stages of the horizontal scanner 13 uniform. The monitor circuit 17 of FIG. 8 has a shift stage (S/R) stage 171 for receiving as input the horizontal start pulse HST and outputting a shift pulse SFTP17, a switch 172 for sampling the second clock DCKX by the shift pulse SFTP17 by the shift stage 171, a phase adjust circuit 173 for generating a sample-and-hold pulse SHP17 comprised of two signals taking complementary levels by adjusting the phase of the clock DCLX sampled by the switch 171, and a sampling switch 174 controlled in connection between the first terminal and the second terminal by the sample-and-hold pulse SHP17 by the phase adjust circuit 173.

The sampling switch 174 of the monitor circuit 17 is grounded at the first terminal and is connected to one end of the monitor line MNTL1 at the other end. The other end of the monitor line MNTL1 is connected to a feedback IC 18 of the outside of the LCD panel. The monitor line MNTL1 is pulled up at the outside of the panel. The external feedback IC 18 monitors the change of phase from the initial state from the timing when the sampling switch 173 becomes conductive and the monitor line MNTL1 shifts to the ground level and feeds back the amount of the change of the phase to the clock of the panel input. Note that the example of FIG. 8 is configured so that the horizontal clocks HCKX, HCK, etc. are generated by the external feedback IC 18.

Summarizing the problems of the invention, the active matrix type liquid crystal display device employing the point sequential drive system explained above is used as for example the display panel of a projection type liquid crystal display device (liquid crystal projector), that is, a LCD panel. In the case of color, three LCD panels are arranged corresponding to the three primary colors R (red), G (green), and B (blue). In this case, due to the relationships of the optical systems and the optical paths, in one liquid crystal display panel, it is necessary to invert from the other liquid crystal display panels and perform an inverse scan at the horizontal scanner. For this reason, the LCD panels are configured so as to have not only the function of scanning from for example the left side in the figure of FIG. 1, but also the function of scanning from the right side in the figure, that is, an inverse scan, in accordance with the application.

In a circuit provided with one conventional monitor circuit (dummy scanner), however, a horizontal scanner in which the phase of the clock is inverted by the left/right inversion has the following disadvantages since generally the number of the shift registers provided in the horizontal scanner 13 is even.

As shown in FIGS. 9A to 9K, when the scan is performed from left to right, for example, as shown in FIG. 9B, when assigning the notations <1>, <2>, and <3> to the pulses of the horizontal clock HCK, at the second timing <2> of the horizontal clock HCK and the timing of the second clock DCKX, the sample-and-hold pulse SHP1 of the first stage of the horizontal scanner 13 and the sample-and-hold pulse SHP17 of the monitor circuit 17 are generated at substantially the same timing and the image is display without problem.

As opposed to this, as shown in FIGS. 10A to 10K, when scanning from right to left, for example, as shown in FIG. 10B, when assigning the notations <1>, <2>, and <3> to the pulses of the horizontal clock HCK, at the first timing <1> of the horizontal clock HCK and the timing of the second clock DCKX, the sample-and-hold pulse SHP17 of the monitor circuit 17 is generated. SHP1 is generated at the timing <2> and the timing of the first clock DCK. Namely, in this case, the phase of the sample-and-hold pulse SHP17 for feedback was changed by the amount of one pulse by the left/right inversion, and correct feedback could not be carried out. In such a case, the image ends up being deviated by half and an image cannot be displayed with a high precision.

SUMMARY OF THE INVENTION

An object of the present invention is to provide a display device and a projection type display device wherein even in a horizontal scanner wherein the phase of the clock is inverted in the scanning direction inversion, a high precision image display is realized no matter what the scanning direction of operation without a change of phase of the output potential change.

To attain the above object, according to a first aspect of the present invention, there is provided a display device comprising a pixel portion in which a plurality of pixels are arrayed in a matrix and signal lines are laid for every pixel column; a monitor line held at a first potential; a control circuit for generating at least a clock signal and an inverse clock signal having inverse phases to each other and serving as reference of a horizontal scan, monitoring the potential change of the monitor line, and correcting the timings of generation of at least the clock signal and inverse clock signal based on the change of the timing of the potential change; a horizontal scanner; and a monitor circuit, wherein the horizontal scanner includes a shift register, in which a plurality of shift stages are cascade connected, which is able to switch between a first scanning operation for sequentially shifting from a first stage to a last stage and a second scanning operation for sequentially shifting from the last stage to the first stage in accordance with the switch signal and sequentially outputs shift pulses from the shift stages in synchronization with the clock signal and inverse clock signal at the time of the first scanning operation or the time of the second scanning operation, a first switch group for alternately sequentially sampling the clock signal and inverse clock signal in response to the shift pulses output from the corresponding shift stages of the shift register and outputting them as sample-and-hold pulses, and a second switch group for sequentially sampling video signals in response to the sample-and-hold pulses from the switches of the first switch group and supplying them to the corresponding signal lines of the pixel portion, and the monitor circuit includes a selector portion for receiving the switch signal, sampling signals different from the signal sampled by the first shift stage of the shift register in the horizontal scanner among the clock signal and inverse clock signal when the switch signal indicates the first scanning operation and sampling signals different from the signal sampled by the last shift stage of the shift register in the horizontal scanner among the clock signal and inverse clock signal when the switch signal indicates the second scanning operation, and outputting the same as the sample-and-hold pulses, and a third switch for setting the potential of the monitor line at a second potential in response to the sample-and-hold pulses from the selector portion.

According to a second aspect of the present invention, there is provided a projection type display comprising a monitor line held at a first potential; a control circuit for generating at least a clock signal and an inverse clock signal having inverse phases to each other and serving as reference of a horizontal scan, monitoring the potential change of the monitor line, and correcting at least the timings of generation of the clock signal and inverse clock signal based on the change of the timing of the potential change; a display panel including a pixel portion in which a plurality of pixels are arrayed in a matrix and signal lines are laid for every pixel column, a horizontal scanner, and a monitor circuit; an irradiating means for irradiating the light to the display panel; and a projecting means for projecting light passing through the display panel onto a screen, wherein the horizontal scanner of the display panel includes a shift register in which a plurality of shift stages are cascade connected, which can switch between a first scanning operation for sequentially shifting from a first stage to a last stage and a second scanning operation for sequentially shifting from the last stage to the first stage in accordance with the switch signal and sequentially outputs shift pulses from the shift stages in synchronization with the clock signal and inverse clock signal at the time of the first scanning operation or the time of the second scanning operation, a first switch group for alternately sequentially sampling the clock signal and inverse clock signal in response to the shift pulses output from the corresponding shift stages of the shift register and outputting them as sample-and-hold pulses, and a second switch group for sequentially sampling video signals in response to the sample-and-hold pulses from the switches of the first switch group and supplying them to the corresponding signal lines of the pixel portion, and the monitor circuit of the display panel includes a selector portion for receiving the switch signal, sampling signals different from the signal sampled by the first shift stage of the shift register in the horizontal scanner among the clock signal and inverse clock signal when the switch signal indicates the first scanning operation and sampling signals different from the signal sampled by the last shift stage of the shift register in the horizontal scanner among the clock signal and inverse clock signal when the switch signal indicates the second scanning operation, and outputting the same as the sample-and-hold pulses, and a third switch for setting the potential of the monitor line at a second potential in response to the sample-and-hold pulses from the selector portion.

Preferably, the selector portion has a fourth switch for receiving a select pulse and sampling the clock signal and outputting the same as the sample-and-hold pulse to the third switch, a fifth switch for receiving the select pulse and sampling the inverse clock signal and outputting the same as the sample-and-hold pulse to the third switch, and a selector for receiving the switch signal, outputting the select pulses to the fourth switch when the switch signal indicates the first scanning operation, and outputting the select pulses to the fifth switch when the switch signal indicates the second scanning operation.

Preferably, the first scanning operation and the second scanning operation are started by receiving the horizontal start pulse, the horizontal start pulse is supplied to the initial shift stage of the shift register and the monitor circuit at the time of the first scanning operation, supplied to the last shift stage of the shift register and the monitor circuit at the time of the second scanning operation, and the selector of the monitor circuit supplies the horizontal start pulse as the select pulse to the fourth switch or fifth switch in accordance with the switch signal.

More preferably, the selector has a first transfer line for transferring the horizontal start pulse as the select pulse to the fourth switch, a second transfer line for transferring the horizontal start pulse as the select pulse to the fifth switch, a first select switch for connecting the first transfer line to the supply line of the horizontal start pulse when the switch signal indicates the first scanning operation, a second select switch for connecting the second transfer line to the supply line of the horizontal start pulse when the switch signal indicates the second scanning operation, and a potential setting means for retaining the first transfer line or the second transfer line in a nonconnection state with the supply line of the horizontal start pulse at a potential able to hold the fourth switch or the fifth switch to which the first transfer line or the second transfer line is connected in a nonconductive state.

Preferably, the number of the shift stages in the shift register of the horizontal scanner is even.

Preferably, provision is made of a clock generating means for generating, based on the clock signal and the inverse clock signal generated at the control circuit, a second clock signal and a second inverse clock signal having the same period as the clock signal and inverse clock signal and having a small duty ratio and supplying the same to the horizontal scanner and monitor circuit, and each switch of the first switch group of the horizontal scanner and the fourth switch or the fifth switch of the monitor circuit samples the second clock signal or second inverse clock signal from the clock generating means.

Preferably, the display element of the pixels is a liquid crystal cell.

According to the present invention, in for example the control circuit, the clock signal and inverse clock signal having inverse phases to each other and serving as reference of a horizontal scan are generated and supplied to the horizontal scanner and the monitor circuit. Further, the first scanning operation or the second scanning operation for scanning in the inverse direction to that of the first scanning operation is designated by for example the switch signal. When the first scanning operation is designated, for example the horizontal start pulse is supplied to the monitor circuit and the first shift stage in the shift register of the horizontal scanner. Further, the switch signal is input to the monitor circuit. At this time, the switch signal indicates the first scanning operation, therefore, in the selector portion, the supplied horizontal start pulse is output as the select pulse to the fourth switch. At the fourth switch, a signal different from the clock signal or the inverse clock signal sampled by the initial shift stage of the horizontal scanner is sampled and output as the sample-and-hold pulse to the third switch. At the third switch, in response to the sample-and-hold pulses from the fourth switch of the selector portion, the potential of the monitor line is set from the first potential to the second potential (for example ground potential). In the horizontal scanner, the shift pulses are sequentially output to the corresponding switches of the first switch group from the shift stages in synchronization with the clock signal and inverse clock signal. In the first switch group, the clock signal and the inverse clock signal are alternately sequentially sampled in response to the shift pulses output from the corresponding shift stages. Then, the sampled signals are output to the corresponding switches of the second switch group as the sample-and-hold pulses. In the second switch group, the input video signals are sequentially sampled in response to the sample-and-hold pulses from the switches of the first switch group and supplied to the corresponding signal lines of the pixel portion. Further, in the control circuit, the potential change of the monitor line is monitored. Specifically, in the control circuit, the change of the phase of the output of the monitor circuit from the initial state is monitored, and the timings of generations of the clock signal and the inverse clock signal are corrected so as to cancel the amount of change of the phase. Due to this, the drift of the sample-and-hold pulses due to the change of the characteristics of the transistors due to panel aging etc. is corrected.

When the second scanning operation is designated, for example the horizontal start pulse is supplied to the monitor circuit and the last shift stage in the shift register of the horizontal scanner. Further, the switch signal is input to the monitor circuit. At this time, the switch signal indicates the second scanning operation, therefore, in the selector portion, the supplied horizontal start pulse is output as the select pulse to the fifth switch. At the fifth switch, a signal different from the clock signal or inverse clock signal sampled by the last shift stage of the horizontal scanner is sampled and output as the sample-and-hold pulses to the third switch. At the third switch, the potential of the monitor line is set from the first potential to the second potential (for example ground potential) in response to the sample-and-hold pulses from the fifth switch of the selector portion. In the horizontal scanner, the shift pulses are sequentially output to the corresponding switches of the first switch group from the shift stages in synchronization with the clock signal and inverse clock signal. In the first switch group, the clock signal and the inverse clock signal are alternately sequentially sampled in response to the shift pulses output from the corresponding shift stages. Then, the sampled signals are output to the corresponding switches of the second switch group as the sample-and-hold pulses. In the second switch group, the input video signals are sequentially sampled in response to the sample-and-hold pulses from the switches of the first switch group and supplied to the corresponding signal lines of the pixel portion. Further, in the control circuit, the potential change of the monitor line is monitored. Specifically, in the control circuit, the change of the phase of the output of the monitor circuit from the initial state is monitored, and the timings of generations of the clock signal and the inverse clock signal are corrected so as to cancel the amount of change of the phase. Due to this, the drift of the sample-and-hold pulses due to the change of characteristics of the transistors due to panel aging etc. is corrected. In this way, even in a horizontal scanner wherein the phase of the clock is inverted in the scanning direction inversion, a high precision image display is realized no matter what the scanning direction of operation without a change of phase of the output potential change.

According to a third aspect of the present invention, there is provided a display having a pixel portion in which a plurality of pixels are arrayed in a matrix and signal lines are laid for every pixel column; a monitor line held at a first potential; a control circuit for generating at least a first clock signal and a first inverse clock signal having inverse phases to each other and serving as reference of a horizontal scan, monitoring the potential change of the monitor line, and correcting the timings of generation of at least the clock signal and inverse clock signal based on the change of the timing of the potential change; a clock generation circuit for generating a second clock signal and a second inverse clock signal having the same period as the first clock signal and first inverse clock signal and having a small duty ratio based on the first clock signal and first inverse clock signal generated at the control circuit; a horizontal scanner; and a monitor circuit, wherein the horizontal scanner includes a shift register, in which a plurality of shift-stages are cascade connected, which can switch between a first scanning operation for sequentially shifting from a first stage to a last stage and a second scanning operation for sequentially shifting from the last stage to the first stage in accordance with the switch signal and sequentially outputs shift pulses from the shift stages in synchronization with the clock signal and inverse clock signal at the time of the first scanning operation or the time of the second scanning operation, a first switch group for alternately sequentially sampling the second clock signal and second inverse clock signal in response to the shift pulses output from the corresponding shift stages of the shift register and outputting them as sample-and-hold pulses, and a second switch group for sequentially sampling video signals in response to the sample-and-hold pulses from the switches of the first switch group and supplying them to the corresponding signal lines of the pixel portion, and the monitor circuit includes a selector portion for receiving the switch signal, sampling signals having different phases from that of the signal sampled by the first shift stage of the shift register in the horizontal scanner between the first clock signal and first inverse clock signal when the switch signal indicates the first scanning operation and sampling signals having different phases from that of the signal sampled by the last shift stage of the shift register in the horizontal scanner between the first clock signal and first inverse clock signal when the switch signal indicates the second scanning operation, and outputting the same as the sample-and-hold pulses, and a third switch for setting the potential of the monitor line at a second potential in response to the sample-and-hold pulses from the selector portion.

According to a fourth aspect of the present invention, there is provided a projection type display comprising a monitor line held at a first potential; a control circuit for generating at least a clock signal and an inverse clock signal having inverse phases to each other and serving as reference of a horizontal scan, monitoring the potential change of the monitor line, and correcting at least the timings of generation of the clock signal and inverse clock signal based on the change of the timing of the potential change; a clock generation circuit for generating a second clock signal and a second inverse clock signal having the same period as the first clock signal and first inverse clock signal and having a small duty ratio based on the first clock signal and first inverse clock signal generated at the control circuit; a display panel including at least a pixel portion in which a plurality of pixels are arrayed in a matrix and signal lines are laid for every pixel column, a horizontal scanner, and a monitor circuit; an irradiating means for irradiating light to the display panel; and a projecting means for projecting the light passed through the display panel onto a screen, wherein the horizontal scanner of the display panel includes a shift register, in which a plurality of shift stages are cascade connected, which can switch between a first scanning operation for sequentially shifting from a first stage to a last stage and a second scanning operation for sequentially shifting from the last stage to the first stage in accordance with the switch signal and sequentially outputs shift pulses from the shift stages in synchronization with the clock signal and inverse clock signal at the time of the first scanning operation or the time of the second scanning operation, a first switch group for alternately sequentially sampling the second clock signal and second inverse clock signal in response to the shift pulses output from the corresponding shift stages of the shift register and outputting them as sample-and-hold pulses, and a second switch group for sequentially sampling video signals in response to the sample-and-hold pulses from the switches of the first switch group and supplying them to the corresponding signal lines of the pixel portion, and the monitor circuit of the display panel includes a selector portion for receiving the switch signal, sampling signals having different phases from that of the signal sampled by the first shift stage of the shift register in the horizontal scanner between the first clock signal and first inverse clock signal when the switch signal indicates the first scanning operation and sampling signals having different phases from that of the signal sampled-by the last shift stage of the shift register in the horizontal scanner between the first clock signal and first inverse clock signal when the switch signal indicates the second scanning operation, and outputting the same as the sample-and-hold pulses, and a third switch for setting the potential of the monitor line at a second potential in response to the sample-and-hold pulses from the selector portion.

Preferably, the selector portion has a fourth switch for receiving a select pulse and sampling the clock signals and outputting the same as the sample-and-hold pulse to the third switch, a fifth switch for receiving the select pulse and sampling the inverse clock signal and outputting the same as the sample-and-hold pulse to the third switch, and a selector for receiving the switch signal, outputting the select pulse to the fourth switch when the switch signal indicates the first scanning operation, and outputting the select pulses to the fifth switch when the switch signal indicates the second scanning operation.

Preferably, the first scanning operation and the second scanning operation are started by receiving the horizontal start pulse, the horizontal start pulse is supplied to the initial shift stage of the shift register and the monitor circuit at the time of the first scanning operation and supplied to the last shift stage of the shift register and the monitor circuit at the time of the second scanning operation, and the selector of the monitor circuit supplies the horizontal start pulse as the select pulse to the fourth switch or fifth switch in accordance with the switch signal.

More preferably, the selector has a first transfer line for transferring the horizontal start pulse as the select pulse to the fourth switch, a second transfer line for transferring the horizontal start pulse as the select pulse to the fifth switch, a first select switch for connecting the first transfer line to the supply line of the horizontal start pulse when the switch signal indicates the first scanning operation, a second select switch for connecting the second transfer line to the supply line of the horizontal start pulse when the switch signal indicates the second scanning operation, and a potential setting means for holding the first transfer line or the second transfer line in a nonconnection state with the supply line of the horizontal start pulse at a potential able to hold the fourth switch or the fifth switch to which the first transfer line or the second transfer line is connected in a nonconductive state.

Preferably, the number of the shift stages in the shift register of the horizontal scanner is even.

Preferably, the display element of the pixels is a liquid crystal cell.

According to the present invention, in for example the control circuit, the clock signal and inverse clock signal having inverse phases to each other and serving as reference of a horizontal scan are generated and supplied to the horizontal scanner and the monitor circuit. Further, the first scanning operation or the second scanning operation for scanning in the inverse direction to that of the first scanning operation is designated by for example the switch signal. When the first scanning operation is designated, for example the horizontal start pulse is supplied to the monitor circuit and the first shift stage in the shift register of the horizontal scanner. Further, the switch signal is input to the monitor circuit. At this time, the switch signal indicates the first scanning operation. Therefore, in the selector portion, the supplied horizontal start pulse is output as the select pulse to the fourth switch. At the fourth switch, the first clock signal or first inverse clock signal having a different phase from that of the second clock signal or the second inverse clock signal to be sampled by the initial shift stage of the horizontal scanner is sampled and output as the sample-and-hold pulse to the third switch. At the third switch, in response to the sample-and-hold pulses from the fourth switch of the selector portion, the potential of the monitor line is set from the first potential to the second potential (for example ground potential). In the horizontal scanner, the shift pulses are sequentially output to the corresponding switches of the first switch group from the shift stages in synchronization with the first clock signal and first inverse clock signal. In the first switch group, the second clock signal and the second inverse clock signal are alternately sequentially sampled in response to the shift pulses output from the corresponding shift stages. Then, the sampled signals are output to the corresponding switches of the second switch group as the sample-and-hold pulses. In the second switch group, the input video signals are sequentially sampled in response to the sample-and-hold pulses from the switches of the first switch group and supplied to the corresponding signal lines of the pixel portion. Further, in the control circuit, the potential change of the monitor line is monitored. Specifically, in the control circuit, the change of the phase of the output of the monitor circuit from the initial state is monitored, and the timings of generation of the clock signal and the inverse clock signal are corrected so as to cancel the amount of change of the phase. Due to this, the drift of the sample-and-hold pulses due to the change of characteristics of the transistors due to the panel aging etc. is corrected.

When the second scanning operation is designated, for example the horizontal start pulse is supplied to the monitor circuit and the last shift stage in the shift register of the horizontal scanner. Further, the switch signal is input to the monitor circuit. At this time, the switch signal indicates the second scanning operation, therefore, in the selector portion, the supplied horizontal start pulse is output as the select pulse to the fifth switch. At the fifth switch, a signal having a different phase from that of the first clock signal or first inverse clock signal sampled by the last shift stage of the horizontal scanner is sampled and output as the sample-and-hold pulses to the third switch. At the third switch, the potential of the monitor line is set from the first potential to the second potential (for example ground potential) in response to the sample-and-hold pulses from the fifth switch of the selector portion. In the horizontal scanner, the shift pulses are sequentially output to the corresponding switches of the first switch group from the shift stages in synchronization with the first clock signal and first inverse clock signal. In the first switch group, the second clock signal and the second inverse clock signal are alternately sequentially sampled in response to the shift pulses output from the corresponding shift stages. Then, the sampled signals are output to the corresponding switches of the second switch group as the sample-and-hold pulses. In the second switch group, the input video signals are sequentially sampled in response to the sample-and-hold pulses from the switches of the first switch group and supplied to the corresponding signal lines of the pixel portion. Further, in the control circuit, the potential change of the monitor line is monitored. Specifically, in the control circuit, the change of the phase of the output of the monitor circuit from the initial state is monitored, and the timings of generation of the first clock signal and the first inverse clock signal are corrected so as to cancel the amount of change of the phase. Due to this, the drift of the sample-and-hold pulses due to the change of characteristics of the transistors due to panel aging etc. is corrected. In this way, even in a horizontal scanner wherein the phase of the clock is inverted in the scanning direction inversion, a high precision image display is realized no matter what the scanning direction of operation without a change of phase of the output potential change. Further, a sample-and-hold pulse having a margin against ghosts increasing along with aging can be obtained.

According to a fifth aspect of the present invention, there is provided a display comprising a pixel portion in which a plurality of pixels are arrayed in a matrix and signal lines are laid for every pixel column; a monitor line held at a first potential; a control circuit for generating at least a clock signal and an inverse clock signal having inverse phases to each other and serving as reference of a horizontal scan, monitoring the potential change of the monitor line, and correcting the timings of generation of at least the clock signal and inverse clock signal based on the change of the timing of the potential change; a horizontal scanner; a first monitor circuit; and a second monitor circuit, wherein the horizontal scanner includes a shift register, in which a plurality of shift stages are cascade connected, which can switch between a first scanning operation for sequentially shifting from a first stage to a last stage and a second scanning operation for sequentially shifting from the last stage to the first stage in accordance with the switch signal and sequentially outputs shift pulses from the shift stages in synchronization with the clock signal and inverse clock signal at the time of the first scanning operation or the time of the second scanning operation, a first switch group for alternately sequentially sampling the clock signal and inverse clock signal in response to the shift pulses output from the corresponding shift stages of the shift register and outputting them as sample-and-hold pulses, and a second switch group for sequentially sampling video signals in response to the sample-and-hold pulses from the switches of the first switch group and supplying them to the corresponding signal lines of the pixel portion, the first monitor circuit includes a shift stage which is connected to the last shift stage of the shift register in the horizontal scanner at the time of the first scanning operation and outputs the shift pulses in synchronization with the clock signal and inverse clock signal when performing shift-in of the signal by the last shift stage, a third switch for sampling signals different from the signal sampled from the last shift stage among the clock signal and inverse clock signal in response to the shift pulse output from the shift stage and outputting the same as the sample-and-hold pulses, and a fourth switch for setting the potential of the monitor line at a second potential in response to the sample-and-hold pulses from the third switch, and the second monitor circuit includes a shift stage which is connected to the initial shift stage of the shift register in the horizontal scanner at the time of the second scanning operation and outputs the shift pulses in synchronization with the clock signal and inverse clock signal when performing the shift-in of the signal by the initial shift stage, a fifth switch for sampling signals different from that of the signal sampled from the initial shift stage between the clock signal and inverse clock signal in response to the shift pulses output from the shift stage and outputting the same as the sample-and-hold pulses, and a sixth switch for setting the potential of the monitor line at the second potential in response to the sample-and-hold pulses from the fifth switch.

According to a sixth aspect of the present invention, there is provided a projection type display comprising a monitor line held at a first potential; a control circuit for generating at least a clock signal and an inverse clock signal having inverse phases to each other and serving as reference of a horizontal scan, monitoring the potential change of the monitor line, and correcting at least the timings of generation of the clock signal and inverse clock signal based on the change of the timing of the potential change; a display panel including a pixel portion in which a plurality of pixels are arrayed in a matrix and signal lines are laid for every pixel column, a horizontal scanner, a first monitor circuit, and a second monitor circuit; an irradiating means for irradiating light to the display panel; and a projecting means for projecting the light passed through the display panel onto a screen, wherein the horizontal scanner of the display panel includes a shift register, in which a plurality of shift stages are cascade connected, which can switch between a first scanning operation for sequentially shifting from a first stage to a last stage and a second scanning operation for sequentially shifting from the last stage to the first stage in accordance with the switch signal and sequentially outputs shift pulses from the shift stages in synchronization with the clock signal and inverse clock signal at the time of the first scanning operation or the time of the second scanning operation, a first switch group for alternately sequentially sampling the clock signal and inverse clock signal in response to the shift pulses output from the corresponding shift stages of the shift register and outputting them as sample-and-hold pulses, and a second switch group for sequentially sampling video signals in response to the sample-and-hold pulses from the switches of the first switch group and supplying them to the corresponding signal lines of the pixel portion, the first monitor circuit of the display panel includes a shift stage which is connected to the last shift stage of the shift register in the horizontal scanner at the time of the first scanning operation and outputs the shift pulses in synchronization with the clock signal and inverse clock signal when performing the shift-in of the signal by the last shift stage, a third switch for sampling signals different from the signal sampled from the last shift stage among the clock signal and inverse clock signal in response to the shift pulse output from the shift stage and outputting the same as the sample-and-hold pulses, and a fourth switch for setting the potential of the monitor line at a second potential in response to the sample-and-hold pulses from the third switch, and the second monitor circuit of the display panel includes a shift stage which is connected to the initial shift stage of the shift register in the horizontal scanner at the time of the second scanning operation and outputs the shift pulses in synchronization with the clock signal and inverse clock signal when performing the shift-in of the signal by the initial shift stage, a fifth switch for sampling signals different from that of the signal sampled from the initial shift stage between the clock signal and inverse clock signal in response to the shift pulses output from the shift stage and outputting the same as the sample-and-hold pulses, and a sixth switch for setting the potential of the monitor line at the second potential in response to the sample-and-hold pulses from the fifth switch.

Preferably, the first scanning operation and the second scanning operation are started by receiving the horizontal start pulse, and the horizontal start pulse is supplied to the initial shift stage of the shift register at the time of the first scanning operation, supplied to the last shift stage of the shift register at the time of the second scanning operation, and not supplied to the first monitor circuit and the second monitor circuit.

Preferably, the first monitor circuit is arranged in the vicinity of the arrangement position of the last shift stage of the horizontal scanner, and the second monitor circuit is arranged in the vicinity of the arrangement position of the initial shift stage of the horizontal scanner.

The monitor line is shared by the first monitor circuit and the second monitor circuit. Preferably, the monitor line is individually formed as a first monitor line connected to the first monitor circuit and as a second monitor line connected to the second monitor circuit.

Preferably, the number of shift stages in the shift register of the horizontal scanner is even.

Preferably, provision is made of a clock generating means for generating, based on the clock signal and the inverse clock signal generated at the control circuit, a second clock signal and a second inverse clock signal having the same period as the clock signal and inverse clock signal and having a small duty ratio and supplying the same to the horizontal scanner, first monitor circuit, and the second monitor circuit, and each switch of the first switch group of the horizontal scanner, the third switch of the first monitor circuit, and the fifth switch of the second monitor circuit samples the second clock signal or second inverse clock signal from the clock generating means.

Further, the display element of the pixels is a liquid crystal cell.

According to the present invention, in for example the control circuit, the clock signal and inverse clock signal having inverse phases to each other and serving as reference of a horizontal scan are generated and supplied to the horizontal scanner and the first monitor circuit (and/or second monitor circuit). Further, the first scanning operation or the second scanning operation for scanning in the inverse direction to that of the first scanning operation is designated by for example the switch signal. When the first scanning operation is designated, for example the horizontal start pulse is supplied to the initial shift stage in the shift register of the horizontal scanner. Further, in the horizontal scanner, the shift pulses are sequentially output to the corresponding switches of the first switch group from the shift stages in synchronization with the clock signal and inverse clock signal. In the first switch group, the clock signal and the inverse clock signal are alternately sequentially sampled in response to the shift pulses output from the corresponding shift stages. Further, the sampled signals are output to the corresponding switches of the second switch group as the sample-and-hold pulses. In the second switch group, the input video signals are sequentially sampled in response to the sample-and-hold pulses from the switches of the first switch group and supplied to the corresponding signal lines of the pixel portion. When the first scanning operation in the above horizontal scanner is carried out up to the last shift stage, the signal by the last shift stage of the horizontal scanner is shifted in the shift stage of the first monitor circuit. Due to this, the shift pulses are output to the third switch in synchronization with the clock signal and the inverse clock signal at the shift stage of the first monitor circuit. In the third switch, a signal different from the signal sampled by the last shift stage of the horizontal scanner between the clock signal and the inverse clock signal is sampled in response to the shift pulse output from the shift stage and output as the sample-and-hold pulses to the fourth switch. In the fourth switch of the first monitor circuit, the potential of the monitor line is set from the first potential to the second potential (for example ground potential) in response to the sample-and-hold pulse from the third switch. Further, in the control circuit, the potential change of the monitor line is monitored. Specifically, in the control circuit, the change of the phase of the output of the first monitor circuit from the initial state is monitored, and the timings of generation of the clock signal and the inverse clock signal are corrected so as to cancel the amount of change of the phase. Due to this, the drift of the sample-and-hold pulses due to the change of characteristics of the transistors due to panel aging etc. is corrected.

When the second scanning operation is designated, for example, the horizontal start pulse is supplied to the last shift stage in the shift register of the horizontal scanner. Then, in the horizontal scanner, the shift pulses are sequentially output to the corresponding switches of the first switch group from the shift stages in synchronization with the clock signal and inverse clock signal. In the first switch group, the clock signal and the inverse clock signal are alternately sequentially sampled in response to the shift pulses output from the corresponding shift stages. Then, the sampled signals are output to the corresponding switches of the second switch group as the sample-and-hold pulses. In the second switch group, the input video signals are sequentially sampled in response to the sample-and-hold pulses from the switches of the first switch group and supplied to the corresponding signal lines of the pixel portion. When the first scanning operation in the above horizontal scanner is carried out up to the initial shift stage, the signal from the initial shift stage of the horizontal scanner is shifted in the shift stage of the second monitor circuit. Due to this, the shift pulses are output to the fifth switch in synchronization with the clock signal and the inverse clock signal at the shift stage of the second monitor circuit. At the fifth switch, a signal different from the signal sampled by the initial shift stage of the horizontal scanner between the clock signal and inverse clock signal is sampled in response to the shift pulse output from the shift stage and output as the sample-and-hold pulses to the sixth switch. At the sixth switch of the second monitor circuit, the potential of the monitor line is set from the first potential to the second potential (for example ground potential) in response to the sample-and-hold pulses from the fifth switch. Further, in the control circuit, the potential change of the monitor line is monitored. Specifically, in the control circuit, the change of the phase of the output of the first monitor circuit from the initial state is monitored, and the timings of generation of the clock signal and inverse clock signal are corrected so as to cancel the change of the phase. Due to this, the drift of the sample-and-hold pulse due to the change of characteristics of the transistors by panel aging etc. is corrected. In this way, even in a horizontal scanner wherein the phase of the clock is inverted in the scanning direction inversion, a high precision image display is realized no matter what the scanning direction of operation without a change of phase of the output potential change.

BRIEF DESCRIPTION OF THE DRAWINGS

These and other objects and features of the present invention will become clearer from the following description of the preferred embodiments given with reference to the attached drawings, wherein:

FIGS. 5A to 5D are waveform diagrams for explaining the operation focusing on the horizontal scanner;

FIGS. 6A to 6D are views for explaining the problems of the horizontal scanner of FIG. 1;

FIGS. 15A to 15K are timing charts for explaining a usual scanning operation of the circuit of FIG. 11;

FIGS. 16A to 16K are timing charts for explaining an inverse scanning operation of the circuit of FIG. 11;

FIGS. 24A to 24K are timing charts for explaining the usual scanning operation of the circuit of FIG. 17;

FIGS. 25A to 25K are timing charts for explaining the inverse scanning operation of the circuit of FIG. 17;

DESCRIPTION OF THE PREFERRED EMBODIMENTS

Below, a detailed explanation will be given of embodiments of the present invention.

FIRST EMBODIMENT

Figure 11:
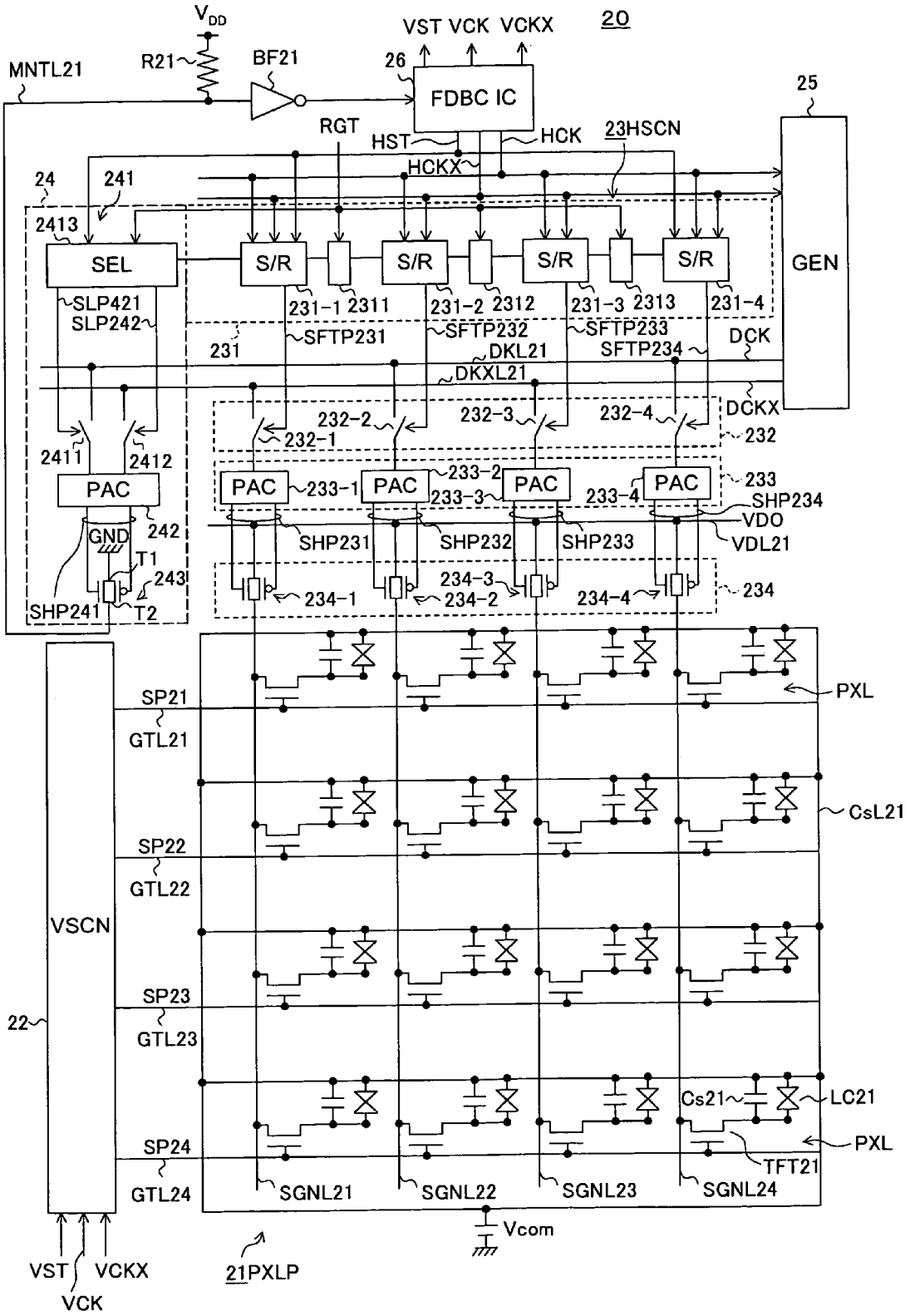
FIG. 11 is a circuit diagram of an example of the configuration of an active matrix type liquid crystal display device of the point sequential drive system according to a first embodiment of the present invention.

FIG. 11 is a circuit diagram of an example of the configuration of an active matrix type liquid crystal display device of the point sequential drive system according to a first embodiment of the present invention using for example liquid crystal cells as display elements (electrooptic elements) of the pixels.

Figure 12:
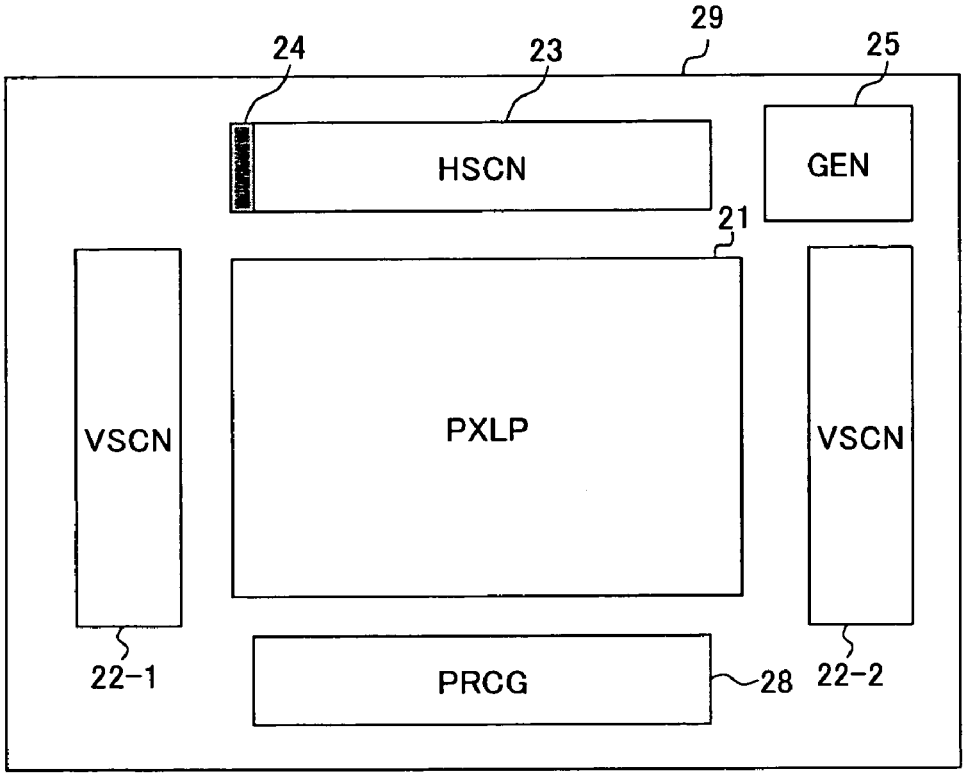
FIG. 12 is a block diagram of an example of the configuration of a display panel of the active matrix type liquid crystal display device of FIG. 11.

This liquid crystal display device 20 has, as shown in FIG. 11, a valid pixel portion (PXLP) 21, a vertical scanner (VSCN) 22, a horizontal scanner (HSCN) 23, a monitor circuit (MNT) 24, a clock generation circuit (GEN) 25, and a feedback control circuit (FDBCIC) 26 including a timing generator as its principal components. Note that, as shown in FIG. 12, the vertical scanner is arranged at not only one side portion of the pixel portion 21 (left side portion in the figure), but at both side portions (left side portion and right side portion in the figure) and is provided with a precharge circuit (PRCG) 27 of the signal lines. Further, the valid pixel portion (PXLP) 21, the vertical scanner (VSCN) 22 (22-1, 22-2), the horizontal scanner (HSCN) 23, the monitor circuit 24, and the clock generation circuit (GEN) 25 (and the precharge circuit 27) are mounted at the display panel (LCD panel) 28.

The pixel portion 21 is comprised of a plurality of pixels PXL arrayed in a matrix consisting of n number of rows and m number of columns. Here, for simplification of the figure, a case of a pixel array consisting of 4 rows and 4 columns will be shown as an example. Each of the pixels PXL arranged in the matrix is comprised of a pixel transistor constituted by a thin film transistor (TFT) 21, a liquid crystal cell LC21 with a pixel electrode connected to a drain electrode of this TFT 21, and a storage capacitor Cs21 with one electrode connected to a drain electrode of the TFT 21. With respect to each of these pixels PXL, signal lines SGNL21 to SGNL24 are laid along the pixel array direction for every column and gate lines GTL21 to GTL24 are laid along the pixel array direction for every row. In each of the pixels PXL, a source electrode (or a drain electrode) of the TFT 21 is connected to each of the corresponding signal lines SGNL21 to SGNL24. The gate electrode of the TFT 21 is connected to each of the gate lines GTL21 to GTL24. The counter electrode of the liquid crystal cell LC21 and the other electrode of the storage capacitor Cs21 are commonly connected to a Cs line CsL21 between adjacent pixels. This Cs line CsL21 is given a predetermined DC current as a common voltage Vcom. In this pixel portion 21, first side ends of the gate lines GTL21 to GTL24 are connected to for example output ends of rows of the vertical scanner 22 arranged on for example the left side in the figure of the pixel portion 21.

The vertical scanner 22 performs processing for scanning pixels in the vertical direction (row direction) for every field period and sequentially selecting the pixels PXL connected to the gate lines GTL21 to GTL24 in units of rows. That is, pixels PXL of columns of the first row are selected when a scanning pulse SP21 is given from the vertical scanner 22 to the gate line GTL21, and pixels PXL of columns of the second row are selected when a scanning pulse SP22 is given to the gate line GTL22. Below, in the same way, scanning pulses SP23 and SP24 are sequentially given to the gate lines GTL23 and GTL24.

For example an upper side in the figure of the pixel portion 21 is provided with the horizontal scanner 23 and the monitor circuit (dummy scanner) 24.

The horizontal scanner 23 performs processing for sequentially sampling input video signals VDO for every 1H (H is the horizontal scanning period) and writing them at the pixels PXL selected in units of rows by the vertical scanner 22. The horizontal scanner 23 employs the clock drive method as shown in FIG. 11 and has a shift register 231, a clock sampling switch group 232, a phase adjust circuit (PAC) group 233, and a sampling switch group 234.

The shift register 231 has four shift stages (S/R stages) 231-1 to 231-4 corresponding to the pixel columns (four columns in the present example) of the pixel portion 21 and performs a first shift operation (usual shift operation) or a second shift operation (inverse shift operation) in synchronization with the horizontal clock HCK and the inverse horizontal clock HCKX having inverse phases to each other (below, the two will be referred to the "horizontal clocks") when the horizontal start pulse HST is given to the first (initial stage) shift stage 231-1 or the fourth (last) shift stage 231-4 by for example the external feedback control circuit 26. Due to this, the shift stages 231-1 to 231-4 of the shift register 231 sequentially output shift pulses SFTP231 to SFTP234 having the same pulse width as the periods of the horizontal clocks HCK and HCKX.

Here, the "usual shift operation" means a scan in the direction from left to right in FIG. 11, that is, in a sequence of the first shift stage 231-1 of the initial stage, the second shift stage 231-2, the third shift stage 231-3, and the fourth shift stage 231-4. On the other hand, the "inverse shift operation" means a scan in the direction from right to left in FIG. 11, that is, in a sequence of the fourth shift stage 231-4, the third shift stage 231-3, the second shift stage 231-2, and the first shift stage 231-1.

The usual shift operation and the inverse shift operation are determined according to a shift direction switch signal RGT given from the outside. For example, the shift register 231 of the horizontal scanner 23 performs the usual shift operation when receiving the shift direction switch signal RGT at a high level, while performs the inverse shift operation when receiving it at a low level.

In the shift register 231, switch circuits 2311, 2312, and 2313 receiving the horizontal start pulse HST and switching whether the shift pulses SFTP are to be propagated in the usual direction going from the first shift stage 231-1 toward the fourth shift stage 231-4 or the inverse direction going from the fourth shift stage 231-4 toward the first shift stage 231-1 are inserted among the shift stages. Specifically, the switch circuit 2311 is inserted between the first shift stage 231-1 and the second shift stage 231-2, the switch circuit 2312 is inserted between the second shift stage 231-2 and the third shift stage 231-3, and the switch circuit 2313 is inserted between the third shift stage 231-3 and the fourth shift stage 231-4. The switch circuits 2311 to 2313 receive the shift direction switch signal RGT and switch the signal propagation direction to the usual direction or the inverse direction.

Figure 13:
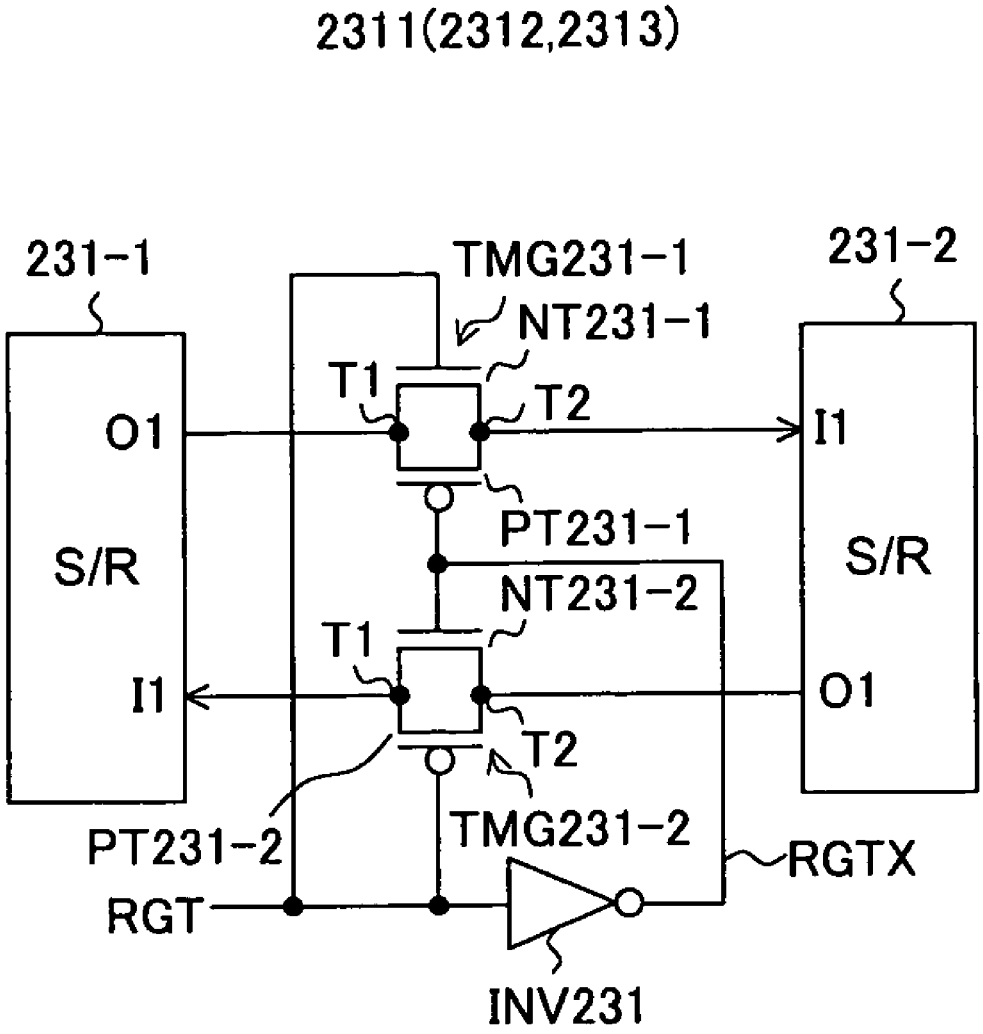
FIG. 13 is a circuit diagram of an example of the configuration of a switch circuit inserted between shift stages of a shift register.

FIG. 13 is a circuit diagram of an example of the configuration of the switch circuit 2311 (to 2313) inserted between shift stages of the shift register. Note that, in FIG. 13, the switch circuit 2311 inserted between the first shift stage 231-1 and the second shift stage 231-2 is shown as an example, but the other switch circuits 2312 and 2313 have the same configuration.

The switch circuit 2311 has, as shown in FIG. 13, transfer gates TMG231-1 and TMG231-2 and an inverter INV231. The transfer gate TMG231-1 connects the sources and drains of a p-channel MOS (PMOS) transistor PT231-1 and an n-channel MOS (NMOS) transistor NT231-1 to configure a first terminal T1 and a second terminal T2. The gate of the NMOS transistor NT231-1 is connected to the supply line of the switch signal RGT, while the gate of the PMOS transistor PT231-1 is connected to the output terminal of the inverter INV231 for outputting the signal RGTX obtained by inverting the level of the switch signal RGT. Further, the first terminal T1 is connected to the output terminal O1 of the first shift stage (left side shift stage) 231-1, and the second terminal T2 is connected to the input terminal I1 of the second shift stage (right side shift stage) 231-2.

The transfer gate TMG231-2 connects the sources and drains of the PMOS transistor PT231-2 and the NMOS transistor NT231-2 to configure the first terminal T1 and the second terminal T2. The gate of the PMOS transistor PT231-2 is connected to the supply line of the switch signal RGT, and the gate of the NMOS transistor NT231-2 is connected to the output terminal of the inverter INV231 for outputting a signal RGTX obtained by inverting the level of the switch signal RGT. Further, the first terminal T1 is connected to the input terminal I1 of the first shift stage (left side shift stage) 231-1, and the second terminal T2 is connected to the output terminal O1 of the second shift stage (right side shift stage) 231-2.

In the switch circuit 2311 having such a configuration, when for example the switch signal RGT is supplied at a high level, the output signal RGTX of the inverter INV231 becomes the low level, and the PMOS transistor PT231-1 and the NMOS transistor NT231-1 of the transfer gate TMG231-1 become conductive. On the other hand, the PMOS transistor PT231-2 and the NMOS transistor NT231-2 of the transfer gate TMG231-2 are held in a nonconductive state. Accordingly, the signal (horizontal start pulse HST) output from the output terminal O1 of the first shift stage 231-1 is propagated to the input terminal I1 of the second shift stage 231-2 through the transfer gate TMG231-1. That is, the usual shift operation is carried out.

As opposed to this, when the switch signal RGT is supplied at a low level, the output signal RGTX of the inverter INV231 becomes the high level, and the PMOS transistor PT231-1 and the NMOS transistor NT231-1 of the transfer gate TMG231-1 are held in the nonconductive state. On the other hand, the PMOS transistor PT231-2 and the NMOS transistor NT231-2 of the transfer gate TMG231-2 become conductive. Accordingly, the signal (horizontal start pulse HST) output from the output terminal O1 of the second shift stage 231-2 is propagated to the input terminal I1 of the first shift stage 231-1 through the transfer gate TMG231-2. That is, the inverse shift operation is carried out.

Note that, in the configuration of FIG. 13, the configuration was made so that the inverter INV231 was provided in each switch circuit, but it is also possible to provide the inverter at the input stage of the switch signal RGT and supply the inverted output signal RGTX thereof to each switch circuit together with the switch signal RGT.

The clock sampling switch group 232 has four switches 232-1 to 232-4 corresponding to the pixel columns of the pixel portion 21. First side ends of these switches 232-1 to 232-4 are alternately connected to clock lines DKL21 and DKXL21 for sending the second clock DCK and the second inverse clock DCKX from the clock generation circuit 25. That is, first side ends of the switches 232-1 and 232-3 corresponding to the odd number columns of the pixel columns of the pixel portion 21 are connected to a clock line DKXL 21, and first side ends of the switches 232-2 and 232-4 corresponding to the even number columns of the pixel columns of the pixel portion 21 are connected to a clock line DKL 21. The switches 232-1 to 232-4 of the clock sampling switch group 232 are given shift pulses SFTP231 to SFTP234 sequentially output from the shift stages 231-1 to 231-4. When the shift pulses SFTP231 to SFTP234 are given from the shift stages 231-1 to 231-4 of the shift register 231, the switches 232-1 to 232-4 of the clock sampling switch group 232 sequentially enter the ON state in response to these shift pulses SFTP231 to SFTP234 and thereby alternately sample the clocks DCKX and DCK having inverse phases to each other.

The phase adjust circuit group 233 has four phase adjust circuits 233-1 to 233-4 corresponding to the pixel columns of the pixel portion 21, adjusts the phases of the clocks DCKX and DCK sampled at the switches 232-1 to 232-4 of the clock sampling switch group 232 at the phase adjust circuits 233-1 to 233-4, and then supplies them to the corresponding sampling switches of the sampling switch group 234.

The sampling switch group 234 has four sampling switches 234-1 to 234-4 corresponding to the pixel columns of the pixel portion 21. First side ends of these sampling switches 234-1 to 234-4 are connected to the video line VDL21 for receiving as input the video signals VDO. The sampling switches 234-1 to 234-4 are given the clocks DCKX and DCK sampled by the switches 232-1 to 232-4 of the clock sampling switch group 232 and is adjusted in phase at the phase adjust circuit group 233 as sample-and-hold pulses SHP231 to SHP234. The sampling switches 234-1 to 234-4 of the sampling switch group 234 respond to the sample-and-hold pulses SHP231 to SHP234 and sequentially enter the ON state when the sample-and-hold pulses SHP231 to SHP234 are given and thereby sequentially sample the video signals VDO input through the video line VDL21 and supply them to the signal lines SGNL21 to SGNL24 of the pixel portion 21.

The monitor circuit 24 is arranged corresponding to the first pixel column of the pixel portion 21 of the horizontal scanner 23, that is, adjacent to the left side in FIG. 11 of the first stage scanner portion including the first shift stage 231-1 for receiving as input the horizontal start pulse HST at first and starting the first shift operation (usual shift operation), the sampling switch 232-1, the phase adjust circuit 233-1, and the sampling switch 234-1. The monitor circuit 24 is configured in the same way as the configuration including the sampling switch 232-1, the phase adjust circuit 233-1, and the sampling switch 234-1 of the scanner portion of each stage of the horizontal scanner 23 for making the amounts of delay of the output pulses of the stages of the horizontal scanner 23 uniform.

Specifically, the monitor circuit 24 has a selector portion 241 for receiving the horizontal start pulse HST and the switch signal RGT and, when the switch signal RGT indicates the first scanning operation, sampling the clock DCK different from the clock DCKX sampled by the initial stage shift stage 231-1 of the shift register 231 in the horizontal scanner 23 between the clocks DCK and DCKX by using the horizontal start pulse HST as the select pulse and, when the switch signal RGT indicates the second scanning operation, sampling the clock DCKX different from the clock DCK signal sampled by the last stage shift stage 231-4 of the shift register 231 in the horizontal scanner 23 between the clocks DCK and DCKX by using the horizontal start pulse HST as the select pulse, a phase adjust circuit 242 for generating a sample-and-hold pulse SHP241 comprised of two signals taking complementary levels by adjusting the phase of the clock DCK or DCKX sampled at the selector portion 241, and a sampling switch (third switch) 243 in which the conduction between the first terminal T1 and the second terminal T2 is controlled by the sample-and-hold pulse SHP241 from the phase adjust circuit 242.

The sampling switch 243 of the monitor circuit 24 is configured by an analog switch obtained by connecting the sources and the drains of a PMOS transistor and an NMOS terminal, in which the first terminal T1 is grounded, and the other terminal is connected to one end of the monitor line MNTL21. The monitor line $$MNTL\ \frac{K}{21}$$

is pulled up by a pull-up resistor R21 on the outside of the liquid crystal display panel, and the other end side is connected via a buffer BF21 to the input terminal of the feedback control circuit 26.

The selector portion 241 of the monitor circuit 24 has a switch (fourth switch) 2411 for receiving the select pulse SLP241, sampling the clock DCK, and outputting the same to the phase adjust circuit 242, a switch (fifth switch) 2412 for receiving the SLP242, sampling the clock DCKX, and outputting the same to the phase adjust circuit 242, and a selector 2413 for receiving the horizontal start pulse HST and the switch signal RGT and outputting the horizontal start pulse HST as the select pulse SLP241 to the switch 2411 when the switch signal RGT indicates the first scanning operation, while outputting the horizontal start pulse HST as the select pulse SLP242 to the switch 2412 when the switch signal RGT indicates the second scanning operation.

Figure 14:
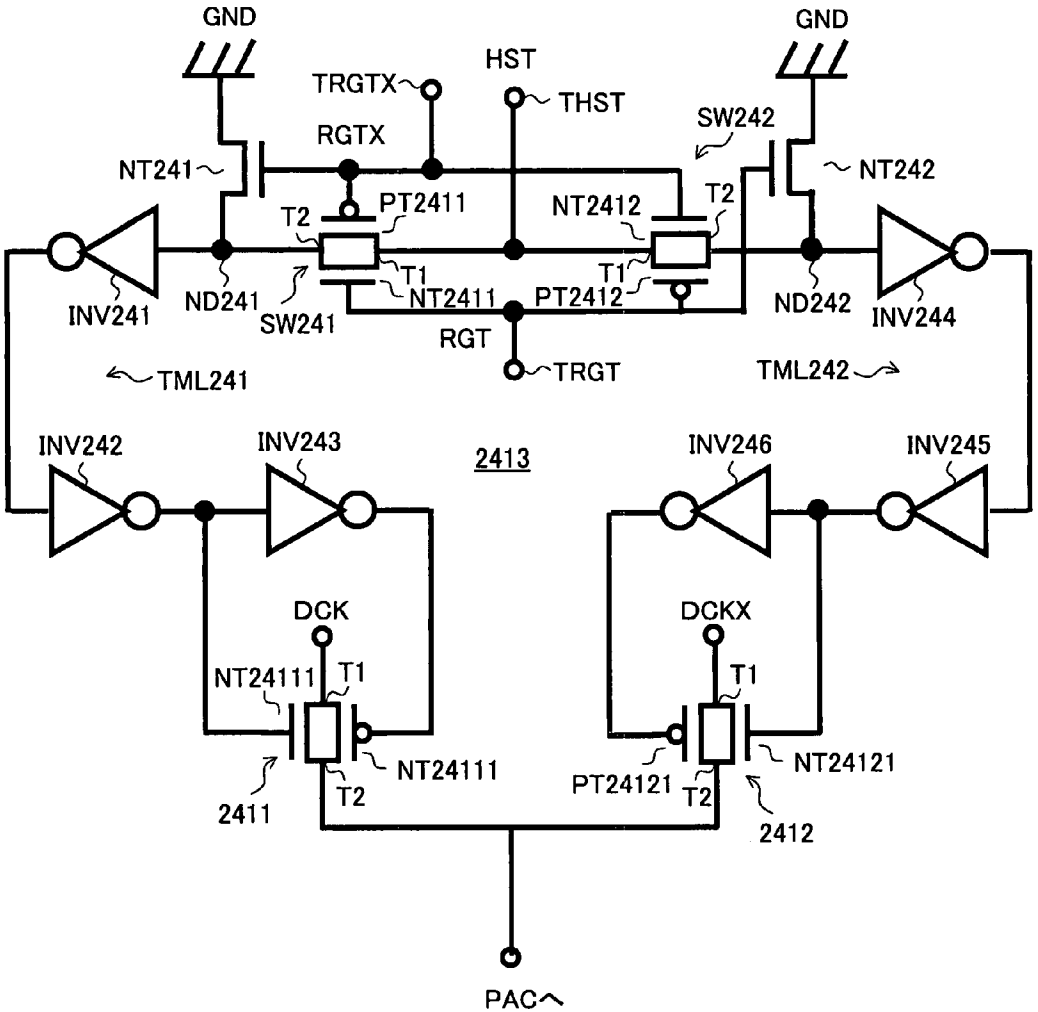
FIG. 14 is a circuit diagram of a concrete example of the configuration of a selector portion of the monitor circuit according to the present embodiment.

FIG. 14 is a circuit diagram of a concrete example of the configuration of the selector portion of the monitor circuit according to the present embodiment.

The selector 2413 has, as shown in FIG. 14, select switches SW241 and SW242, NMOS transistors NT241 and NT242, inverters INV241 to INV246, an input terminal THST of the horizontal start pulse HST, an input terminal TRGT of the switch signal RGT, and an input terminal TRGTX of the inverted signal RGTX of the switch signal RGT. Note that, in the configuration of FIG. 14, the configuration is made so that the switch signal RGT and the inverted signal RGTX of the switch signal RGT are input from the outside, but it is also possible to configure the same so that only the switch signal RGT is input from the outside, and the inverted signal RGTX of the switch signal RGT is generated inside the selector 2413 via the inverter.

In the select switch SW241, the first terminal T1 and the second terminal T2 are configured by connecting the sources and the drains of the NMOS transistor NT2411 and the PMOS transistor PT2411. In the select switch SW242, the first terminal T1 and the second terminal T2 are configured by connecting the sources and the drains of the NMOS transistor NT2412 and the PMOS transistor PT2412. In the same way as above, in the switch (fourth switch) 2411, the first terminal T1 and the second terminal T2 are configured by connecting the sources and the drains of the NMOS transistor NT24111 and the PMOS transistor PT24111. In the switch (fifth switch) 2412, the first terminal T1 and the second terminal T2 are configured by connecting the sources and the drains of the NMOS transistor NT24121 and the PMOS transistor PT24121.

In the select switch SW241, the first terminal T1 is connected to the input terminal THST of the horizontal start pulse HST, the second terminal T2 is connected to the input terminal of the inverter INV241, and the source and drain of the NMOS transistor NT241 are respectively connected between a connection node ND241 of these and the ground GND. The gate of the NMOS transistor NT2411 of the select signal SW241 is connected to the input terminal TRGT of the switch signal RGT, and the gate of the PMOS transistor PT2411 and the gate of the NMOS transistor NT241 are connected to the input terminal TRGTX of the inverted signal RGTX of the switch signal RGT. The inverters INV241 to INV243 are connected in series with respect to the node ND241, the output terminal of the inverter INV242 is connected to the gate of the NMOS transistor NT24111 of the switch 2411, and the output terminal of the inverter INV243 is connected to the gate of the PMOS transistor PT24111 of the switch 2411. Further, a first transfer line TML 241 is configured by a signal propagation route reaching the NMOS transistor NT24111 of the switch 2411 from the terminal T2 of the select switch SW241 including the node ND241. Further, by the NMOS transistor NT241, a potential setting means for setting the potential of the first transfer line TML241 in a nonselection state at the time of the second scanning operation (inverse scanning operation)

at the potential at which the switch 2411 can be stably held in the nonconductive state, that is, the ground potential in the present embodiment, is configured.

In the select switch SW242, the first terminal T1 is connected to the input terminal THST of the horizontal start pulse HST, the second terminal T2 is connected to the input terminal of the inverter INV244, and the source and the drain of the NMOS transistor NT242 are respectively connected between a connection node ND242 of these and the ground GND. The gate of the PMOS transistor PT2412 of the select switch SW242 and the gate of the NMUS transistor NT242 are connected to the input terminal TRGT of the switch signal RGT, and the gate of the NMOS transistor NT2412 is connected to the input terminal TRGTX of the inverted signal RGTX of the switch signal RGT. The inverters INV244 to INV246 are connected in series with respect to the node ND242, the output terminal of the inverter INV245 is connected to the gate of the NMOS transistor NT24121, and the output terminal of the inverter INV246 is connected to the gate of the PMOS transistor PT24121. Further, the second signal transfer line TML 242 is configured by the signal propagation route reaching the NMOS transistor 24121 of the switch 2412 and the gate of the NMOS transistor NT24121 from the terminal T2 of the select switch SW242 including the node ND242. Further, by the NMOS transistor NT242, the potential setting means for setting the potential of the second transfer line TML 242 in the nonselection state at the time of the first scanning operation (usual scanning operation) at the potential at which the switch 2412 can be stably held in the nonconductive state, that is the ground potential in the present embodiment is configured.

In the selector portion 241 having such a configuration, at the time of the first scanning operation, the switch signal RGT is input at the high level, and the inverted signal RGTX thereof is input at the low level. As a result, the select switch SW241 and the NMOS transistor NT242 become the conductive state, and the select switch SW242 and the NMOS transistor NT241 become the nonconductive state. Accordingly, the horizontal start pulse HST of the high level in the constant period input from the input terminal THST passes through the select switch SW241, is supplied to the NMOS transistor NT24111 of the switch 2411 at the high level by the inverter INV242, and then is supplied to the PMOS transistor PT24111 of the switch 2411 at the low level by the inverter INV243. Due to this, the switch 2411 becomes the conductive state for a constant period, and the clock DCK is sampled and output to the phase adjust circuit 242. Further, at this time, the NMOS transistor NT242 is in the conductive state, so the potential of the node ND242 is held at the ground level. Accordingly, the signal is supplied to the NMOS transistor NT24121 of the switch 2412 at the low level by the inverter INV245, and the signal of a high level is supplied to the PMOS transistor PT24121 of the switch 2412 by the inverter INV246. As a result, the switch 2412 is stably held in the nonconductive state.

On the other hand, at the time of the second scanning operation, the switch signal RGT is input at the low level, and the inverted signal RGTX thereof is input at the high level. As a result, the select switch SW241 and the NMOS transistor NT242 become the nonconductive state, and the select switch SW242 and the NMOS transistor NT241 become the conductive state. Accordingly, the horizontal start pulse HST of the high level for the constant period input from the input terminal THST passes through the select switch SW242, is supplied to the NMOS transistor NT24121 of the switch 2412 at the high level by the inverter INV245, and then is supplied to the PMOS transistor PT24121 of the switch 2412 at the low level by the inverter INV246. Due to this, the switch 2412 becomes the conductive state in the constant period, and the clock DCKX is sampled and output to the phase adjust circuit 242. Further, at this time, the NMOS transistor NT241 is in the conductive state, so the potential of the node ND241 is held at the ground level. Accordingly, the signal is supplied to the NMOS transistor NT24111 of the switch 2411 at the low level by the inverter INV242, then the signal of the high level is supplied to the PMOS transistor PT24111 of the switch 2411 by the inverter INV243. As a result, the switch 2411 is stably held in the nonconductive state.

As described above, in the present embodiment, in the monitor circuit 24, at the time of the first scanning operation (usual scanning operation) and the time of the second scanning operation (inverse scanning operation), the clocks DCK and DCKX sampled at the sampling switches 2411 and 2412 are made different clocks. Here, the clock DCK is sampled at the time of the first scanning operation, and the clock DCKX is sampled at the time of the second scanning operation.

The clock generation circuit 25 generates second clocks DCK and DCKX having inverse phases to each other, having the same period with respect to the horizontal clocks (first clocks) HCK and HCKX generated at the feedback control circuit 26 (T1=T2), and having a small duty ratio and supplies them through the clock lines DKL21 and DKXL21 to the monitor circuit 24 and the horizontal scanner 23. Here, the "duty ratio" means the ratio between the pulse width t and the pulse repetition period T in the pulse waveform. For example, as shown in FIGS. 3A to 3D, the duty ratio (t1/T1) of the horizontal clocks HCK and HCKX is 50%, and the duty ratio (t2/T2) of the clocks DCK and DCKX is set smaller than this, that is, the pulse width t2 of the clocks DCK and DCKX is set narrower than the pulse width t1 of the horizontal clocks HCK and HCKX.

The feedback control circuit 26 generates a vertical start pulse VST for instructing the start of the vertical scan, vertical clocks VCK and VCKX having inverse phases to each other and serving as reference of the vertical scan, the horizontal start pulse HST for instructing the start of the horizontal scan, and horizontal clocks HCK and HCKX having inverse phases to each other and serving as reference of the horizontal scan, supplies the vertical start pulse VST and the vertical clocks VCK and VCKX to the vertical scanner 22, and supplies the horizontal clocks HCK and HCKX to the horizontal scanner 23, the monitor circuit 24, and the clock generation circuit 25. Further, the feedback control circuit 26 generates the horizontal start pulse HST and supplies the same to the first shift stage 231-1 and the second shift stage 231-2 of the shift register 231 of the horizontal scanner 23 and the selector 2413 of the monitor circuit 24. Further, the feedback control circuit 26 monitors the change of the phase from the initial state from the timing when the sampling switch 243 of the monitor circuit 24 becomes conductive and the monitor line MNTL21 shifts to the ground level at the time of the usual scanning operation or the time of the inverse scanning operation, feeds back the amount of change of the phase to the horizontal clock HCK and the inverse horizontal clock HCKX of the panel input, and performs control for preventing the generation of a ghost due to the sample-and-hold pulse SHP drifting from the initial state thereof.

Next, an explanation will be given of the usual scanning operation and the inverse scanning operation by the above configuration in relation to the timing charts of FIGS. 15A to 15K and FIGS. 16A to 16K.

First, the usual scanning operation will be explained in relation to the timing charts of FIGS. 15A to 15K.

In this case, the scanning direction switch signal RGT is set at the high level and supplied to the shift register 231 of the horizontal scanner 23 and the selector 2413 of the monitor circuit 24 (for example also the inverted signal RGTX is supplied to the selector 2413). Due to this, routes through which the switch circuits 2311 to 2313 inserted among the shift stages in the shift register 231 of the horizontal scanner 23 propagate signals from left to right are formed. That is, signal propagation routes through which the horizontal start pulse HST is sequentially shifted from the first shift stage 231-1 to the second shift stage 231-2, from the second shift stage 231-2 to the third shift stage 231-3, and from the third shift stage 231-3 to the fourth shift stage 231-4 are formed.

In this state, the feedback control circuit 26 generates the horizontal start pulse HST as shown in FIG. 15A and supplies the same to the first shift stage 231-1 of the shift register 231 of the horizontal scanner 23 and the selector 2413 of the monitor circuit 24. Further, the feedback control circuit 26 generates the horizontal clocks HCK and HCKX having inverse phases to each other as shown in FIGS. 15B and 15C and supplies them to the first shift stage 231-1 to the fourth shift stage 231-4 of the shift register 231 in the horizontal scanner 23 and the clock generation circuit 25. The clock generation circuit 25 generates the clocks DCK and DCKX having the same period (T1=T2) as the horizontal clocks HCK and HCKX generated at the feedback control circuit 26, having a small duty ratio, and having inverse phases to each other as shown in FIGS. 15D and 15E and supplies them through the clock lines DKL21 and DKXL21 to the monitor circuit 24 and the horizontal scanner 23.

The feedback control circuit 26 generates the vertical start pulse VST for instructing the start of the vertical scan, vertical clocks VCK and VCKX having inverse phases to each other and serving as reference of the vertical scan, and supplies them to the vertical scanner 22.

Further, the monitor circuit 24 receives the horizontal start pulse HST and the switch signal RGT and the inverted signal RGTX thereof and, since the switch signal RGT is at the high level for indicating the first scanning operation, outputs the horizontal start pulse HST as the select pulse SLP241 to the switch 2411 as shown in FIG. 15F, samples the clock DCK different from the clock DCKX sampled by the first shift stage 231-1 of the horizontal scanner 23, and, after the phase adjustment at the phase adjust circuit 242, supplies the same as the sample-and-hold pulse SHP241 to the sampling switch 243 as shown in FIG. 15I. Due to this, the sampling switch 243 enters the ON state in response to the sample-and-hold pulse SHP241, the monitor line MNTL21 which has been pulled up by the pull-up resistor R21 on the outside of the liquid crystal display panel is pulled to the ground level, and the level change information thereof is input via the buffer BF21 to the feedback control circuit 26.

Further, in the shift register 231 of the horizontal scanner 23, at the first shift stage 231-1 to which the horizontal start pulse HST is supplied by the external feedback control circuit 26, in synchronization with the horizontal clocks HCK and HCKX having inverse phases, as shown in FIG. 15G, the shift pulse SFTP231 having the same pulse width as the periods of the horizontal clocks HCK and HCKX is output to the sampling switch 232-1. Further, the shift pulse SFTP231 is shifted to the second shift stage 231-2 from the first shift stage 231-1. The sampling switch 232-1 corresponding to the first shift stage 231-1 enters the ON state in response to the shift pulse SFTP231, samples the clock DCKX output to the clock line DKXL21 as shown in FIGS. 15E and 15J, adjusts this in phase at the phase adjust circuit 233-1, and then supplies the same as the sample-and-hold pulse SHP231 to the sampling switch 234-1. Due to this, the sampling switch 234-1 enters the ON state in response to the sample-and-hold pulse SHP231, samples the video signals VDO input through the video line VDL21, and supplies the same to the signal line SGNL21 of the pixel portion 21.

Next, in the second shift stage 231-2 into which the shift pulse SFTP231 is shifted from the first shift stage 231-1, in synchronization with the horizontal clocks HCK and HCKX having inverse phases, as shown in FIG. 15H, the shift pulse SFTP232 having the same pulse width as the periods of the horizontal clocks HCK and HCKX is output to the sampling switch 232-2. Further, the shift pulse SFTP232 is shifted to the third shift stage 231-3 from the second shift stage 231-2. The sampling switch 232-2 corresponding to the second shift stage 231-2 enters the ON state in response to the shift pulse SFTP232, samples the clock DCK output to the clock line DKL21 as shown in FIGS. 15D and 15K, adjusts this in phase at the phase adjust circuit 233-2, and then supplies the same as the sample-and-hold pulse SHP232 to the sampling switch 234-2. Due to this, the sampling switch 234-2 enters the ON state in response to the sample-and-hold pulse SHP232, samples the-video signals VDO input through the video line VDL21, and supplies the same to the signal line SGNL22 of the pixel portion 21.

Next, in the third shift stage 231-3 into which the shift pulse SFTP232 is shifted from the second shift stage 231-2, in synchronization with the horizontal clocks HCK and HCKX having inverse phases, the shift pulse SFTP233 having the same pulse width as the periods of the horizontal clocks HCK and HCKX is output to the sampling switch 232-3. Further, the shift pulse SFTP233 is shifted to the fourth shift stage 231-4 from the third shift stage 231-3. The sampling switch 232-3 corresponding to the third shift stage 231-3 enters the ON state in response to the shift pulse SFTP233, samples the clock DCKX output to the clock line DKXL21, adjusts this in phase at the phase adjust circuit 233-3, and then supplies the same as the sample-and-hold pulse SHP233 to the sampling switch 234-3. Due to this, the sampling switch 234-3 enters the ON state in response to the sample-and-hold pulse SHP233, samples the video signals VDO input through the video line VDL21, and supplies the same to the signal line SGNL23 of the pixel portion 21.

Next, in the fourth shift stage 231-4 into which the shift pulse SFTP233 is shifted from the third shift stage 231-3, in synchronization with the horizontal clocks HCK and HCKX having inverse phases, the shift pulse SFTP234 having the same pulse width as the periods of the horizontal clocks HCK and HCKX is output to the sampling switch 232-4. The sampling switch.232-4 corresponding to the fourth shift stage 231-4 enters the ON state in response to the shift pulse SFTP234, samples the clock DCK output to the clock line DKL21, adjusts this in phase at the phase adjust circuit 233-4, and then supplies the same as the sample-and-hold pulse SHP234 to the sampling switch 234-4. Due to this, the sampling switch 234-4 enters the ON state in response to the sample-and-hold pulse SHP234, samples the video signals VDO input through the video line VDL21, and supplies the same to the signal line SGNL24 of the pixel portion 21.

In the feedback control circuit 26, the change of the phase from the initial state is monitored from the timing when the sampling switch 243 of the monitor circuit 24 becomes conductive at the time of the usual scanning operation and the monitor line MNTL21 shifts to the ground level. In the feedback control circuit 26, the amount of change of the monitored phase is fed back to the clocks HCK, HCKX, etc. of the panel input and a suitable timing is set. Due to this, the generation of a ghost due to the drift of the sample-and-hold pulse SHP from the initial state thereof is prevented.

As described above, at the time of the usual scanning operation, in the monitor circuit 24, by receiving the horizontal start pulse HST and the switch signal RGT and the inverted signal RGTX thereof, the clock DCK different from the clock DCKX sampled by the first shift stage 231-1 of the horizontal scanner 23 is sampled at the selector portion 241, is adjusted in phase at the phase adjust circuit 242, and then is supplied as the sample-and-hold pulse SHP241 to the sampling switch 243, then the sampling switch 243 enters the ON state. Further, in the horizontal scanner 23, at the switches 232-1 to 232-4 of the clock sampling switch group 232, when the shift pulses SFTP231 to SFTP234 are given from the shift stages 231-1 to 231-4 of the shift register 231, they sequentially enter the ON state in response to these shift pulses SFTP231 to SFTP234 to thereby alternately sample the clocks DCKX and DCK having inverse phases to each other and give the clocks DCKX and DCK adjusted in phase at the phase adjust circuit group 233 as the sample-and-hold pulses SHP231 to SHP234. Further, when the sample-and-hold pulses SHP231 to SHP234 are given, the sampling switches 234-1 to 234-4 of the sampling switch group 234 sequentially enter the ON state in response to these sample-and-hold pulses SHP231 to SHP234, sequentially sample the video signals VDO input through the video line VDL21, and supply them to the signal lines SGNL21 to SGNL24 of the pixel portion 21. That is, the sample-and-hold pulse SHP231 of the first shift stage of the horizontal scanner 23 and the sample-and-hold pulse SHP241 of the monitor circuit 24 are generated at substantially the same timing as the relationships among the other sample-and-hold pulses SHP232 to SHP234, and the image is displayed without a problem.

Next, the inverse scanning operation will be explained in relation to the timing charts of FIGS. 16A to 16K.

In this case, the scanning direction switch signal RGT is set at the low level and supplied to the shift register 231 of the horizontal scanner 23 and the selector 2413 of the monitor circuit 24 (for example also the inverted signal RGTX is supplied to the selector 2413). Due to this, routes through which the switch circuits 2311 to 2313 inserted among shift stages in the shift register 231 of the horizontal scanner 23 propagate signals from right to left are formed. That is, signal propagation routes through which the shift pulses SFTP are sequentially shifted from the fourth shift stage 231-4 to the third shift stage 231-3, from the third shift stage 231-3 to the second shift stage 231-2, and from the second shift stage 231-2 to the first shift stage 231-1 are formed.

In this state, the feedback control circuit 26 generates the horizontal start pulse HST as shown in FIG. 16A and supplies the same to the fourth shift stage 231-4 of the shift register 231 in the horizontal scanner 23 and the selector 2413 of the monitor circuit 24. Further, the feedback control circuit 26 generates the horizontal clocks HCK and HCKX having inverse phases to each other as shown in FIGS. 16B and 16C and supplies them to the first shift stage 231-1 to the fourth shift stage 231-4 of the shift register 231 in the horizontal scanner 23 and the clock generation circuit 25. The-clock generation circuit 25 generates clocks DCK and DCKX having the same period (T1=T2) as the horizontal clocks HCK and HCKX generated at the feedback control circuit 26, having a small duty ratio, and having inverse phases to each other as shown in FIGS. 16D and 16E and supplies the same through the clock lines DKL21 and DKXL21 to the monitor circuit 24 and the horizontal scanner 23.

The feedback control circuit 26 generates the vertical start pulse VST for instructing the start of the vertical scanning, the vertical clocks VCK and VCKX having inverse phases to each other and serving as reference of the vertical scanning, and supplies them to the vertical scanner 22.

Further, the monitor circuit 24 receives the horizontal start pulse HST and the switch signal RGT and the inverted signal RGTX thereof. Since the switch signal RGT is at the low level for indicating the second scanning operation, as shown in FIG. 16F, the horizontal start pulse HST is output as the select pulse SLP242 to the switch 2412, the clock DCKX different from the clock DCK sampled by the fourth shift stage 231-4 of the horizontal scanner 23 is sampled, is adjusted in phase at the phase adjust circuit 242, and then is supplied as the sample-and-hold pulse SHP241 to the sampling switch 243 as shown in FIG. 16I. Due to this, the sampling switch 243 enters the ON state in response to the sample-and-hold pulse SHP241, the monitor line MNTL21 which has been pulled up by the pull-up resistor R21 on the outside of the liquid crystal display panel is pulled to the ground level, and the level change information is input to the feedback control circuit 26 via the buffer BF21.

Further, at the shift register 231 of the horizontal scanner 23, at the fourth shift stage 231-4 to which the horizontal start pulse HST is supplied by the external feedback control circuit 26, in synchronization with the horizontal clocks HCK and HCKX having inverse phases, as shown in FIG. 16G, the shift pulse SFTP234 having the same pulse width as the periods of the horizontal clocks HCK and HCKX is output to the sampling switch 232-4. Further, the shift pulse SFTP234 is shifted to the third shift stage 231-3 from the fourth shift stage 231-4. The sampling switch 232-4 corresponding to the fourth shift stage 231-4 enters the ON state in response to the shift pulse SFTP234, and as shown in FIGS. 16D and 16J, the clock DCK output to the clock line DKL21 is sampled, is adjusted in phase at the phase adjust circuit 233-4, and then is supplied as the sample-and-hold pulse SHP234 to the sampling switch 234-4. Due to this, the sampling switch 234-4 enters the ON state in response to the sample-and-hold pulse SHP234, and the video signals VDO input through the video line VDL21 are sampled and supplied to the signal line SGNL24 of the pixel portion 21.

Next, at the third shift stage 231-3 into which the shift pulse SFTP234 is shifted from the fourth shift stage 231-4, in synchronization with the horizontal clocks HCK and HCKX having inverse phases, as shown in FIG. 16H, the shift pulse SFTP233 having the same pulse width as the periods of the horizontal clocks HCK and HCKX is output to the sampling switch 232-3. Further, the shift pulse SFTP233 is shifted to the second shift stage 231-2 from the third shift stage 231-3. The sampling switch 232-3 corresponding to the third shift stage 231-3 enters the ON state in response to the shift pulse SFTP233, and, as shown in FIGS. 16E and 16K, the clock DCKX output to the clock line DKLX21 is sampled, is adjusted in phase at the phase adjust circuit 233-3, and then is supplied as the sample-and-hold pulse SHP233 to the sampling switch 234-3. Due to this, the sampling switch 234-3 enters the ON state in response to the sample-and-hold pulse SHP233, and the video signals VDO input through the video line VDL21 are sampled and supplied to the signal line SGNL23 of the pixel portion 21.

Next, at the second shift stage 231-2 into which the shift pulse SFTP233 is shifted from the third shift stage 231-3, in synchronization with the horizontal clocks HCK and HCKX having inverse phases, the shift pulse SFTP232 having the same pulse width as the periods of the horizontal clocks HCK and HCKX is output to the sampling switch 232-2. Further, the shift pulse SFTP232 is shifted to the first shift stage 231-1 from the second shift stage 231-2. The sampling switch 232-2 corresponding to the second shift stage 231-2 enters the ON state in response to the shift pulse SFTP232, and the clock DCK output to the clock line DKL21 is sampled, is adjusted in phase at the phase adjust circuit 233-2, and then is supplied as the sample-and-hold pulse SHP232 to the sampling switch 234-2. Due to this, the sampling switch 234-2 enters the ON state in response to the sample-and-hold pulse SHP232, and the video signals VDO input through the video line VDL21 are sampled and supplied to the signal line SGNL22 of the pixel portion 21.

Next, at the first shift stage 231-1 into which the shift pulse SFTP232 is shifted from the second shift stage 231-2, in synchronization with the horizontal clocks HCK and HCKX having inverse phases, the shift pulse SFTP231 having the same pulse width as the periods of the horizontal clocks HCK and HCKX is output to the sampling switch 232-1. The sampling switch 232-1 corresponding to the first shift stage 231-1 enters the ON state in response to the shift pulse SFTP231, the clock DCKX output to the clock line DKXL21 is sampled, is adjusted in phase at the phase adjust circuit 233-1, and then is supplied as the sample-and-hold pulse SHP231 to the sampling switch 234-1. Due to this, the sampling switch 234-1 enters the ON state in response to the sample-and-hold pulse SHP231, and the video signals VDO input through the video line VDL21 are sampled and supplied to the signal line SGNL21 of the pixel portion 21.

At the feedback control circuit 26, the change of the phase from the initial state is monitored from the timing when the sampling switch 243 of the monitor circuit 24 at the time of the inverse scanning operation becomes conductive and the monitor line MNTL21 shifts to the ground level. At the feedback control circuit 26, the amount of change of the monitored phase is fed back to the clocks HCK and HCKX of the panel input and a suitable timing is set. Due to this, the generation of a ghost due to the drift of the sample-and-hold pulse SHP from the initial state thereof is prevented.

As described above, at the time of the inverse scanning operation, at the monitor circuit 24, by receiving the horizontal start pulse HST and the switch signal RGT and the inverted signal RGTX thereof, the clock DCKX different from the clock DCK sampled by the fourth shift stage 231-4 of the horizontal scanner 23 is sampled at the selector portion 241, is adjusted in phase at the phase adjust circuit 242, and then is supplied as the sample-and-hold pulse SHP241 to the sampling switch 243, and the sampling switch 243 enters the ON state. Further, at the horizontal scanner 23, when the shift pulses SFTP234 to SFTP231 are given from the shift stages 234-1 to 231-1 of the shift register 231 at the switches 232-4 to 232-1 of the clock sampling switch group 232, they sequentially enter the ON state in response to these shift pulses SFTP234 to SFTP231 and thereby alternately sample the clocks DCK and DCKX having inverse phases to each other, and the clocks DCK and DCKX adjusted in phase at the phase adjust circuit group 233 are given as the sample-and-hold pulses SHP234 to SHP231. Further, at the sampling switches 234-4 to 234-1 of the sampling switch group 234, when the sample-and-hold pulses SHP234 to SHP231 are given, the sampling switches sequentially enter the ON state in response to these sample-and-hold pulses SHP234 to SHP231, and the video signals VDO input through the video line VDL21 are sequentially sampled and supplied to the signal lines SGNL24 to SGNL21 of the pixel portion 21. That is, the sample-and-hold pulse SHP234 of the fourth shift stage of the horizontal scanner 23 and the sample-and-hold pulse SHP241 of the monitor circuit 24 are generated at substantially the same timing as the relationships of the other sample-and-hold pulses SHP231 to SHP233, and the image is displayed without a problem. That is, even if the phase of the clock changes at the time of the left/right inversion of the scanning operation, pulses having uniform phases of output can be obtained.

As explained above, according to the first embodiment, the monitor circuit 24 is arranged close to one side portion of the horizontal scanner 23. At the time of the first scanning operation (usual scanning operation), the horizontal start pulse HST is supplied to the shift stage 231-1 of the initial stage of the horizontal scanner 23 and the selector 2413 of the monitor circuit 24. At the monitor circuit 24, by receiving the horizontal start pulse HST and the switch signal RGT and the inverted signal RGTX thereof, the selector portion 241 samples the clock DCK different from the clock DCKX sampled by the first shift stage 231-1 of the horizontal scanner 2 and outputs it as the sample-and-hold pulse SHP241, and the sampling switch 243 sets the potential of the monitor line MNTL21 which has been pulled up at the ground potential in response to the sample-and-hold pulse. At the time of the second scanning operation (inverse scanning operation), at the monitor circuit 24, by receiving the horizontal start pulse HST and the switch signal RGT and the inverted signal RGTX thereof, the selector portion 241 samples the clock DCKX different from the clock DCK sampled by the fourth shift stage 231-4 of the horizontal scanner 23 and outputs it as the sample-and-hold pulse SHP241, and the sampling switch 243 sets the potential of the pulled up monitor line MNTL21 at the ground potential in response to the sample-and-hold pulse. Therefore, the following effects can be obtained. That is, even in a horizontal scanner (even number of shift stages) in which the phase of the clock is inverted in scanning direction inversion, monitoring is possible with a high precision and a high precision image display can be realized without the image ending up shifting by half no matter which the scanning direction of operation without any change of the phase of the output potential change.

Further, a configuration providing monitor circuits at both side portions of the horizontal scanner 23 is possible. In this case, the outputs of the two monitor circuits are connected by an Al or other interconnect. In order to prevent a resistance difference of the amount of the Al interconnect from occurring in the outputs of the two monitor circuits, it is necessary to set the line width of the Al interconnect at about 100 μm. The layout area taken ends up becoming larger. This will give become a problem as frames become narrower in the future. As opposed to this, in the first embodiment, the scanning operation of the horizontal scanner in which the phase of the clock inverts in scanning direction inversion can be monitored with a high precision by only providing one monitor circuit. Therefore, it is not necessary to connect circuits by an Al interconnect, the layout space can be reduced, which is advantageous also in the layout, and it is possible to sufficiently deal with the future narrower framing. Further, by making the circuit configuration after the clock sampling the same as that of the other horizontal scanner in the monitor circuit 24, output pulses having the same delay can be obtained.

Further, at the horizontal scanner 23, shift pulses SFTP231 to SFTP234 sequentially output from the shift register 231 are not sampled and used as the sample-and-hold pulses, but the clocks DCKX and DCK having inverse phases to each other are alternately sampled in synchronization with the shift pulses SFTP231 to SFTP234, and these clocks DCKX and DCK are used as the sample-and-hold pulses SHP231 to SHP234 via the phase adjust circuit. Due to this, fluctuation of the sample-and-hold pulses SHP231 to SHP234 can be suppressed. As a result, a ghost due to fluctuation of the sample-and-hold pulses SHP231 to SHP234 can be eliminated.

In addition, in the horizontal scanner 23, the horizontal clocks HCXK and HCK serving as reference of the shift operation of the shift register 231 are not sampled and used as the sample-and-hold pulses, but the clocks DCKX and DCK having the same period as the horizontal clocks HCXK and HCK and having a small duty ratio are separately generated and these clocks DCKX and DCK are sampled and used as the sample-and-hold pulses SHP231 to SHP234. Therefore, at horizontal driving, completely non-overlapping sampling between sampling pulses can be realized, so the generation of vertical stripes due to overlapping sampling can be suppressed.

Second Embodiment

Figure 17:
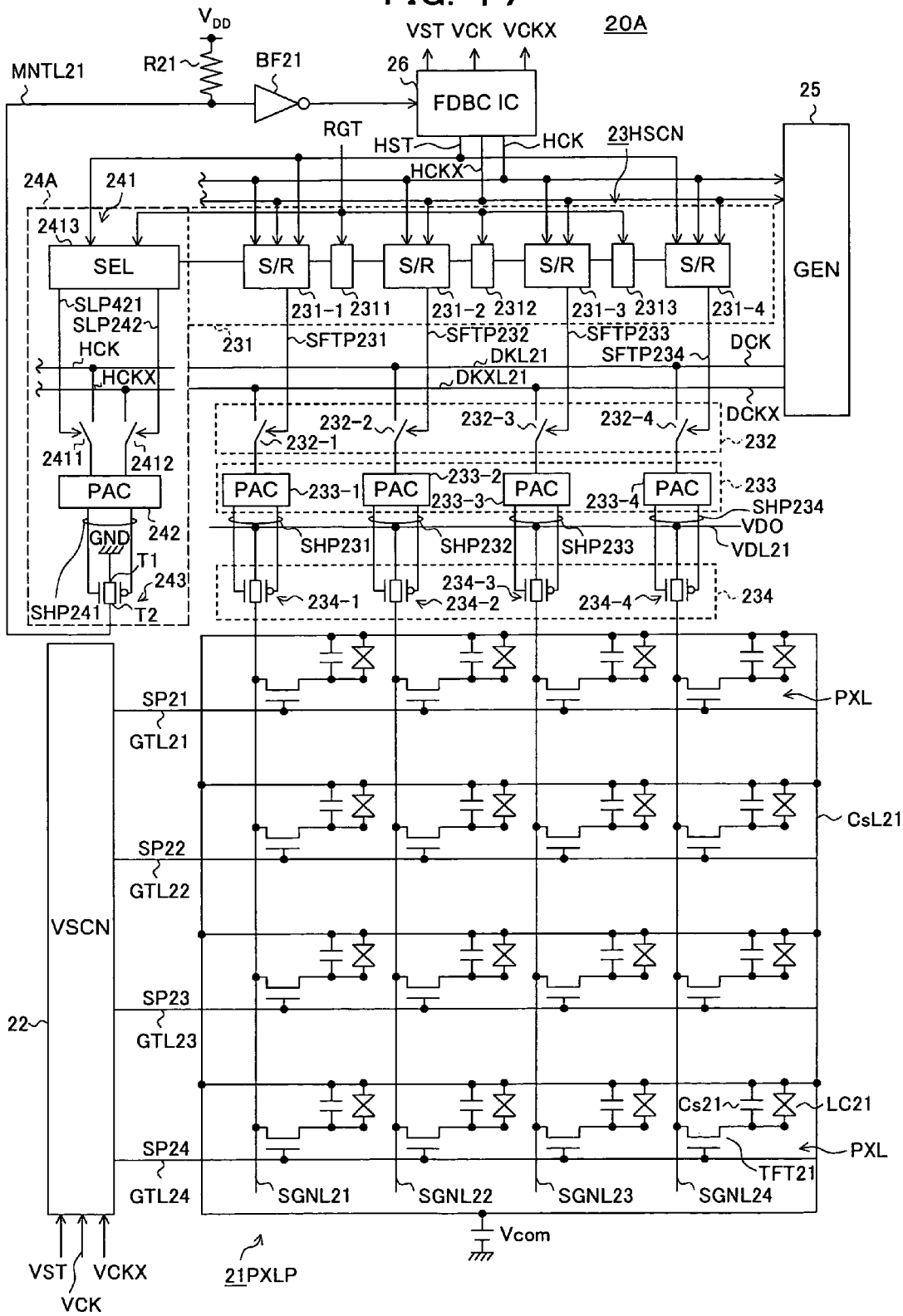
FIG. 17 is a circuit diagram of an example of the configuration of an active matrix type liquid crystal display device of the point sequential drive system according to a second embodiment of the present invention.

FIG. 17 is a circuit diagram of an example of the configuration of an active matrix type liquid crystal display device of the point sequential drive system according to a second embodiment of the present invention using for example liquid crystal cells as display elements (electrooptic elements) of the pixels.

The difference of the liquid crystal display device 20A of the second embodiment from the liquid crystal display device 20 of the first embodiment mentioned above resides in that, in a monitor circuit 24A, the clocks to be sampled at the switches 2411 and 2422 are made the horizontal clock HCK and the inverse horizontal clock HCXK generated at the feedback control circuit 26 instead of clocks the DCK and DCKS generated at the clock generation circuit (GEN) 25. That is, in the present embodiment, in the monitor circuit 24A, by receiving the horizontal start pulse HST and the switch signal RGT and the inverted signal RGTX thereof, the selector portion 241 samples the first clock HCK having the different phase from the second clock DCKX sampled by the first shift stage 231-1 of the horizontal scanner 23 and outputs it as the sample-and-hold pulse SHP241, the sampling switch 243 sets the potential of the pulled up monitor line MNTL21 at the ground potential in response to the sample-and-hold pulse, and at the time of the second scanning operation (inverse scanning operation), at the monitor circuit 24, by receiving the horizontal start pulse HST and the switch signal RGT and the inverted signal RGTX thereof, the selector portion 241 samples the second clock HCKX having the different phase from that of the second clock DCK sampled by the fourth shift stage 231-4 of the horizontal scanner 23 and outputs the same as the sample-and-hold pulse SHP241, and the sampling switch 243 sets the potential of the pulled up monitor line MNTL21 at the ground potential in response to the sample-and-hold pulse.

The rest of the configuration is the same as that of the first embodiment.

As mentioned above, in the second embodiment, the clocks to be sampled at the monitor circuit 24A are made not the second clocks DCK and DCKX having the same period as the horizontal clocks HCK and HCKX generated at the clock generation circuit 25 sampled by the horizontal scanner 23, having a small duty ratio, and having inverse phases to each other, but the first clocks HCK and HCKX. Below, an explanation will be given of the reason for making the clocks to be sampled at the monitor circuit 24A not the second clocks DCK and DCKX, but the first clocks HCK and HCKX, in relation to the drawings.

Figure 1:
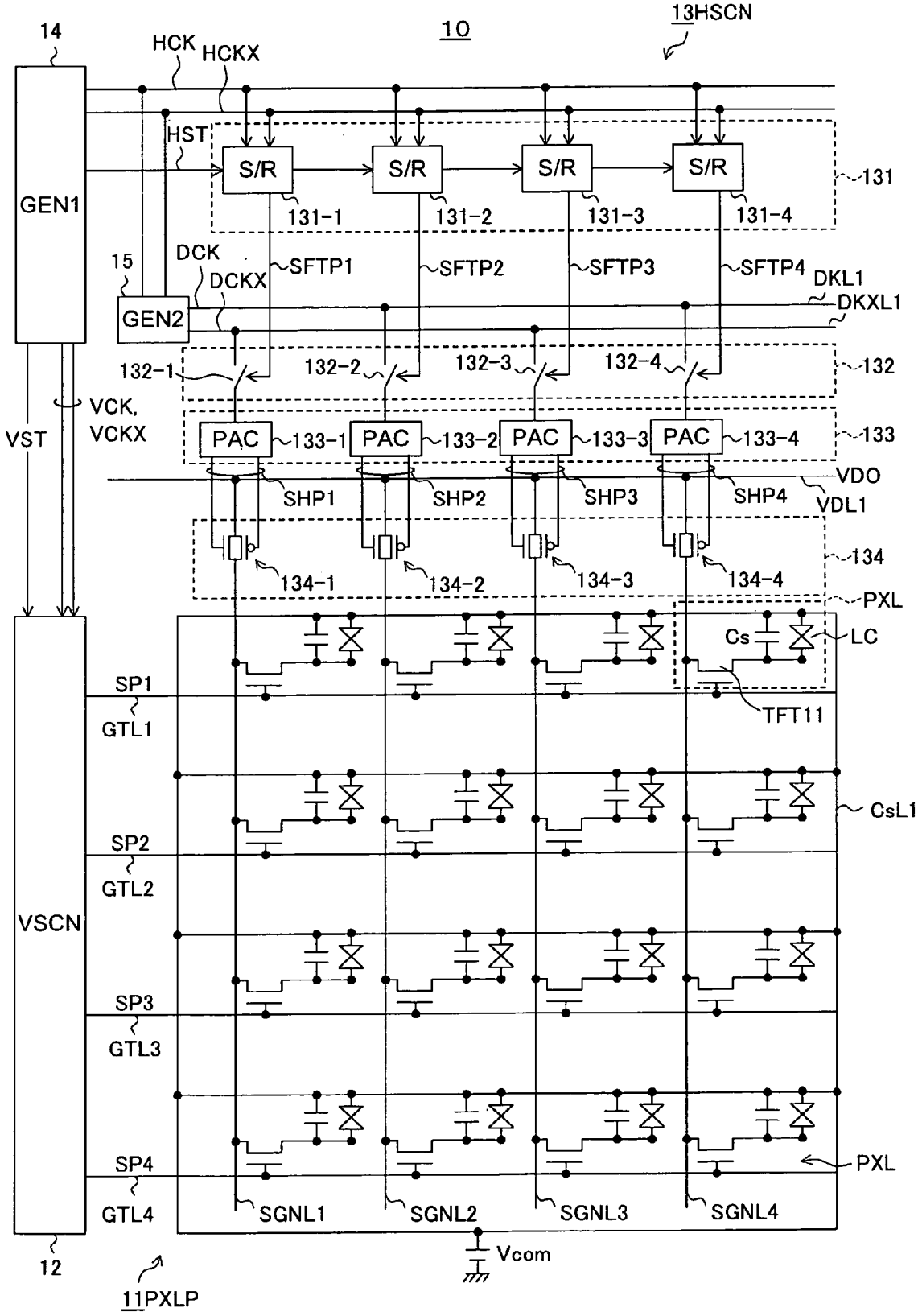
FIG. 1 is a circuit diagram of the configuration of an active matrix type liquid crystal display device employing a general point sequential drive system.
Figure 2:
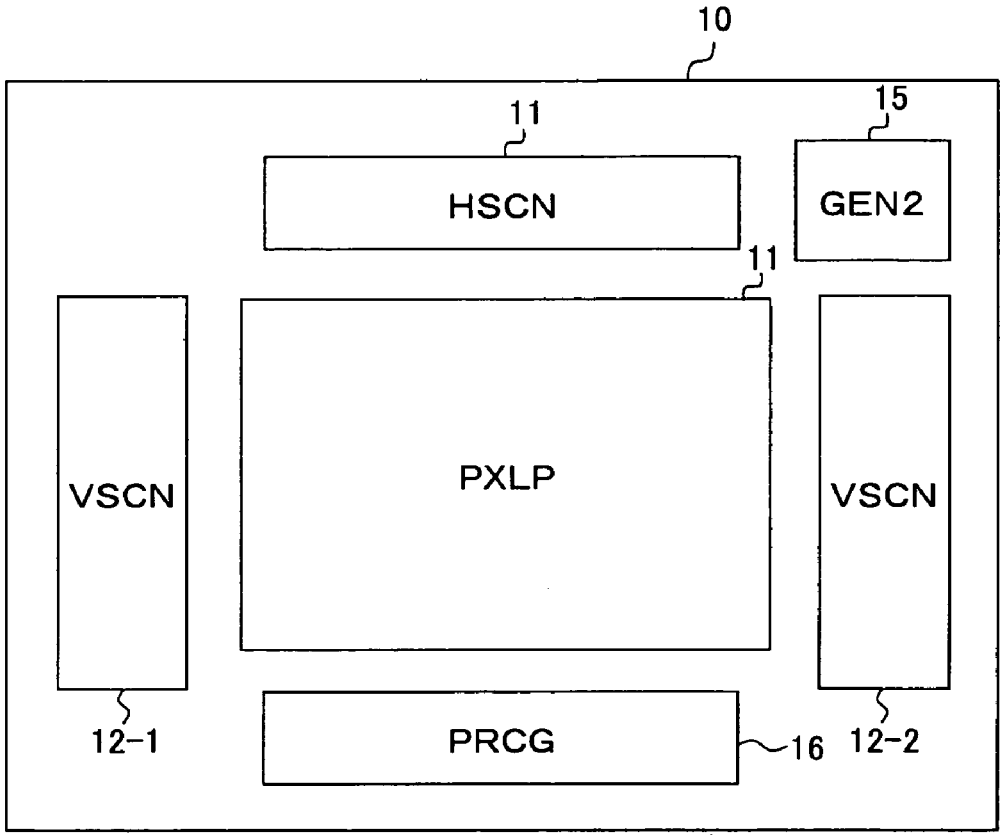
FIG. 2 is a block diagram of an example of the configuration of a display panel of an active matrix type liquid crystal display device.
Figure 3:
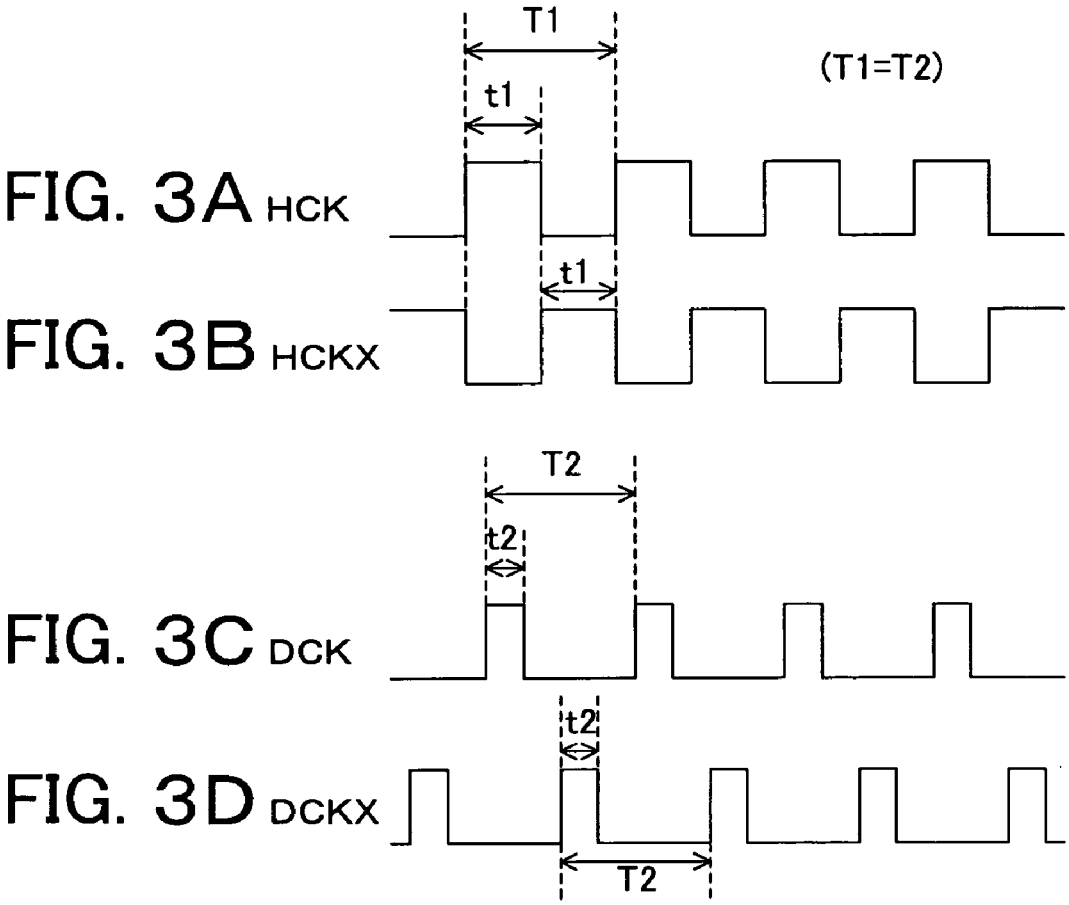
FIGS. 3A to 3D are timing charts showing relationships between horizontal clocks HCK and HCKX and clocks DCK and DCKX.
Figure 4:
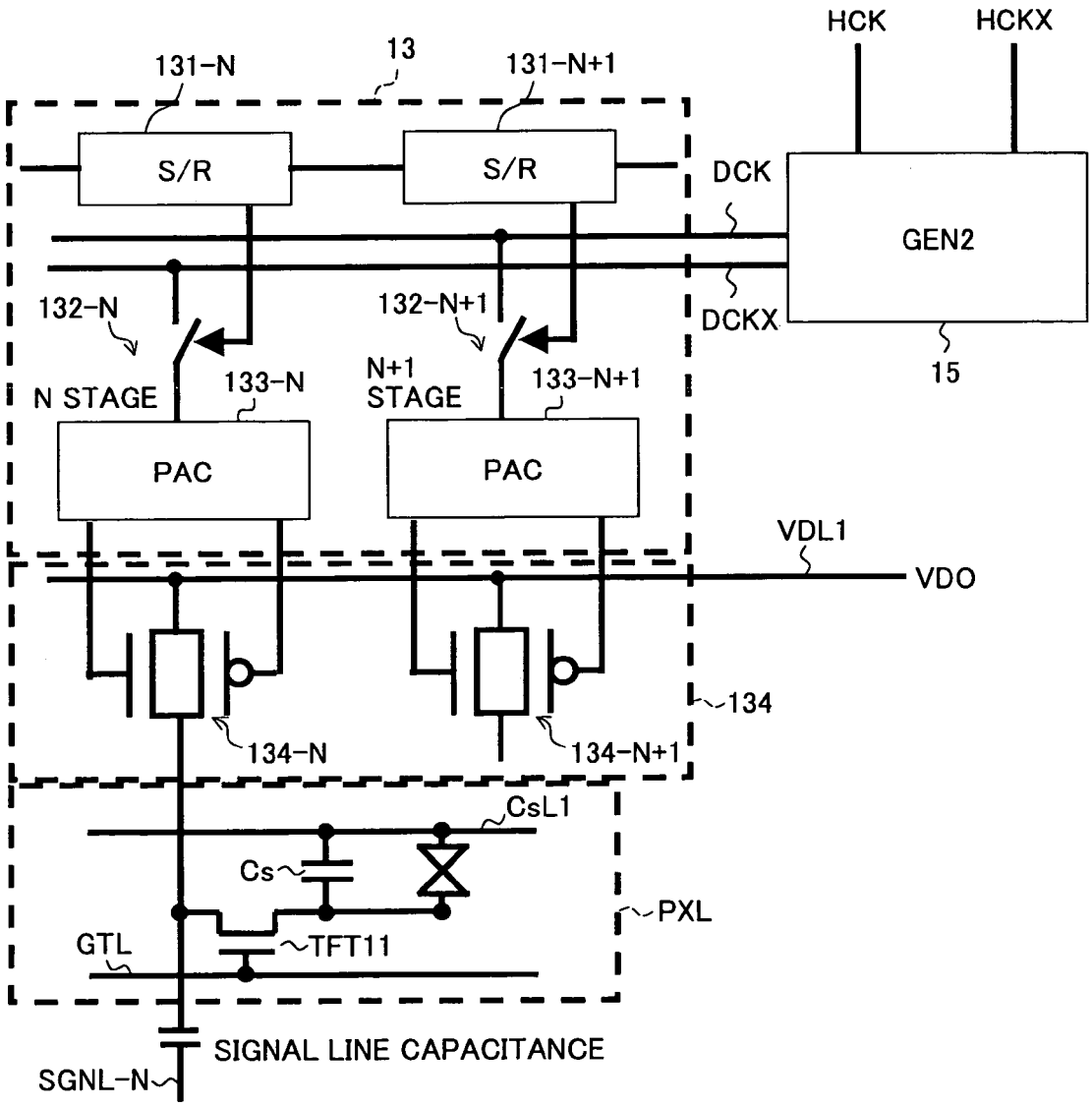
FIG. 4 is a view for explaining the operation focusing on a horizontal scanner of FIG. 1.
Figure 7:
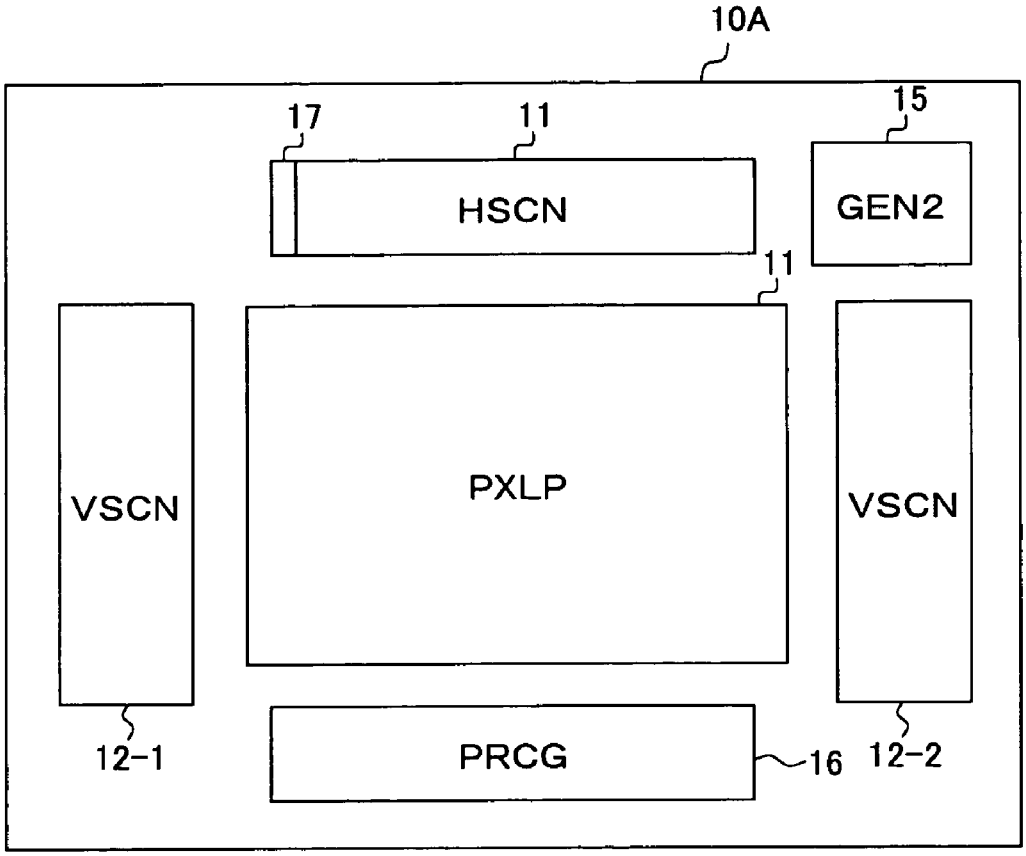
FIG. 7 is a block diagram of an example of the configuration of a conventional liquid crystal display device provided with a monitor circuit.
Figure 8:
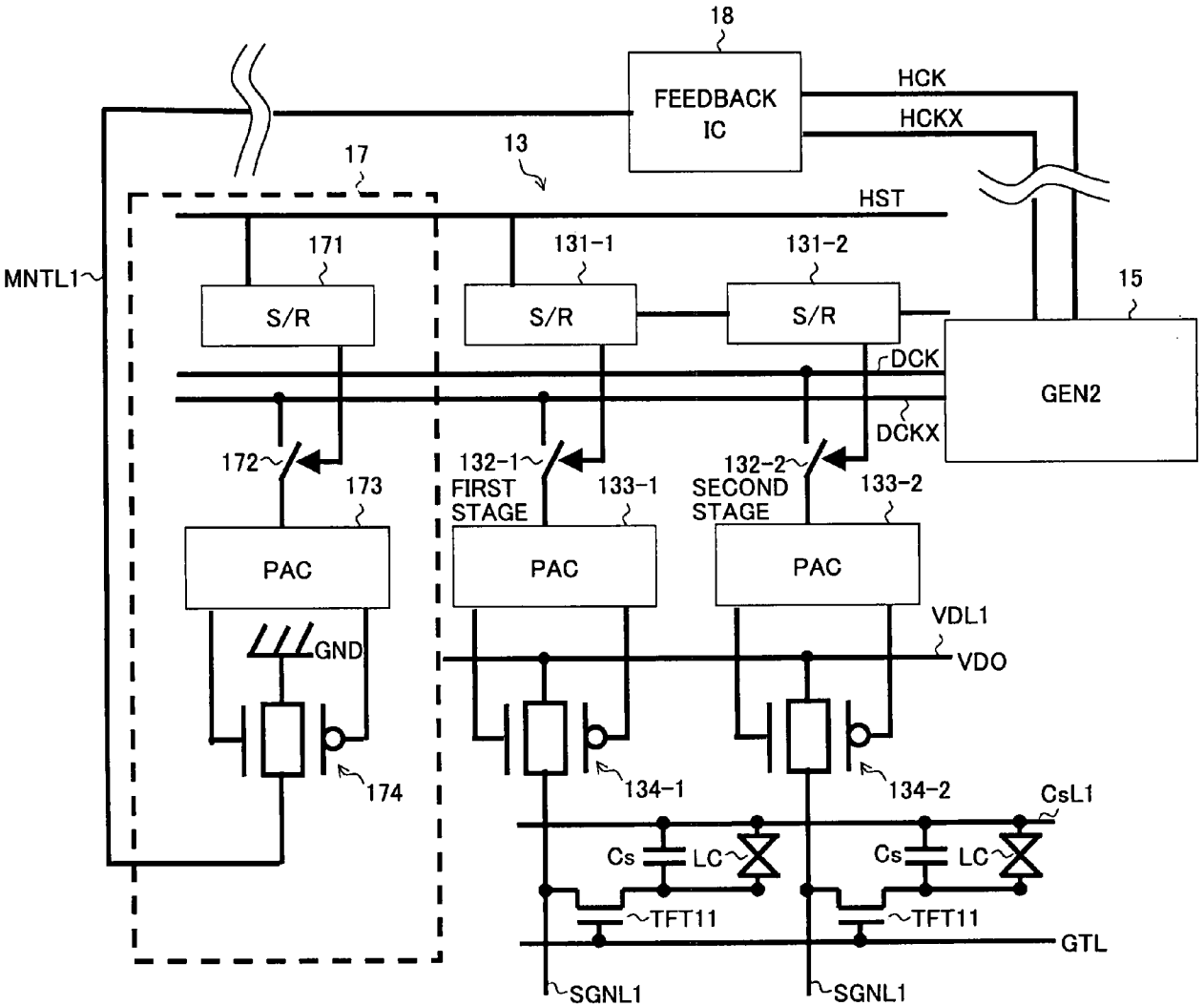
FIG. 8 is a circuit diagram of a concrete example of the configuration of the monitor circuit of FIG. 7 and part of the peripheral horizontal scanner.
Figure 9:
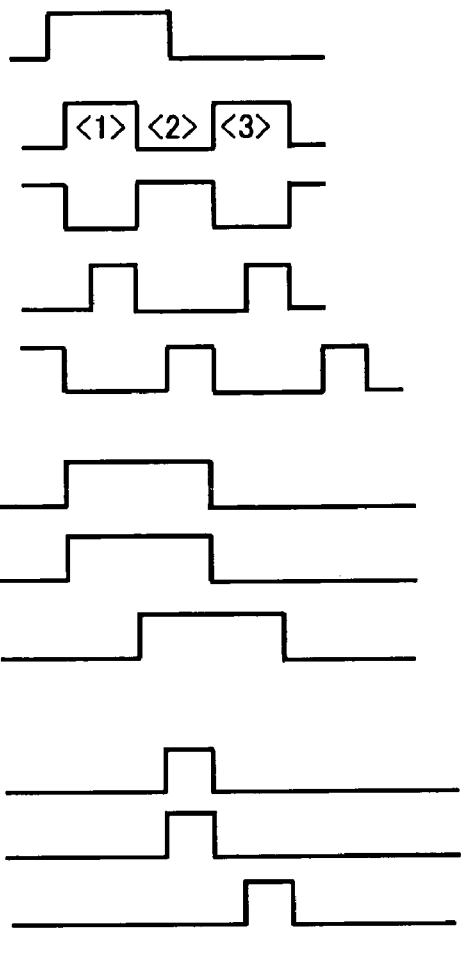
FIGS. 9A to 9K are timing charts for explaining the operation when performing the scan in a usual direction (direction from left to right in FIG. 8) of the circuit of FIG. 8.
Figure 10:
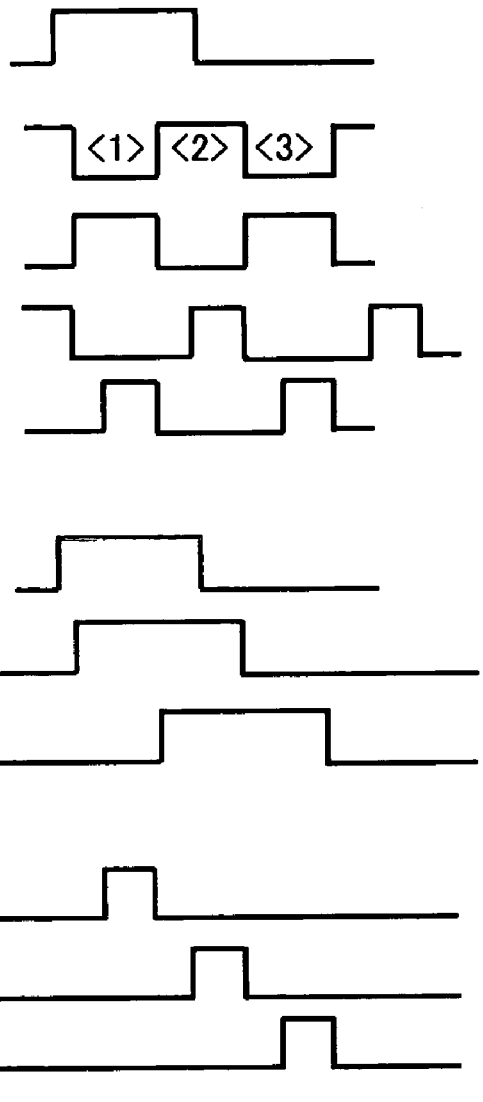
FIGS. 10A to 10K are timing charts for explaining the operation when performing the scan in an inverse direction (direction from right to left in FIG. 8) of the circuit of FIG. 8.
Figure 18:
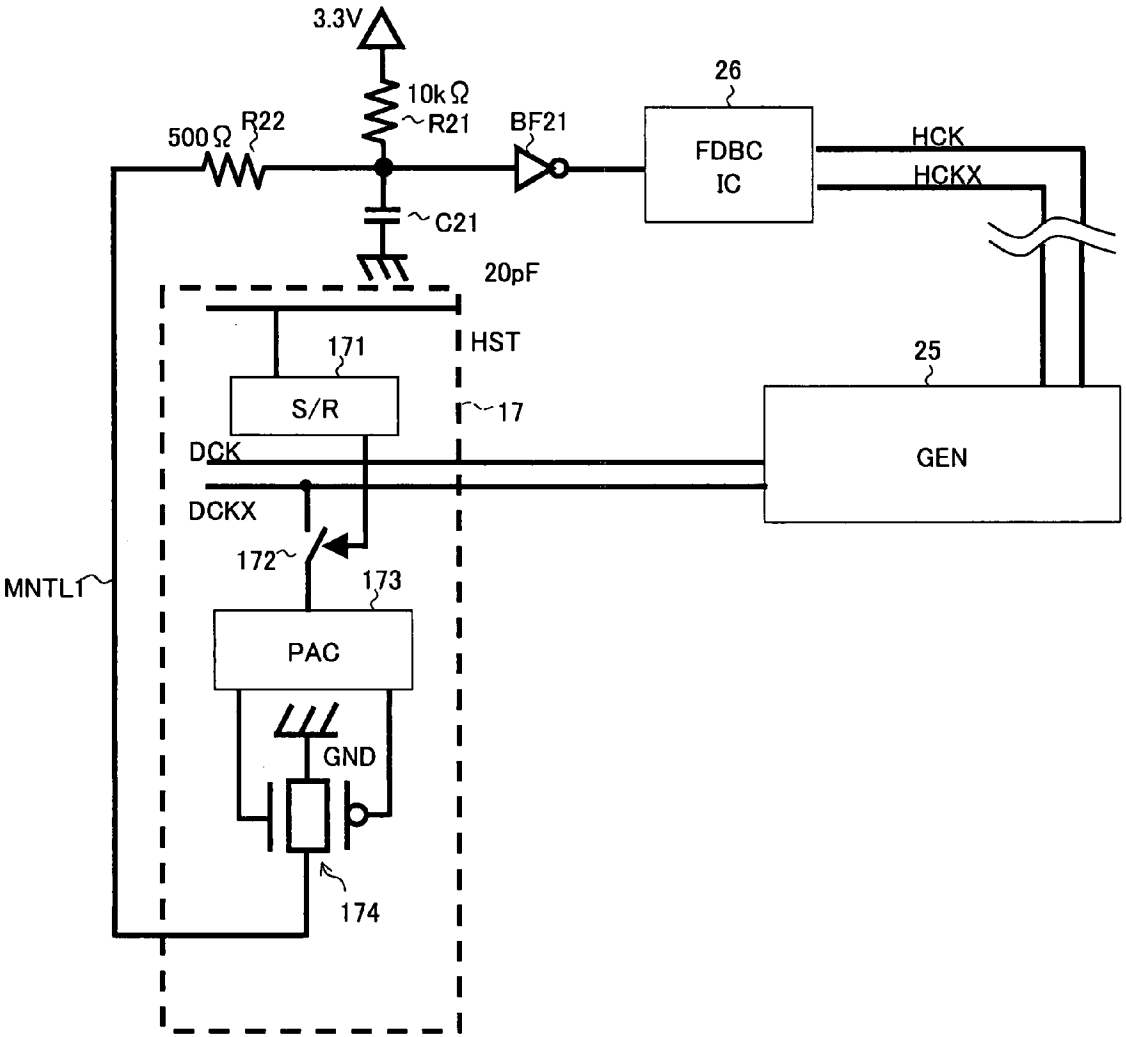
FIG. 18 is an explanatory view of a case of sampling the second clocks DCK and DCKX of FIG. 2 and correcting the drift.

FIG. 18 is a circuit diagram of the output portion of a general drift correction circuit including the monitor circuit 17 of FIG. 8 sampling the second clocks DCK and DCKX. In FIG. 18, in the monitor circuit 24A, the shift stage R22 indicates the interconnect resistor, and C21 indicates the interconnect capacitor.

Figures 19A, 19B:
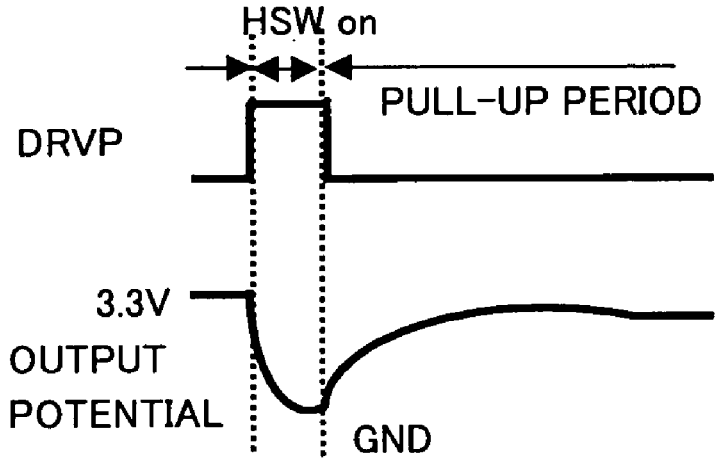
FIGS. 19A and 19B are explanatory views of a case of sampling the second clocks DCK and DCKX and correcting the drift.

The resistor R21 of the pull-up portion must be made sufficiently large in comparison with the internal resistance of the panel so as to pass almost no penetration current to the pull-up power source when the sampling switch (HSW) 174 turns ON and the output is brought to the ground level GND. For this reason, as shown in FIGS. 19A and 19B, the transient at the time of the pull-up becomes loose, the pull-down is fast, but a long time is taken for the pull-up. When the potential change of the output does not become sharp, a delay difference due to the fluctuation of the pull-up transient occurs when monitoring the drift by the feedback control circuit as the external IC, so it becomes impossible to measure the correct drift. For this reason, in the conventional method, the potential change at the time of the pull-down to the ground level GND when the sampling switch (HSW) 174 is ON is monitored by the external feedback control circuit and corrected.

Figure 20:
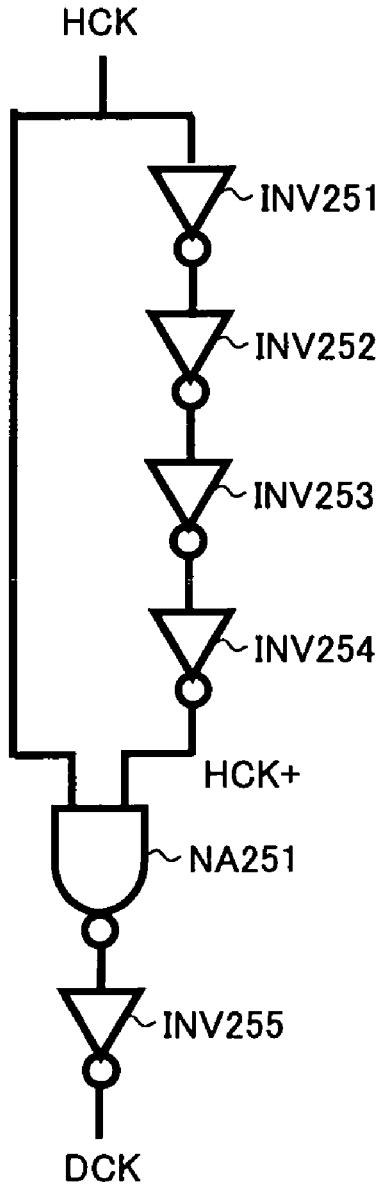
FIG. 20 is a view of an example of the configuration of a generation circuit of a second clock DCK.
Figures 21A, 21B, 21C:
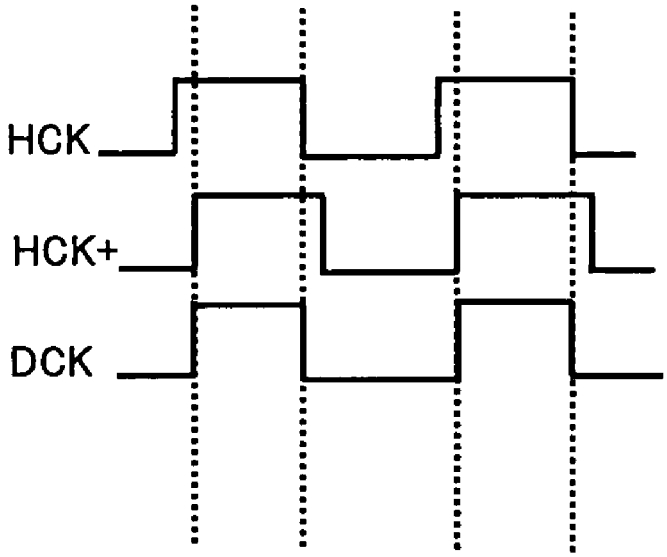
FIGS. 21A to 21C are timing charts of the generation circuit of the second clock DCK.

FIG. 20 is a circuit diagram of a DCK generation circuit in the clock generation circuit 25. The second clock DCK is found by taking a NAND of the first clock HCK of the input and a clock pulse (HCK+) obtained by delaying the clock HCK by passing it through plural stages of inverters INV251 to INV254 at a NAND gate NA251 as shown in FIG. 20. That is, as shown in FIGS. 21A to 21C, the rising edge of the DCK is determined according to the rising edge of the HCK+. Here, the drift when used for a long time is the sum of the transistor delays, therefore, in the DCK generation circuit, it considered that the rising edge of the DCK is large delayed in comparison with the trailing edge, and the pulse width thereof becomes shorter due to the drift. As described above, it is necessary to monitor the delay of the drift when the sampling switch (HSW) 174 becomes ON and pull-down occurs, that is, at the rising edge of the DCK, in order to prevent fluctuation at the time of the monitoring. On the other hand, the sample-and-hold operation inside the panel is carried out at the timing of the trailing edge of the DCK. That is, in the circuit generating the DCK inside the panel, in the circuit configuration thereof, the drift of the rising edge of the DCK sampling output pulse is larger than the drift of the sample-and-hold pulse, and a correct drift cannot be monitored.

Figures 22A, 22B, 22C:
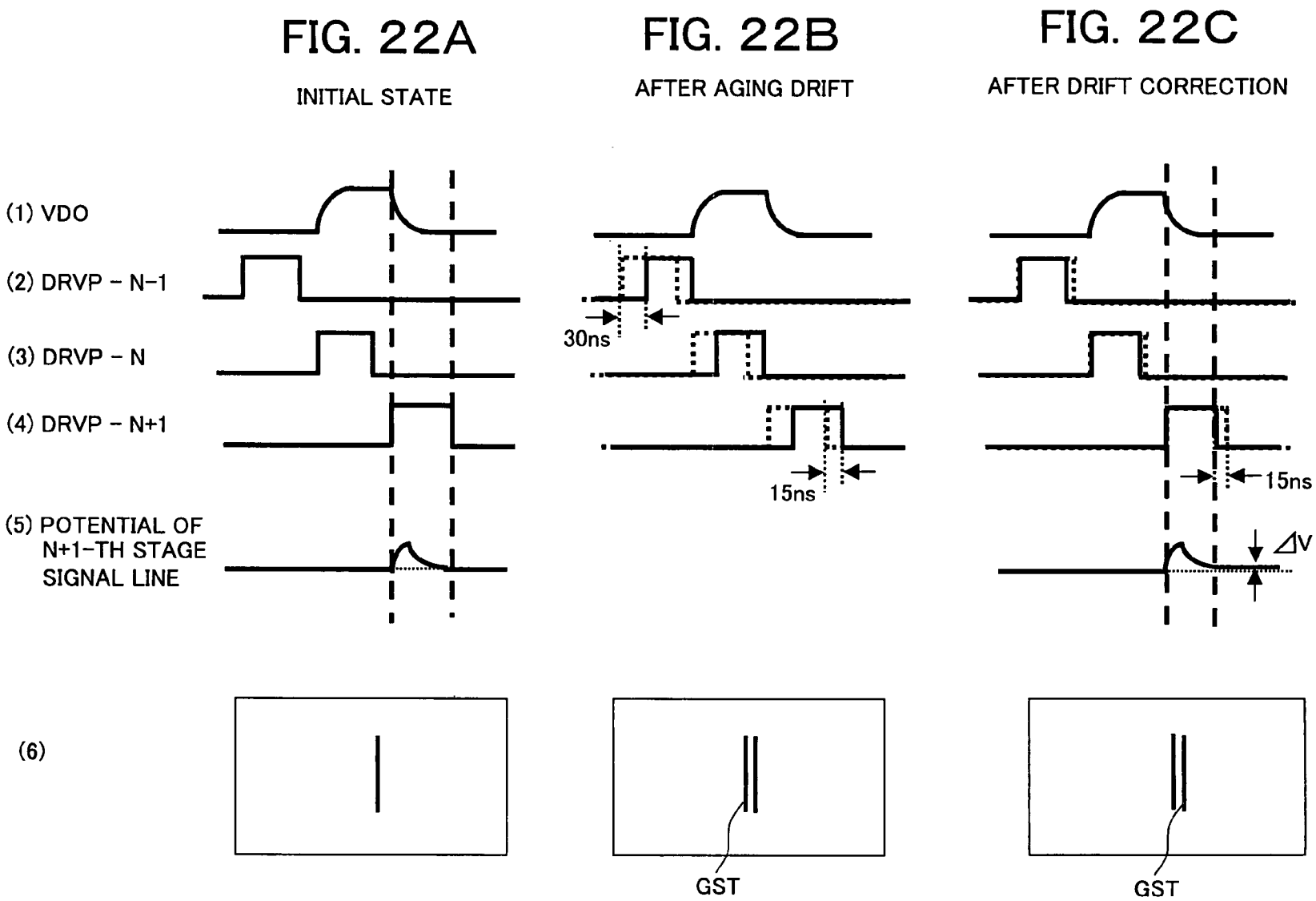
FIGS. 22A to 22C are timing charts of the case of sampling the second clocks DCK and DCKX and correcting the drift.

For this, a detailed description will be made in relation to the timing charts of FIGS. 22A to 22C. In FIGS. 22A to 22C, waveforms of FIG. 22A the initial state, FIG. 22B after aging drift, and FIG. 22C after drift correction when sampling the video signals VDO are shown in parallel.

When sampling and using the DCK pulse as the monitor output, as mentioned above, the delay of the rising edge becomes larger with respect to the trailing edge of the clock DCK. For example, assume that the rising edge is delayed by 30 ns, and the trailing edge is delayed by 15 ns. At this time, as shown in (1) to (6) of FIG. 22B, a ghost GST is generated in the closer direction. Here, the drift is corrected with respect to the rising edge of the clock DCK, therefore, in this case, the input pulse is made earlier by 30 ns. Further, the pulse timing as shown in FIG. 22C is obtained. Here, the trailing edge timing of the sample-and-hold pulse after the drift correction becomes earlier by 15 ns than the initial state. Due to this, the black signal written in the N+1-th stage signal line does not completely return to the gray level, a potential of ΔV remains, and a ghost GST is generated at this position. That is, there is the concern that, the larger the drift, the smaller the margin of the back ghost, so the meaning of the drift correction circuit is lost.

As opposed to this, in the present embodiment, in order to deal with the above phenomenon, the first clocks HCK and HCKX are sampled in place of the second clocks DCK and DCKX as the sample-and-hold pulses of the monitor circuit 24A.

Figures 23A, 23B, 23C:
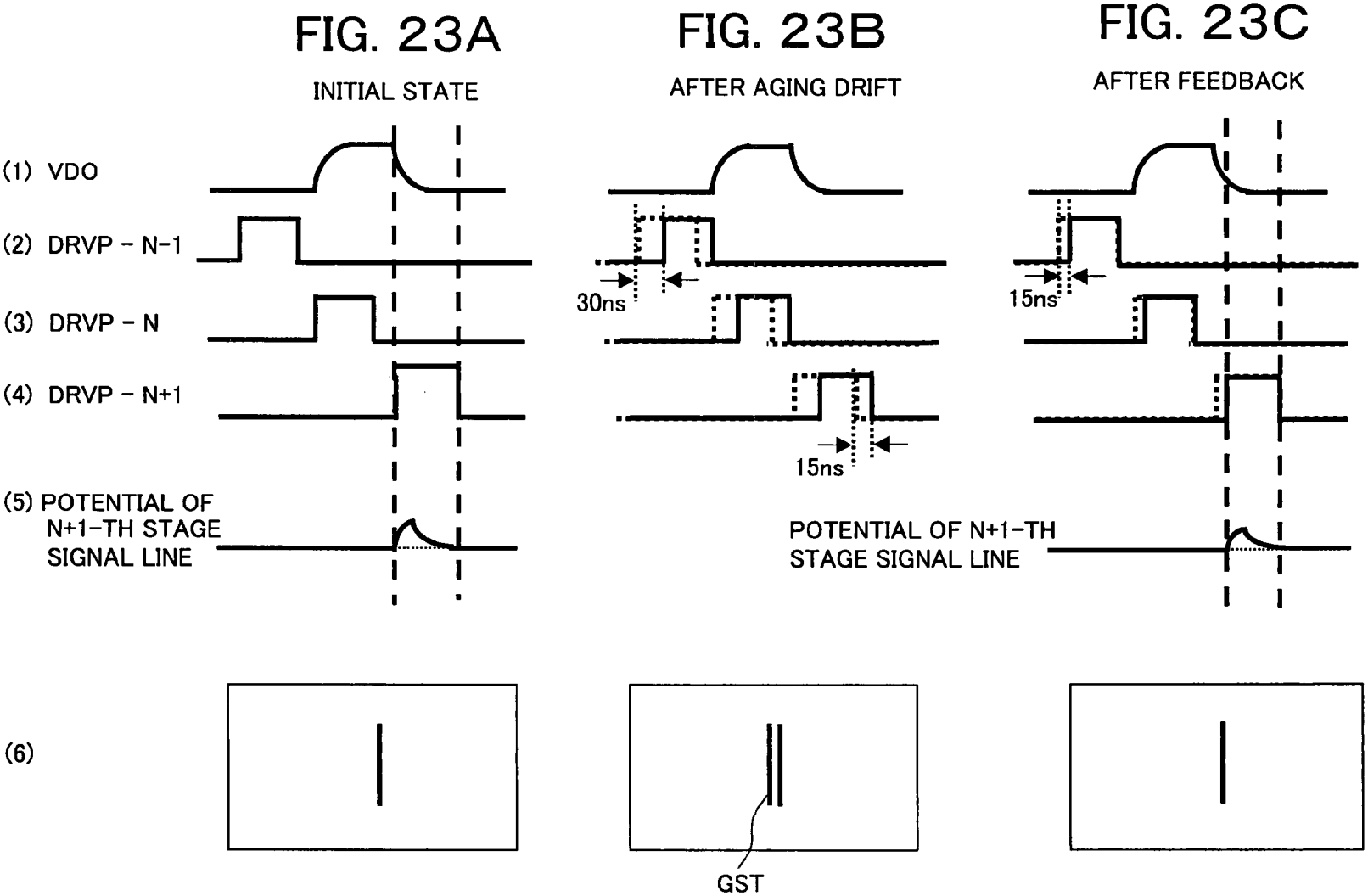
FIGS. 23A to 23C are timing charts in a case of sampling first clocks HCK and HCKX and correcting the drift as in the present second embodiment.

FIGS. 23A to 23C are timing charts in a case of sampling the first clocks HCK and HCKX and correcting the drift as in the present embodiment. In FIGS. 23A to 23C, the waveforms of FIG. 23A in the initial state, FIG. 23B after the aging drift, and FIG. 23C after the drift correction when sampling the video signals VDO are shown in parallel.

The number of the transistors of the path of the first clock HCK is substantially equal to the number of the transistors of the trailing edge path of the second clock DCK, and the delays of the rising edge and trailing edge of the first HCK are values almost unchanged from the delay of the trailing edge of the DCK. That is, the drift correction performed at the rising edge of the first clock HCK has the same meaning as the drift correction performed at the timing of the trailing edge of the second clock DCK, and the delay of the sample-and-hold pulse can be correctly corrected.

For example, as shown in FIGS. 23A to 23C, assume that the rising edge of the second clock DCK is delayed by 30 ns and the trailing edge is delayed by 15 ns. At this time, the rising edge of the first clock HCK is delayed by 15 ns. Here, the drift is corrected with respect to the rising edge of the first clock HCK, so the input pulse is made earlier by 15 ns in this case. Further, the pulse timing as shown in FIG. 23C is obtained. Here, the trailing edge timing of the sample-and-hold pulse is not changed in comparison with the initial state. Due to this, the margin with respect to a back ghost is not changed from the initial state. Further, the rising edge of the sample-and-hold pulse is delayed by 15 ns in comparison with the initial state, so also the drive pulse DRVP thereof becomes short. Here, the ghost margin increases when the drive pulse is shorter. Therefore, by making the first clock HCK the sampling sample-and-hold pulse at the monitor circuit 24A as in the present embodiment, not only is the drift correctly corrected, but also the margin against ghosts increases.

Next, an explanation will be given of the usualscanning operation and the inverse scanning operation by the above configuration in relation to the timing charts of FIGS. 24A to 24K and FIGS. 25A to 25K.

First, the usual scanning operation will be explained in relation to the timing charts of FIGS. 24A to 24K.

In this case, the scanning direction switch signal RGT is set at the high level and supplied to the shift register 231 of the horizontal scanner 23 and the selector 2413 of the monitor circuit 24A (for example the inverted signal RGTX is also supplied to the selector 2413). Due to this, routes through which the switch circuits 2311 to 2313 inserted among the shift stages in the shift register 231 of the horizontal scanner 23 propagate the signals from left to right are formed. That is, signal propagation routes through which the horizontal start pulse HST is sequentially shifted from the first shift stage 231-1 to the second shift stage 231-2, from the second shift stage 231-2 to the third shift stage 231-3, and from the third shift stage 231-3 to the fourth shift stage 231-4 are formed.

In this state, in the feedback control circuit 26, the horizontal start pulse HST as shown in FIG. 24A is generated and supplied to the first shift stage 231-1 of the shift register 231 in the horizontal scanner 23 and the selector 2413 of the monitor circuit 24A. Further, in the feedback control circuit 26, as shown in FIGS. 24B and 24C, the horizontal clocks HCK and HCKX having inverse phases to each other are generated and supplied to the first shift stage 231-1 to fourth shift stage 231-4 of the shift register 231 in the horizontal scanner 23, the monitor circuit 24A, and the clock generation circuit 25. In the clock generation circuit 25, as shown in FIGS. 24D and 24E, the clocks DCK and DCKX having the same period (T1=T2) as the horizontal clocks HCK and HCKX generated at the feedback control circuit 26, having,a small duty ratio, and having inverse phases to each other are generated and supplied through the clock lines DKL1 and DKXL21 to the horizontal scanner 23.

In the feedback control circuit 26, the vertical start pulse VST for instructing the start of the vertical scan, and the vertical clocks VCK and VCKS having inverse phases to each other and serving as reference of the vertical scan, are generated and supplied to the vertical scanner 22.

Further, in the monitor circuit 24A, by receiving the horizontal start pulse HST and the switch signal RGT and the inverted signal RGTX thereof, since the switch signal RGT is at the high level for instructing the first scanning operation, as shown in FIG. 24F, the horizontal start pulse HST is output as the select pulse SLP241 to the switch 2411, and the first clock HCK having the different phase from that of the second clock DCKX sampled by the first shift stage 231-1 of the horizontal scanner 23 is sampled, is adjusted in phase at the phase adjust circuit 242, and then, as shown in FIG. 24I, is supplied as the sample-and-hold pulse SHP241 to the sampling switch 243. Due to this, the sampling switch 243 enters the ON state in response to the sample-and-hold pulse SHP241, the monitor line MNTL21 pulled up by the pull-up resistor R21 on the outside of the liquid crystal display panel is pulled to the ground level, and the level change information thereof is input to the feedback control circuit 26 via the buffer BF21.

Further, in the shift register 231 of the horizontal scanner 23, in the first shift stage 231-1 to which the horizontal start pulse HST is supplied by the external feedback control circuit 26, in synchronization with the horizontal clocks HCK and HCKX having inverse phases, as shown in FIG. 24G, the shift pulse SFTP231 having the same pulse width as the periods of the horizontal clocks HCK and HCKX is output to the sampling switch 232-1. Further, the shift pulse SFTP231 is shifted to the second shift stage 231-2 from the first shift stage 231-1. The sampling switch 232-1 corresponding to the first shift stage 231-1 enters the ON state in response to the shift pulse SFTP231, and as shown in FIGS. 24E and 24J, the second clock DCKX output to the clock line DKXL21 is sampled, is adjusted in phase at the phase adjust circuit 233-1, and then is supplied as the sample-and-hold pulse SHP231 to the sampling switch 234-1. Due to this, the sampling switch 234-1 enters the ON state in response to the sample-and-hold pulse SHP231, and the video signals VDO input through the video line VDL21 are sampled and supplied to the signal line SGNL21 of the pixel portion 21.

Next, at the second shift stage 231-2 into which the shift pulse SFTP231 was shifted from the first shift stage 231-1, in synchronization with the horizontal clocks HCK and HCKX having inverse phases, as shown in FIG. 24G, the shift pulse SFTP232 having the same pulse width as the periods of the horizontal clocks HCK and HCKX is output to the sampling switch 232-2. Further, the shift pulse SFTP232 is shifted to the third shift stage 231-3 from the second shift stage 231-2. The sampling switch 232-2 corresponding to the second shift stage 231-2 enters the ON state in response to the shift pulse SFTP232, and as shown in FIGS. 24D and 24K, the second clock DCK output to the clock line DKL21 is sampled, is adjusted in phase at the phase adjust circuit 233-2, and then is supplied as the sample-and-hold pulse SHP232 to the sampling switch 234-2. Due to this, the sampling switch 234-2 enters the ON state in response to the sample-and-hold pulse SHP232, and the video signals VDO input through the video line VDL21 are sampled and supplied to the signal line SGNL22 of the pixel portion 21.

Next, at the third shift stage 231-3 into which the shift pulse SFTP232 was shifted from the second shift stage 231-2, in synchronization with the horizontal clocks HCK and HCKX having inverse phases, the shift pulse SFTP233 having the same pulse width as the periods of the horizontal clocks HCK and HCKX is output to the sampling switch 232-3. Further, the shift pulse SFTP233 is shifted to the fourth shift stage 231-4 from the third shift stage 231-3. The sampling switch 232-3 corresponding to the third shift stage 231-3 enters the ON state in response to the shift pulse SFTP233, and the second clock DCKX output to the clock line DKXL21 is sampled, is adjusted in phase at the phase adjust circuit 233-3, and then is supplied as the sample-and-hold pulse SHP233 to the sampling switch 234-3. Due to this, the sampling switch 234-3 enters the ON state in response to the sample-and-hold pulse SHP233, and the video signals VDO input through the video line VDL21 are sampled and supplied to the signal line SGNL23 of the pixel portion 21.

Next, at the fourth shift stage 231-4 into which the shift pulse SFTP233 was shifted from the third shift stage 231-3, in synchronization with the horizontal clocks HCK and HCKX having inverse phases, the shift pulse SFTP234 having the same pulse width as the periods of the horizontal clocks HCK and HCKX is output to the sampling switch 232-4. The sampling switch 232-4 corresponding to the fourth shift stage 231-4 enters the ON state in response to the shift pulse SFTP234, and the second clock DCK output to the clock line DKL21 is sampled, is adjusted in phase at the phase adjust circuit 233-4, and then is supplied as the sample-and-hold pulse SHP234 to the sampling switch 234-4. Due to this, the sampling switch 234-4 enters the ON state in response to the sample-and-hold pulse SHP234, and the video signals VDO input through the video line VDL21 are sampled and supplied to the signal line SGNL24 of the pixel portion 21.

At the feedback control circuit 26, the change of the phase from the initial state is monitored from the timing when the sampling switch 243 of the monitor circuit 24A at the time of the usual scanning operation becomes conductive and the monitor line MNTL21 shifts to the ground level. At the feedback control circuit 26, the amount of change of the monitored phase is fed back to the clocks HCK, HCKX, etc. of the panel input and the suitable timing is set. Due to this, the generation of a ghost due to the drift of the sample-and-hold pulse SHP from the initial state thereof is prevented.

As described above, at the time of the usual scanning operation, in the monitor circuit 24A, by receiving the horizontal start pulse HST and the switch signal RGT and the inverted signal RGTX thereof, the selector portion 241 samples the first clock HCK having the different phase from that of the second clock DCKX sampled by the first shift stage 231-1 of the horizontal scanner 23, adjusts it in phase at the phase adjust circuit 242, and then supplies the same as the sample-and-hold pulse SHP241 to the sampling switch 243, and thus the sampling switch 243 enters the ON state. Further, at the horizontal scanner 23, when the shift pulses SFTP231 to SFTP234 are given from the shift stages 231-1 to 231-4 of the shift register 231, the switches 232-1 to 232-4 of the clock sampling switch group 232 sequentially enter the ON state in response to these shift pulses SFTP231 to SFTP234, whereby the second clocks DCKX and DCK having inverse phases to each other are alternately sampled, and the clocks DCKX and DCK adjusted in phase at the phase adjust circuit group 233 are given as the sample-and-hold pulses SHP231 to SHP234. Further, at the sampling switches 234-1 to 234-4 of the sampling switch group 234, when the sample-and-hold pulses SHP231 to SHP234 are given, these switches sequentially enter the ON state in response to these sample-and-hold pulses SHP231 to SHP234, and the video signals VDO input through the video line VDL21 are sequentially sampled and supplied to the signal lines SGNL21 to SGNL24 of the pixel portion 21. That is, the sample-and-hold pulse SHP231 of the first shift stage of the horizontal scanner 23 and the sample-and-hold pulse SHP241 of the monitor circuit 24A are generated at substantially the same timing as the relationships of the other sample-and-hold pulses SHP232 to SHP234, and the image is displayed without a problem.

Next, the inverse scanning operation will be explained in relation to the timing charts of FIGS. 25A to 25K.

In this case, the scanning direction switch signal RGT is set at the low level and supplied to the shift register 231 of the horizontal scanner 23 and the selector 2413 of the monitor circuit 24A (for example also the inverted signal RGTX is supplied to the selector 2413). Due to this, routes through which the switch circuits 2311 to 2313 inserted among the shift stages in the shift register 231 of the horizontal scanner 23 propagate the signals from right to left are formed. That is, the signal propagation routes through which the horizontal start pulse HST is sequentially shifted from the fourth shift stage 231-4 to the third shift stage 231-3, from the third shift stage 231-3 to the second shift stage 231-2, and from the second shift stage 231-2 to the first shift stage 231-1 are formed.

In this state, in the feedback control circuit 26, the horizontal start pulse HST as shown in FIG. 25A is generated and supplied to the fourth shift stage 231-4 of the shift register 231 in the horizontal scanner 23 and the selector 2413 of the monitor circuit 24A. Further, in the feedback control circuit 26, as shown in FIGS. 25B and 25C, the horizontal clocks HCK and HCKX having inverse phases to each other are generated and supplied to the first shift stage 231-1 to fourth shift stage 231-4 of the shift register 231 in the horizontal scanner 23, the monitor circuit 24A, and the clock generation circuit 25. In the clock generation circuit 25, as shown in FIGS. 25D and 25E, the clocks DCK and DCKX having the same period (T1=T2) as the horizontal clocks HCK and HCKX generated at the feedback control circuit 26, having a small duty ratio, and having inverse phases to each other are generated and supplied through the clock lines DKL21 and DKXL21 to the horizontal scanner 23.

In the feedback control circuit 26, the vertical start pulse VST for instructing the start of the vertical scan, and the vertical clocks VCK and VCKS having inverse phases to each other and serving as reference of the vertical scan, are generated and supplied to the vertical scanner 22.

Further, in the monitor circuit 24A, by receiving the horizontal start pulse HST and the switch signal RGT and the inverted signal RGTX thereof, since the switch signal RGT is at the low level for instructing the second scanning operation, as shown in FIG. 25F, the horizontal start pulse HST is output as the select pulse SLP242 to the switch 2412, and the first clock HCKX having the different phase from that of the second clock DCK sampled by the fourth shift stage 231-4 of the horizontal scanner 23 is sampled, is adjusted in phase at the phase adjust circuit 242, and then, as shown in FIG. 25I, and supplied as the sample-and-hold pulse SHP241 to the sampling switch 243. Due to this, the sampling switch 243 enters the ON state in response to the sample-and-hold pulse SHP241, the monitor line MNTL21 pulled up by the pull-up resistor R21 on the outside of the liquid crystal display panel is pulled to the ground level, and the level change information thereof is input to the feedback control circuit 26 via the buffer BF21.

Further, in the shift register 231 of the horizontal scanner 23, in the fourth shift stage 231-4 to which the horizontal start pulse HST was supplied by the external feedback control circuit 26, in synchronization with the horizontal clocks HCK and HCKX having inverse phases, as shown in FIG. 25G, the shift pulse SFTP234 having the same pulse width as the periods of the horizontal clocks HCK and HCKX is output to the sampling switch 232-4. Further, the shift pulse SFTP234 is shifted to the third shift stage 231-3 from the fourth shift stage 231-4. The sampling switch 232-4 corresponding to the fourth shift stage 231-4 enters the ON state in response to the shift pulse SFTP234, and as shown in FIGS. 25E and 25J, the second clock DCK output to the clock line DKL21 is sampled, is adjusted in phase at the phase adjust circuit 233-4, and then is supplied as the sample-and-hold pulse SHP234 to the sampling switch 234-4. Due to this, the sampling switch 234-4 enters the ON state in response to the sample-and-hold pulse SHP234, and the video signals VDO input through the video line VDL21 are sampled and supplied to the signal line SGNL24 of the pixel portion 24.

Next, at the third shift stage 231-3 into which the shift pulse SFTP234 was shifted from the fourth shift stage 231-4, in synchronization with the horizontal clocks HCK and HCKX having inverse phases, as shown in FIG. 25G, the shift pulse SFTP233 having the same pulse width as the periods of the horizontal clocks HCK and HCKX is output to the sampling switch 232-3. Further, the shift pulse SFTP233 is shifted to the second shift stage 231-2 from the third shift stage 231-3. The sampling switch 232-3 corresponding to the third shift stage 231-3 enters the ON state in response to the shift pulse SFTP233, and as shown in FIGS. 25D and 25K, the second clock DCKX output to the clock line DKLX21 is sampled, is adjusted in phase at the phase adjust circuit 233-3, and then is supplied as the sample-and-hold pulse SHP233 to the sampling switch 234-3. Due to this, the sampling switch 234-3 enters the ON state in response to the sample-and-hold pulse SHP233, and the video signals VDO input through the video line VDL21 are sampled and supplied to the signal line SGNL23 of the pixel portion 21.

Next, at the second shift stage 231-2 into which the shift pulse SFTP233 was shifted from the third shift stage 231-3, in synchronization with the horizontal clocks HCK and HCKX having inverse phases, the shift pulse SFTP232 having the same pulse width as the periods of the horizontal clocks HCK and HCKX is output to the sampling switch 232-2. Further, the shift pulse SFTP232 is shifted to the first shift stage 231-1 from the second shift stage 231-2. The sampling switch 232-2 corresponding to the second shift stage 231-2 enters the ON state in response to the shift pulse SFTP232, and the second clock DCK output to the clock line DKL21 is sampled, is adjusted in phase at the phase adjust circuit 233-2, and then is supplied as the sample-and-hold pulse SHP232 to the sampling switch 234-2. Due to this, the sampling switch 234-2 enters the ON state in response to the sample-and-hold pulse SHP232, and the video signals VDO input through the video line VDL21 are sampled and supplied to the signal line SGNL22 of the pixel portion 21.

Next, at the first shift stage 231-1 into which the shift pulse SFTP232 was shifted from the second shift stage 231-2, in synchronization with the horizontal clocks HCK and HCKX having inverse phases, the shift pulse SFTP231 having the same pulse width as the periods of the horizontal clocks HCK and HCKX is output to the sampling switch 232-1. The sampling switch 232-1 corresponding to the first shift stage 231-1 enters the ON state in response to the shift pulse SFTP231, and the second clock DCKX output to the clock line DKXL21 is sampled, is adjusted in phase at the phase adjust circuit 233-1, and then is supplied as the sample-and-hold pulse SHP231 to the sampling switch 234-1. Due to this, the sampling switch 234-1 enters the ON state in response to the sample-and-hold pulse SHP231, and the video signals VDO input through the video line VDL21 are sampled and supplied to the signal line SGNL21 of the pixel portion 21.

At the feedback control circuit 26, the change of the phase from the initial state is monitored from the timing when the sampling switch 243 of the monitor circuit 24A at the time of the usual scanning operation becomes conductive and the monitor line MNTL21 shifts to the ground level. At the feedback control circuit 26, the amount of change of the monitored phase is fed back to the clocks HCK, HCKX, etc. of the panel input and the suitable timing is set. Due to this, the generation of the ghost due to the drift of the sample-and-hold pulse SHP from the initial state thereof is prevented.

As described above, at the time of the inverse scanning operation, in the monitor circuit 24A, by receiving the horizontal start pulse HST and the switch signal RGT and the inverted signal RGTX thereof, the selector portion 241 samples the first clock HCKX having the different phase from that of the second clock DCK sampled by the fourth shift stage 231-4 of the horizontal scanner 23, adjusts it in phase at the phase adjust circuit 242, and then supplies the same as the sample-and-hold pulse SHP241 to the sampling switch 243, and thus the sampling switch 243 enters the ON state. Further, at the horizontal scanner 23, when the shift pulses SFTP234 to SFTP231 are given from the shift stages 234-1 to 231-1 of the shift register 231, the switches 232-4 to 232-1 of the clock sampling switch group 232 sequentially enter the ON state in response to these shift pulses SFTP234 to SFTP231, whereby the second clocks DCK and DCKX having inverse phases to each other are alternately sampled, and the clocks DCK and DCKX adjusted in phase at the phase adjust circuit 233 are given as the sample-and-hold pulses SHP234 to SHP231. Further, at the sampling switches 234-4 to 234-1 of the sampling switch group 234, when the sample-and-hold pulses SHP234 to SHP231 are given, these switches sequentially enter the ON state in response to these sample-and-hold pulses SHP234 to SHP231, and the video signals VDO input through the video line VDL21 are sequentially sampled and supplied to the signal lines SGNL24 to SGNL21 of the pixel portion 21.

That is, the sample-and-hold pulse SHP234 of the fourth shift stage of the horizontal scanner 23 and the sample-and-hold pulse SHP241 of the monitor circuit 24A are generated at substantially the same timing as the relationships of the other sample-and-hold pulses SHP231 to SHP233, and the image is displayed without a problem. That is, even if the phase of the clock changes at the time of the left/right inversion of the scanning operation, pulses having uniform phases of output can be obtained.

As explained above, according to the second embodiment, the monitor circuit 24A is arranged close to one side portion of the horizontal scanner 23. At the time of the first scanning operation (usual scanning operation), the horizontal start pulse HST is supplied to the shift stage 231-1 of the initial stage of the horizontal scanner 23 and the selector 2413 of the monitor circuit 24A. In the monitor circuit 24A, by receiving the horizontal start pulse HST and the switch signal RGT and the inverted signal RGTX thereof, the selector portion 241 samples the first clock HCK having the different phase from that of the second clock DCKX sampled by the first shift stage 231-1 of the horizontal scanner 23 and outputs the same as the sample-and-hold pulse SHP241, and the sampling switch 243 sets the potential of the pulled up monitor line MNTL21 at the ground potential in response to the sample-and-hold pulse. At the time of the second scanning operation (inverse scanning operation), in the monitor circuit 24A, by receiving the horizontal start pulse HST and the switch signal RGT and the inverted signal RGTX thereof, the selector portion 241 samples the second clock HCKX having the different phase from that of the second clock DCK sampled by the fourth shift stage 231-4 of the horizontal scanner 23 and outputs the same as the sample-and-hold pulse SHP241, and the sampling switch 243 sets the potential of the pulled up monitor line MNTL21 at the ground potential in response to the sample-and-hold pulse. Therefore, the following effects can be obtained. That is, the drift of the sample-and-hold pulse due to the change of characteristics of the transistors by panel aging or the like can be correctly corrected. In this way, even in a horizontal scanner (even number of shift stages) in which the phase of the clock is inverted in scanning direction inversion, a high precision image display can be realized no matter which the scanning direction of operation without any change of the phase of the output potential change. Further, a sample-and-hold pulse having an increased margin against ghosts due to aging can be obtained.

Further, a configuration providing monitor circuits at both side portions of the horizontal scanner 23 is also possible. In this case, the outputs of the two monitor circuits are connected by an Al or other interconnect. In order to prevent a resistance difference of the amount of the Al interconnect from occurring in the outputs of the two monitor circuits, it is necessary to make the line width of this Al interconnect about 100 μm. The layout area taken ends up becoming larger. This will become a problem as frames become narrower in the future. As opposed to this, in the second embodiment, the scanning operation of the horizontal scanner in which the phase of the clock inverts in scanning direction inversion can be monitored with a high precision by only providing one monitor circuit. Therefore, it is not necessary to connect circuits by an Al interconnect, the layout space can be reduced, which is advantageous also in the layout, and it is possible to sufficiently deal with the future narrower frames. Further, by making the circuit configuration after the clock sampling the same as that of the other horizontal scanner in the monitor circuit 24A, output pulses having the same delay can be obtained.

Further, in the second embodiment as well, at the horizontal scanner 23, the shift pulses SFTP231 to SFTP234 which are sequentially output from the shift register 231 are not used as the sample-and-hold pulses, but the clocks DCKX and DCK having inverse phases to each other are alternately sampled in synchronization with the shift pulses SFTP231 to SFTP234, and these clocks DCKX and DCK are used as the sample-and-hold pulses SHP231 to SHP234 via the phase adjust circuit. Due to this, fluctuation of the sample-and-hold pulses SHP231 to SHP234 can be suppressed. As a result, a ghost due to the fluctuation of the sample-and-hold pulses SHP231 to SHP234 can be eliminated.

In addition, in the horizontal scanner 23, the horizontal clocks HCXK and HCK serving as reference of the shift operation of the shift register 231 are not sampled and used as the sample-and-hold pulses, but the clocks DCKX and DCK having the same period with respect to the horizontal clocks HCXK and HCK and having a small duty ratio are separately generated and these clocks DCKX and DCK are sampled and used as the sample-and-hold pulses SHP231 to SHP234. Therefore, at horizontal driving, completely non-overlapping sampling between sampling pulses can be realized, so the generation of vertical stripes due to the overlapping sampling can be suppressed.

Third Embodiment

Figure 26:
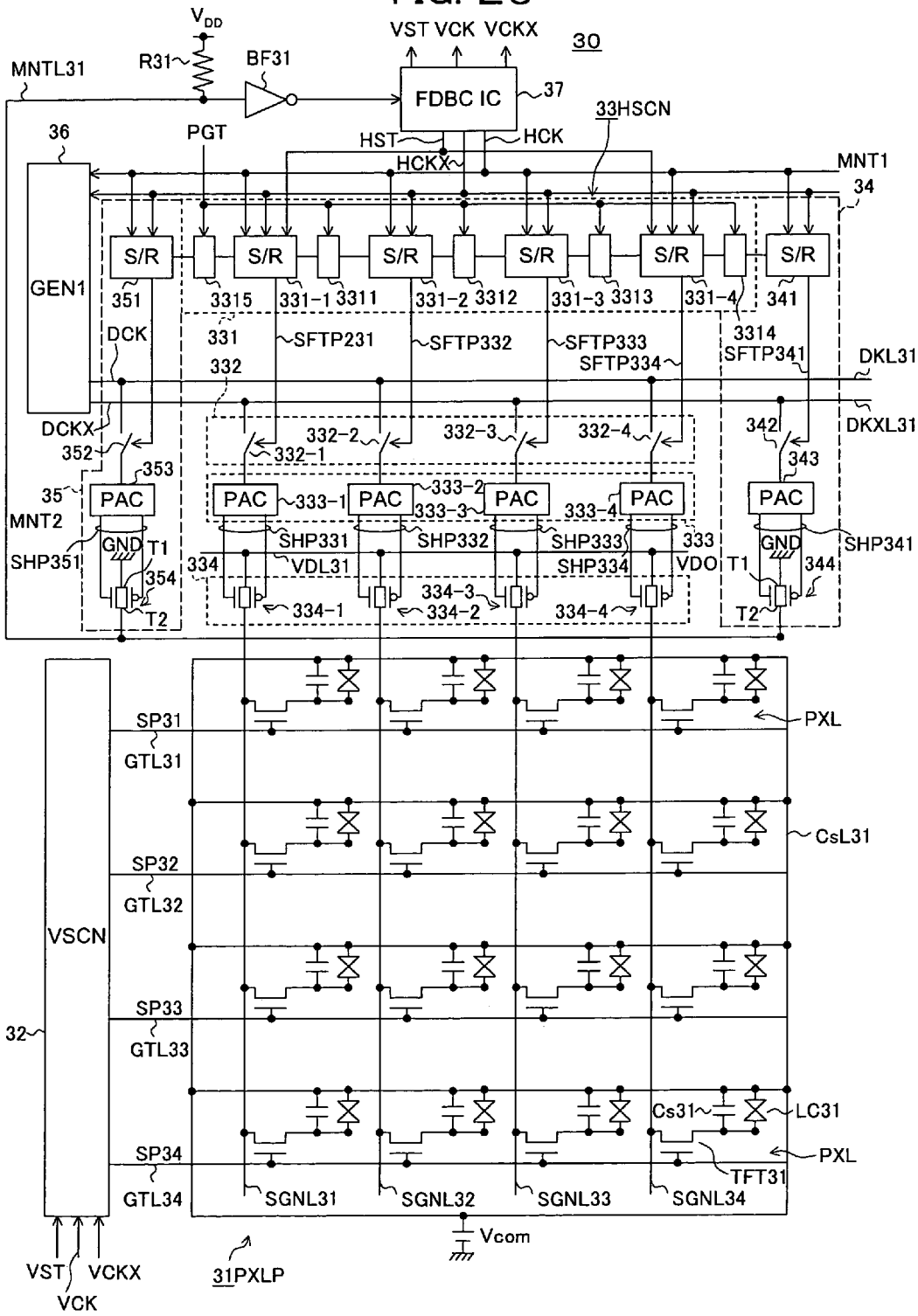
FIG. 26 is a circuit diagram of an example of the configuration of an active matrix type liquid crystal display device of the point sequential drive system according to a third embodiment of the present invention.

FIG. 26 is a circuit diagram of an example of the configuration of an active matrix type liquid crystal display device of the point sequential drive system according to a third embodiment of the present invention using for example liquid crystal cells as the display elements (electrooptic elements) of the pixels.

Figure 27:
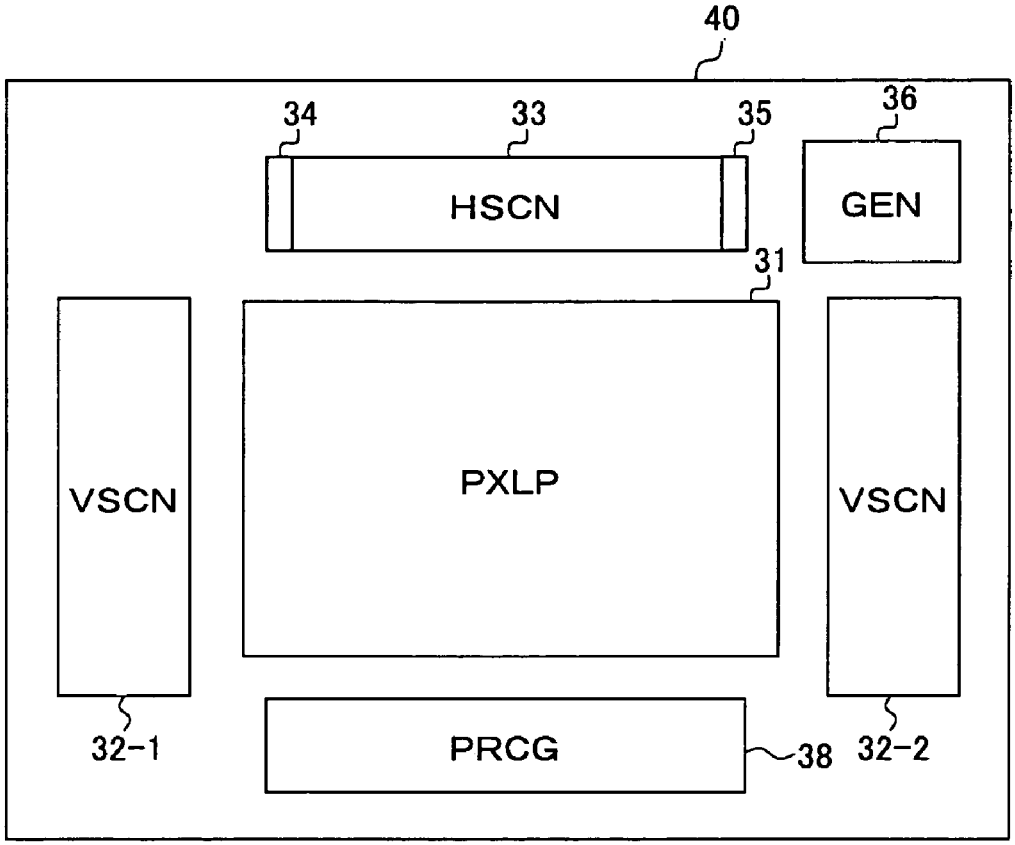
FIG. 27 is a block diagram of an example of the configuration of a display panel of the active matrix type liquid crystal display device of FIG. 26.

This liquid crystal display device 30 has, as shown in FIG. 26, a valid pixel portion (PXLP) 31, a vertical scanner (VSCN) 32, a horizontal scanner (HSCN) 33, a first monitor circuit (MNT1) 34, a second monitor circuit (MNT2) 35, a clock generation circuit (GEN) 36, and a feedback control circuit (FDBCIC) 37 including a timing generator as the principal components. Note that, as shown in FIG. 27, the vertical scanner is sometimes arranged at not only one side portion of the pixel portion 31 (left side portion in the figure), but at both side portions (left side portion and right side portion in the figure) and provided with a precharge circuit (PRCG) 38 of the signal lines. Further, the valid pixel portion (PXLP) 31, the vertical scanner (VSCN) 32 (32-1, 32-2), the horizontal scanner (HSCN) 33, the first monitor circuit 34, the second monitor circuit 35, and the clock generation circuit (GEN) 36 (and the precharge circuit 37) are mounted at the display panel (liquid crystal display panel) 40.

The pixel portion 31 is comprised of a plurality of pixels PXL arrayed in a matrix consisting of n number of rows and m number of columns. Here, for simplification of the figure, a case of a pixel array consisting of 4 rows and 4 columns will be shown as an example. Each of the pixels PXL arranged in the matrix is comprised of a pixel transistor constituted by a thin film transistor (TFT) 31, a liquid crystal cell LC31 with a pixel electrode connected to the drain electrode of this TFT 31, and a storage capacitor Cs 31 with one electrode connected to the drain electrode of the TFT 31. With respect to each of these pixels PXL, signal lines SGNL31 to SGNL34 are laid along the pixel array direction for every column and gate lines GTL31 to GTL34 are laid along the pixel array direction for every row. In each of the pixels PXL, the source electrode (or drain electrode) of the TFT 31 is connected to each of the corresponding signal lines SGNL31 to SGNL34. The gate electrode of the TFT 31 is connected to each of the gate lines GTL31 to GTL34. The counter electrode of the liquid crystal cell LC31 and the other electrode of the storage capacitor Cs31 are commonly connected to a Cs line CsL31 between each adjacent pixels. This Cs line CsL31 is given a predetermined DC current as a common voltage Vcom. In this pixel portion 31, first side ends of the gate lines GTL31 to GTL34 are connected to for example output ends of rows of the vertical scanner 32 arranged at for example the left side in the figure of the pixel portion 31.

The vertical scanner 32 performs processing for scanning pixels in the vertical direction (row direction) for every field period and sequentially selecting the pixels PXL connected to the gate lines GTL31 to GTL34 in units of rows. That is, pixels PXL of columns of the first row are selected when a scanning pulse SP31 is given from the vertical scanner 32 to the gate line GTL31, and pixels PXL of columns of the second row are selected when a scanning pulse SP32 is given to the gate line GTL32. Below, in the same way, scanning pulses SP33 and SP34 are sequentially given to the gate lines GTL33 and GTL34.

For example the upper side in the figure of the pixel portion 31 is provided with the horizontal scanner 33, the first monitor circuit (first dummy scanner) 34, and the second monitor circuit (second dummy scanner) 35.

The horizontal scanner 33 performs processing for sequentially sampling input video signals VDO for every 1H (H is the horizontal scanning period) and writing them at the pixels PXL selected in units of rows by the vertical scanner 32.

The horizontal scanner 33 employs the clock drive method as shown in FIG. 26 and has a shift register 331, a clock sampling switch group 332, a phase adjust circuit (PAC) group 333, and a sampling switch group 334.

The shift register 331 has four shift stages (S/R stages) 331-1 to 331-4 corresponding to the pixel columns (four columns in the present example) of the pixel portion 31 and performs the first shift operation (usual shift operation) or the second shift operation (inverse shift operation) in synchronization with the horizontal clock HCK and the inverse horizontal clock HCKX having inverse phases to each other when the horizontal start pulse HST is given to the first (initial stage) shift stage 331-1 or the fourth (last) shift stage 331-4 by for example the external feedback control circuit 37. Due to this, from the shift stages 331-1 to 331-4 of the shift register 331, shift pulses SFTP331 to SFTP334 having the same pulse width as the periods of the horizontal clocks HCK and HCKX are sequentially output.

Here, the "usual shift operation" means scanning in the direction from left to right in FIG. 26, that is, in a sequence of the first shift stage 331-1 of the initial stage, the second shift stage 331-2, the third shift stage 331-3, the fourth shift stage 331-4, and further the first monitor circuit 34. On the other hand, the "inverse shift operation" means scanning in the direction from right to left in FIG. 26, that is, in a sequence of the fourth shift stage 331-4, the third shift stage 331-3, the second shift stage 331-2, the first shift stage 331-1, and further the second monitor circuit 35.

The usual shift operation and the inverse shift operation are determined according to a shift direction switch signal RGT given from the outside. For example, the shift register 331 of the horizontal scanner 33 performs the usual shift operation when receiving the shift direction switch signal RGT at a high level, while performs the inverse shift operation when receiving it at a low level.

In the shift register 331, switch circuits 3311, 3312, and 3313 receiving the horizontal start pulse HST and switching whether the shift pulses SFTP are to be propagated in the usual direction going from the first shift stage 331-1 toward the fourth shift stage 331-4 and the first monitor circuit 34 or the inverse direction going from the fourth shift stage 331-4 toward the first shift stage 331-1 and the second monitor circuit 35 are inserted among the shift stages. Specifically, the switch circuit 3311 is inserted between the first shift stage 331-1 and the second shift stage 331-2, the switch circuit 3312 is inserted between the second shift stage 331-2 and the third shift stage 331-3, and the switch circuit 3313 is inserted between the third shift stage 331-3 and the fourth shift stage 331-4. Further, in the shift register 331, the fourth shift stage 331-4 is connected with the shift stage 341 mentioned later of the first monitor circuit 34, and the switch circuit 3314 is inserted in the connection route thereof. In the same way, the first shift stage 331-1 is connected with the shift stage 351 mentioned later of the second monitor circuit 35, and the switch circuit 3315 is inserted in the connection route thereof. The switch circuits 3311 to 3315 receive the shift direction switch signal RGT and switch the signal propagation direction to the usual direction or the inverse direction.

Note that it is not always necessary to provide the switch circuit 3314 between the fourth shift stage 331-4 and the shift stage 341 mentioned later of the first monitor circuit 34 and the switch circuit 3315 between the first shift stage 331-1 and the shift stage 351 mentioned later of the second monitor circuit 35.

Figure 28:
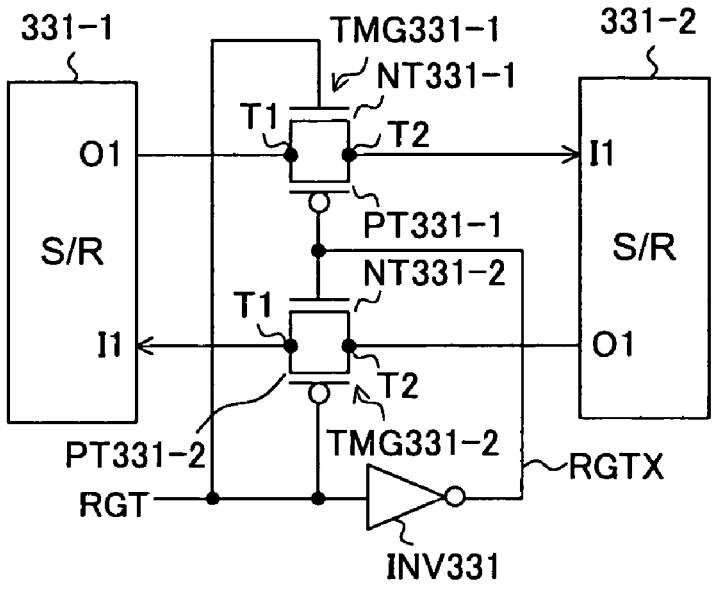
FIG. 28 is a circuit diagram of an example of the configuration of a switch circuit inserted between shift stages of the shift register.

FIG. 28 is a circuit diagram of an example of the configuration of the switch circuit 3311 (to 3315) inserted between the shift stages of the shift register. Note that, in FIG. 28, the switch circuit 3311 inserted between the first shift stage 331-1 and the second shift stage 331-2 is shown as an example, but the other switch circuits 3312 to 3315 have the same configuration.

The switch circuit 3311 has, as shown in FIG. 28, transfer gates TMG331-1 and TMG331-2 and an inverter INV331. The transfer gate TMG331-1 connects the sources and drains of a p-channel MOS (PMOS) transistor PT331-1 and an n-channel MOS (NMOS) transistor NT331-1 to configure a first terminal T1 and a second terminal T2. The gate of the NMOS transistor NT331-1 is connected to the supply line of the switch signal RGT, and the gate of the PMOS transistor PT331-1 is connected to the output terminal of the inverter INV331 for outputting the signal RGTX obtained by inverting the level of the switch signal RGT. Further, the first terminal T1 is connected to the output terminal O1 of the first shift stage (left side shift stage) 331-1, and the second terminal T2 is connected to the input terminal I1 of the second shift stage (right side shift stage) 331-2.

The transfer gate TMG331-2 connects the sources and drains of the PMOS transistor PT331-2 and the NMOS transistor NT331-2 to configure the first terminal T1 and the second terminal T2. The gate of the PMOS transistor PT331-2 is connected to the supply line of the switch signal RGT, and the gate of the NMOS transistor NT331-2 is connected to the output terminal of the inverter INV331 for outputting a signal RGTX obtained by inverting the level of the switch signal RGT. Further, the first terminal T1 is connected to the input terminal I1 of the first shift stage (left side shift stage) 331-1, and the second terminal T2 is connected to the output terminal O1 of the second shift stage (right side shift stage) 331-2.

In the switch circuit 3311 having such a configuration, when for example the switch signal RGT is supplied at the high level, the output signal RGTX of the inverter INV331 becomes the low level, and the PMOS transistor PT331-1 and the NMOS transistor NT331-1 of the transfer gate TMG331-1 become conductive. On the other hand, the PMOS transistor PT331-2 and the NMOS transistor NT331-2 of the transfer gate TMG331-2 are held in a nonconductive state. Accordingly, the signal (horizontal start pulse HST) output from the output terminal O1 of the first shift stage 331-1 is propagated to the input terminal I1 of the second shift stage 331-2 through the transfer gate TMG331-1. That is, the usual shift operation is carried out.

As opposed to this, when the switch signal RGT is supplied at the low level, the output signal RGTX of the inverter INV331 becomes the high level, and the PMOS transistor PT331-1 and the NMOS transistor NT331-1 of the transfer gate TMG331-1 are held in the nonconductive state. On the other hand, the PMOS transistor PT331-2 and the NMOS transistor NT331-2 of the transfer gate TMG331-2 become conductive. Accordingly, the signal (horizontal start pulse HST) output from the output terminal O1 of the second shift stage 331-2 is propagated to the input terminal I1 of the first shift stage 331-1 through the transfer gate TMG331-2. That is, the inverse shift operation is carried out.

Note that, in the configuration of FIG. 28, the configuration was made so that the inverter INV331 was provided in each switch circuit, but it is also possible to provide the inverter at the input stage of the switch signal RGT and supply the inverted output signal RGTX thereof to each switch circuit together with the switch signal RGT.

The clock sampling switch group 332 has four switches 332-1 to 332-4 corresponding to the pixel columns of the pixel portion 31. First side ends of these switches 332-1 to 332-4 are alternately connected to clock lines DKL 3 and DKXL 31 for sending the second clock DCK and the second inverse clock DCKX from the clock generation circuit 36. That is, first side ends of the switches 332-1 and 332-3 corresponding to the odd number columns of the pixel columns of the pixel portion 31 are connected to a clock line DKXL 31, and first side ends of the switches 332-2 and 332-4 corresponding to the even number columns of the pixel columns of the pixel portion 31 are connected to a clock line DKL 31. The switches 332-1 to 332-4 of the clock sampling switch group 332 are given shift pulses SFTP331 to SFTP334 sequentially output from the shift stages 331-1 to 331-4. When the shift pulses SFTP331 to SFTP334 are given from the shift stages 331-1 to 331-4 of the shift register 331, the switches 332-1 to 332-4 of the clock sampling switch group 332 sequentially enter the ON state in response to these shift pulses SFTP331 to SFTP334 and thereby alternately sample the clocks DCKX and DCK having inverse phases to each other.

The phase adjust circuit group 333 has four phase adjust circuits 333-1 to 333-4 corresponding to the pixel columns of the pixel portion 31, adjusts the phases of the clocks DCKX and DCK sampled at the switches 332-1 to 332-4 of the clock sampling switch group 332 at the phase adjust circuits 333-1 to 333-4, and then supplies them to the corresponding sampling switches of the sampling switch group 334.

The sampling switch group 334 has four sampling switches 334-1 to 334-4 corresponding to the pixel columns of the pixel portion 31. First side ends of these sampling switches 334-1 to 334-4 are connected to the video line VDL31 for receiving as input the video signals VDO. The sampling switches 334-1 to 334-4 are given the clocks DCKX and DCK sampled by the switches 332-1 to 332-4 of the clock sampling switch group 332 and adjusted in phase at the phase adjust circuit group 333 as sample-and-hold pulses SHP331 to SHP334. The sampling switches 334-1 to 334-4 of the sampling switch group 334 respond to the sample-and-hold pulses SHP331 to SHP334 and sequentially enter the ON state when the sample-and-hold pulses SHP331 to SHP334 are given and thereby sequentially sample the video signals VDO input through the video line VDL31 and supply them to the signal lines SGNL31 to SGNL34 of the pixel portion 31.

The first monitor circuit 34 is arranged corresponding to the fourth pixel column of the pixel portion 31 of the horizontal scanner 33, that is, adjacent to the right side in FIG. 26 of the fourth stage scanner portion including the fourth shift stage 331-4 for receiving as input the horizontal start pulse HST at first and starting the second shift operation (inverse shift operation), the sampling switch 332-4, the phase adjust circuit 333-4, and the sampling switch 334-4. The first monitor circuit 34 is configured in the same way as the configuration of each stage scanner portion of the horizontal scanner 33 for making the delays of the output pulses of the stages of the horizontal scanner 33 uniform.

Specifically, the first monitor circuit 34 has a shift stage (S/R stage) 341 to which the horizontal start pulse HST is not input, which is connected to the fourth shift stage 331-4 of the shift register 331 of the horizontal scanner 33, receives, at the time of the usual shift operation, the shift pulse SFTP334 shifted in from this fourth shift stage 331-4, and outputs the shift pulse SFTP341 in synchronization with the horizontal clocks HCK and HCKX, a switch (third switch) 342 for sampling the clock DCKX by the shift pulse SFTP341 by the shift stage 341, a phase adjust circuit 343 for generating the sample-and-hold pulse SHP341 comprised of two signals taking complementary levels by adjusting the phase of the clock DCKX sampled at the switch 342, and a sampling switch (fourth switch) 344 in which the conduction between the first terminal T1 and the second terminal T2 is controlled by the sample-and-hold pulse SHP341 from the phase adjust circuit 343.

The sampling switch 344 of the first monitor circuit 34 is configured by an analog switch obtained by connecting the source and the drain of the PMOS transistor and the NMOS transistor, has a first terminal T1 which is grounded, and has the other terminal connected to one end of the monitor line MNTL31. The monitor line MNTL31 is formed by an aluminum (Al) or other low resistance interconnect. The monitor line MNTL31 is pulled up by a pull-up resistor R31 on the outside of the liquid crystal display panel. The other end side is connected to the input terminal of the feedback control circuit 37 via a buffer BF31.

The second monitor circuit 35 is arranged corresponding to the first pixel column (initial stage pixel column) of the pixel portion 31 of the horizontal scanner 33, that is, adjacent to the left side in FIG. 26 of the fourth stage scanner portion including the first shift stage 331-1 for starting the first scanning operation (usual scanning operation) when the horizontal start pulse HST is input at first, the sampling switch 332-1, the phase adjust circuit 333-1, and the sampling switch 334-1. The second monitor circuit 35 is configured in the same way as the configuration of each stage scanner portion of the horizontal scanner 33 in order to make the delays of the output pulses of the stages of the horizontal scanner 33 uniform.

Specifically, the second monitor circuit 35 has a shift stage (S/R stage) 351 to which the horizontal start pulse HST is not input, which is connected to the first shift stage 331-1 of the shift register 331 of the horizontal scanner 33, receives, at the time of the inverse shift operation, the shift pulse SFTP331 shifted in from this first shift stage 331-1, and outputs the shift pulse SFTP351 in synchronization with the horizontal clocks HCK and HCKX, a switch (fifth switch) 352 for sampling the clock DCK by the shift pulse SFTP351 from the shift stage 351, a phase adjust circuit 353 for generating the sample-and-hold pulse SHP351 comprised of two signals taking complementary levels by adjusting the phase of the clock DCK sampled at the switch 352, and a sampling switch (sixth switch) 354 in which the conduction between the first terminal T1 and the second terminal T2 is controlled by the sample-and-hold pulse SHP351 from the phase adjust circuit 353.

The sampling switch 354 of the second monitor circuit 35 is configured by an analog switch obtained by connecting the source and the drain of the PMOS transistor and the NMOS transistor, has the first terminal T1 grounded, and has the other end connected to one end of the monitor line MNTL31 shared by the first monitor circuit 34.

As described above, in the present embodiment, in the first monitor circuit 34 and the second monitor circuit 35, the clocks sampled by the sampling switches 342 and 352 are made different clocks. Here, the clock DCKX is sampled at the first monitor circuit 34, and the clock DCK is sampled at the second monitor circuit 35.

Further, the first monitor circuit 34 and the second monitor circuit 35 do not receive as input the horizontal start pulse HST, therefore, the external output pulse is obtained from only the monitor circuit of the scanning end. That is, the output pulse is obtained from the first monitor circuit 34 on the right end in the usual scanning operation (the scanning in the direction from the left to the right), and the output pulse is obtained from the second monitor circuit 35 on the left end in the inverse scanning operation (scanning in the direction from the right to the left).

The clock generation circuit 36 generates the second clocks DCK and DCKX having inverse phases to each other, having the same period as the horizontal clocks (first clocks) HCK and HCKX generated at the feedback control circuit 37 (T1=T2), and having a small duty ratio and supplies them through the clock lines DKL31 and DKXL31 to the first monitor circuit 34, the horizontal scanner 33, and the second monitor circuit 35. Here, the "duty ratio" means the ratio between the pulse width t and the pulse repetition period T in the pulse waveform. For example, as shown in FIGS. 3A to 3D, the duty ratio (t1/T1) of the horizontal clocks HCK and HCKX is 50%, and the duty ratio (t2/T2) of the clocks DCK and DCKX is set smaller than this, that is, the pulse width t2 of the clocks DCK and DCKX is set narrower than the pulse width t1 of the horizontal clocks HCK and HCKX.

The feedback control circuit 37 generates a vertical start pulse VST for instructing the start of the vertical scan, vertical clocks VCK and VCKX having inverse phases to each other and serving as reference of the vertical scan, the horizontal start pulse HST for instructing the start of the horizontal scan, and horizontal clocks HCK and HCKX having inverse phases to each other and serving as reference of the horizontal scan, supplies the vertical start pulse VST and the vertical clocks VCK and, VCKX to the vertical scanner 32, and supplies the horizontal clocks HCK and HCKX to the horizontal scanner 33, the first monitor circuit 34, the second monitor circuit 35, and the clock generation circuit 36. Further, the feedback control circuit 37 generates the horizontal start pulse HST, supplies the same to only the first shift stage 331-1 and the fourth shift stage 331-4 of the shift register 331 of the horizontal scanner 33, and does not supply the same to the shift stage 341 of the first monitor circuit 34 and the shift stage 351 of the second monitor circuit 35. Further, the feedback control circuit 37 performs control for monitoring the change of the phase from the initial state from the timing when the sampling switch 344 of the first monitor circuit 34 at the time of the usual scanning operation becomes conductive and the monitor line MNTL31 shifts to the ground level or the change of the phase from the initial state from the timing when the sampling switch 354 of the second monitor circuit 35 at the time of the inverse scanning operation becomes conductive and the monitor line MNTL31 shifts to the ground level, feeding back the amount of change of the phase to the horizontal clock HCK and the inverse horizontal clock HCKX of the panel input, and preventing the generation of a ghost due to the drift of the sample-and-hold pulse SHP from the initial state thereof.

Next, an explanation will be given of the usual scanning operation and the inverse scanning operation by the above configuration in relation to the timing charts of FIGS. 29A to 29M and FIGS. 30A to 30M.

First, the usual scanning operation will be explained in relation to the timing charts of FIGS. 29A to 29M.

In this case, the scanning direction switch signal RGT is set at the high level and supplied to the shift register 331 of the horizontal scanner 33. Due to this, routes through which the switch circuits 3311 to 3314 inserted among the shift stages propagate signals from left to right are formed. That is, signal propagation routes through which the horizontal start pulse HST is sequentially shifted from the first shift stage 331-1 to the second shift stage 331-2, from the second shift stage 331-2 to the third shift stage 331-3, from the third shift stage 331-3 to the fourth shift stage 331-4, and further to the shift stage 341 of the first monitor circuit 34 are formed.

Figure 29:
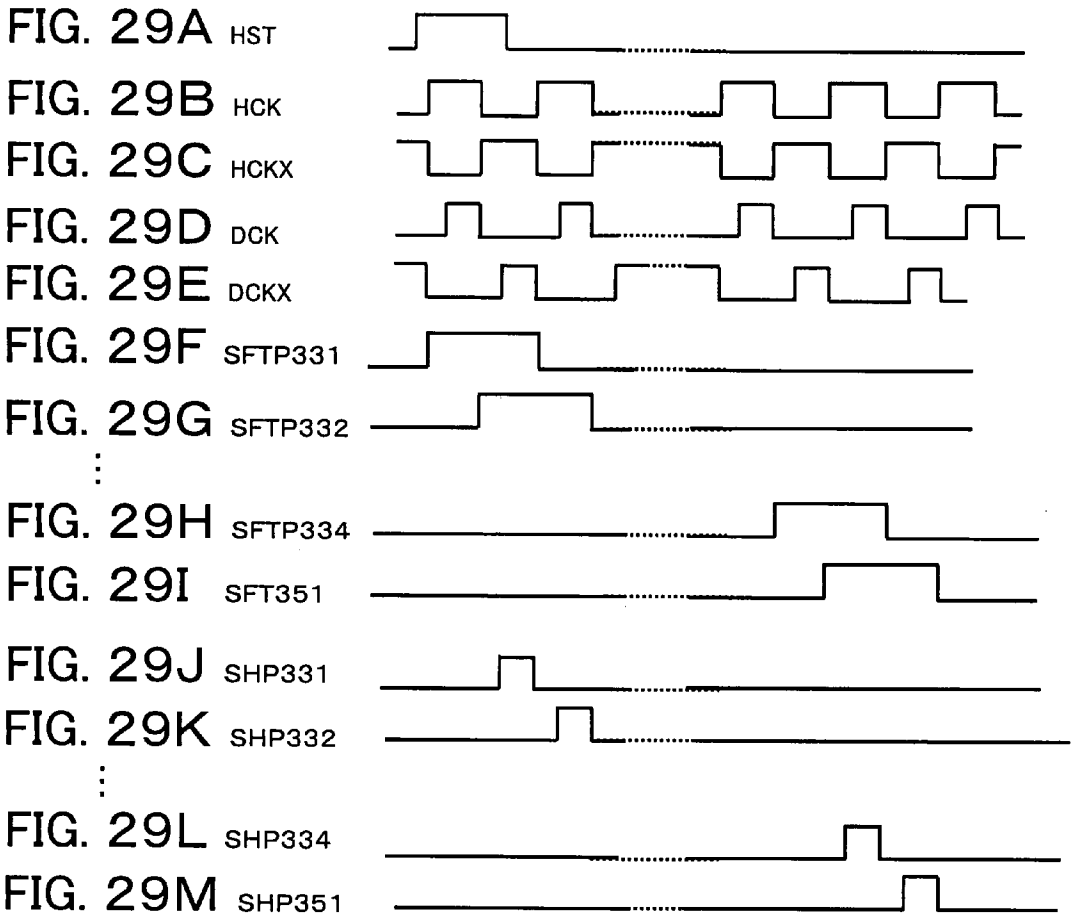
FIGS. 29A to 29M are timing charts for explaining the usual scanning operation of the circuit of FIG. 26.

In this state, the feedback control circuit 37 generates the horizontal start pulse HST as shown in FIG. 29A and supplies the same to the first shift stage 331-1 of the shift register 331 of the horizontal scanner 33. This horizontal start pulse HST is not supplied to the shift stage 341 of the first monitor circuit 34. Further, the feedback control circuit 37 generates the horizontal clocks HCK and HCKX having inverse phases to each other as shown in FIGS. 29B and 29C and supplies them to the first shift stage 331-1 to the fourth shift stage 331-4 of the shift register 331 in the horizontal scanner 33, the shift stage 341 of the first monitor circuit 34, and the clock generation circuit 36. The clock generation circuit 36 generates the clocks DCK and DCKX having the same period (T1=T2) with respect to the horizontal clocks HCK and HCKX generated at the feedback control circuit 37, having a small duty ratio, and having inverse phases to each other as shown in FIGS. 29D and 29E and supplies them through the clock lines DKL31 and DKXL31 to the first monitor circuit 34 and the horizontal scanner 33 (and the second monitor circuit 35).

The feedback control circuit 37 generates the vertical start pulse VST for instructing the start of the vertical scan, and vertical clocks VCK and VCKX having inverse phases to each other and serving as reference of the vertical scan, and supplies them to the vertical scanner 32.

Further, at the shift register 331 of the horizontal scanner 33, at the first shift stage 331-1 to which the horizontal start pulse HST is supplied by the external feedback control circuit 37, in synchronization with the horizontal clocks HCK and HCKX having inverse phases, as shown in FIG. 29F, the shift pulse SFTP331 having the same pulse width as the periods of the horizontal clocks HCK and HCKX is output to the sampling switch 332-1. Further, the shift pulse SFTP331 is shifted to the second shift stage 331-2 from the first shift stage 331-1. The sampling switch 332-1 corresponding to the first shift stage 331-1 enters the ON state in response to the shift pulse SFTP331, samples the clock DCKX output to the clock line DKXL31 as shown in FIGS. 29E and 29J, adjusts this in phase at the phase adjust circuit 333-1, and then supplies the same as the sample-and-hold pulse SHP331 to the sampling switch 334-1. Due to this, the sampling switch 334-1 enters the ON state in response to the sample-and-hold pulse SHP331, samples the video signals VDO input through the video line VDL31, and supplies the same to the signal line SGNL31 of the pixel portion 31.

Next, in the second shift stage 331-2 into which the shift pulse SFTP331 is shifted from the first shift stage 331-1, in synchronization with the horizontal clocks HCK and HCKX having inverse phases, as shown in FIG. 29G, the shift pulse SFTP332 having the same pulse width as the periods of the horizontal clocks HCK and HCKX is output to the sampling switch 332-2. Further, the shift pulse SFTP332 is shifted to the third shift stage 331-3 from the second shift stage 331-2. The sampling-switch 332-2 corresponding to the second shift stage 331-2 enters the ON state in response to the shift pulse SFTP332, samples the clock DCK output to the clock line DKL31 as shown in FIGS. 29D and 29K, adjusts this in phase at the phase adjust circuit 333-2, and then supplies the same as the sample-and-hold pulse SHP332 to the sampling switch 334-2. Due to this, the sampling switch 334-2 enters the ON state in response to the sample-and-hold pulse SHP332, samples the video signals VDO input through the video line VDL31, and supplies the same to the signal line SGNL32 of the pixel portion 31.

Next, at the third shift stage 331-3 into which the shift pulse SFTP332 is shifted from the second shift stage 331-2, in synchronization with the horizontal clocks HCK and HCKX having inverse phases, the shift pulse SFTP333 having the same pulse width as the periods of the horizontal clocks HCK and HCKX is output to the sampling switch 332-3. Further, the shift pulse SFTP333 is shifted to the fourth shift stage 331-4 from the third shift stage 331-3. The sampling switch 332-3 corresponding to the third shift stage 331-3 enters the ON state in response to the shift pulse SFTP333, samples the clock DCKX output to the clock line DKXL31, adjusts this in phase at the phase adjust circuit 333-3, and then supplies the same as the sample-and-hold pulse SHP333 to the sampling switch 334-3. Due to this, the sampling switch 334-3 enters the ON state in response to the sample-and-hold pulse SHP333, samples the video signals VDO input through the video line VDL31, and supplies the same to the signal line SGNL33 of the pixel portion 31.

Next, at the fourth shift stage 331-4 into which the shift pulse SFTP233 is shifted from the third shift stage 331-3, in synchronization with the horizontal clocks HCK and HCKX having inverse phases, the shift pulse SFTP334 having the same pulse width as the periods of the horizontal clocks HCK and HCKX is output to the sampling switch 332-4 as shown in FIG. 29H. Further, the shift pulse SFTP334 is shifted to the shift stage 341 of the first monitor circuit 34 from the fourth shift stage 331-4. The sampling switch 332-4 corresponding to the fourth shift stage 331-4 enters the ON state in response to the shift pulse SFTP334, samples the clock DCK output to the clock line DKL31 as shown in FIGS. 29D and 29L, adjusts this in phase at the phase adjust circuit 333-4, and then supplies the same as the sample-and-hold pulse SHP334 to the sampling switch 334-4. Due to this, the sampling switch-334-4 enters the ON state in response to the sample-and-hold pulse SHP334, samples the video signals VDO input through the video line VDL31, and supplies the same to the signal line SGNL34 of the pixel portion 31.

Next, at the shift stage 341 of the first monitor circuit 34 into which the shift pulse SFTP334 is shifted from the fourth shift stage 331-4, in synchronization with the horizontal clocks HCK and HCKX having inverse phases, as shown in FIG. 29I, the shift pulse SFTP341 having the same pulse width as the periods of the horizontal clocks HCK and HCKX is output to the sampling switch 342. The sampling switch 342 corresponding to the shift stage 341 enters the ON state in response to the shift pulse SFTP341, and as shown in FIGS. 29E and 29M, the clock DCKX output to the clock line DKXL31 is sampled, is adjusted in phase at the phase adjust circuit 343, and then is supplied as the sample-and-hold pulse SHP341 to the sampling switch 344. Due to this, the sampling switch 344 enters the ON state in response to the sample-and-hold pulse SHP341, the monitor line MNTL31 pulled up by the pull-up resistor R31 on the outside of the liquid crystal display panel is pulled to the ground level, and the level change information is input via the buffer BF31 to the feedback control circuit 37.

At the feedback control circuit 37, the change of the phase from the initial start is monitored from the timing when the sampling switch 344 of the first monitor circuit 34 at the time of the usual scanning operation becomes conductive and the monitor line MNTL31 shifts to the ground level. At the feedback control circuit 37, the amount of change of the monitored phase is fed back to the horizontal clocks HCK, HCKX, etc. of the panel input and the suitable timing is set. Due to this, the generation of a ghost due to the drift of the sample-and-hold pulse SHP from the initial state thereof is prevented.

As described above, at the time of the usual scanning operation, at the horizontal scanner 33, when the shift pulses SFTP331 to SFTP334 are given from the shift stages 331-1 to 331-4 of the shift register 331, the switches 332-1 to 332-4 of the clock sampling switch group 332 sequentially enter the ON state in response to these shift pulses SFTP331 to SFTP334 and thereby alternately sample the clocks DCKX and DCK having inverse phases to each other, and the clocks DCKX and DCK is adjusted in phase at the phase adjust circuit group 333 are given as the sample-and-hold pulses SHP331 to SHP334. Further, at the sampling switches 334-1 to 334-4 of the sampling switch group 334, when the sample-and-hold pulses SHP331 to SHP334 are given, they sequentially enter the ON state in response to these sample-and-hold pulses SHP331 to SHP334, and the video signals VDO input through the video line VDL31 are sequentially sampled and supplied to the signal lines SGNL31 to SGNL34 of the pixel portion 31. Further, as the continuous operation at the first monitor circuit 34 located in the last stage, the clock DCKX different from that of the fourth shift stage is sampled, is adjusted in phase at the phase adjust circuit 353, and then is supplied as the sample-and-hold pulse SHP341 to the sampling switch 344, and the sampling switch 344 enters the ON state. That is, the sample-and-hold pulse SHP334 of the fourth shift stage of the horizontal scanner 33 and the sample-and-hold pulse SHP341 of the first monitor circuit 34 are generated at substantially the same timing as the relationships among the other sample-and-hold pulses SHP331 to SHP333, and the image is displayed without a problem.

Next, the inverse scanning operation will be explained in relation to the timing charts of FIGS. 30A to 30M.

In this case, the scanning direction switch signal RGT is set at the low level and supplied to the shift register 331 of the horizontal scanner 33. Due to this, routes through which the switch circuits 3311 to 3313 and 3315 inserted among shift stages propagate signals from the right to the left are formed. That is, signal propagation routes through which the horizontal start pulse HST is sequentially shifted from the fourth shift stage 331-4 to the third shift stage 331-3, from the third shift stage 331-3 to the second shift stage 331-2, from the second shift stage 331-2 to the first shift stage 331-1, and further to the shift stage 351 of the second monitor circuit 35 are formed.

In this state, the feedback control circuit 37 generates the horizontal start pulse HST as shown in FIG. 30A and supplies the same to the fourth shift stage 331-4 of the shift register 331 in the horizontal scanner 33. This horizontal start pulse HST is not supplied to the shift stage 351 of the second monitor circuit 35. Further, the feedback control circuit 37 generates the horizontal clocks HCK and HCKX having inverse phases to each other as shown in FIGS. 30B and 30C and supplies them to the first shift stage 331-1 to the fourth shift stage 331-4 of the shift register 331 in the horizontal scanner 33, the shift stage 351 of the second monitor circuit 35, and the clock generation circuit 36. The clock generation circuit 36 generates clocks DCK and DCKX having the same period (T1=T2) with respect to the horizontal clocks. HCK and HCKX generated at the feedback control circuit 37, having a small duty ratio, and having inverse phases to each other as shown in FIGS. 30D and 30E and supplies the same through the clock lines DKL31 and DKXL31 to (the first monitor circuit 34,) the horizontal scanner 33, and the second monitor circuit 35.

The feedback control circuit 37 generates the vertical start pulse VST for instructing the start of the vertical scan, and the vertical clocks VCK and VCKX having inverse phases to each other and serving as reference of the vertical scan, and supplies them to the vertical scanner 32.

Figure 30:
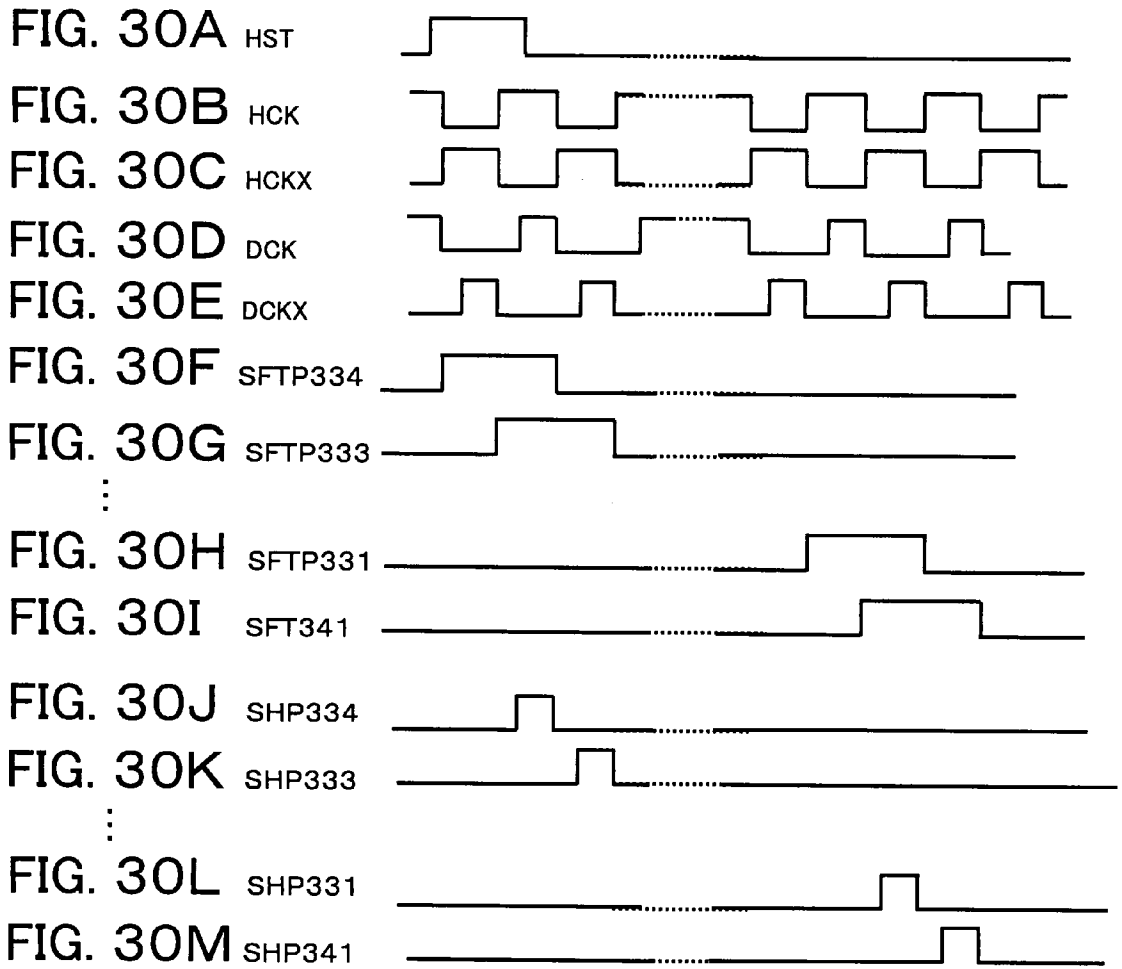
FIGS. 30A to 30M are timing charts for explaining the inverse scanning operation of the circuit of FIG. 26.

Further, at the shift register 331 of the horizontal scanner 33, at the fourth shift stage 331-4 to which the horizontal start pulse HST is supplied by the external feedback control circuit 37, in synchronization with the horizontal clocks HCK and HCKX having inverse phases, as shown in FIG. 30F, the shift pulse SFTP334 having the same pulse width as the periods of the horizontal clocks HCK and HCKX is output to the sampling switch 332-4. Further, the shift pulse SFTP334 is shifted to the third shift stage 331-3 from the fourth shift stage 331-4. The sampling switch 332-4 corresponding to the fourth shift stage 331-4 enters the ON state in response to the shift pulse SFTP334, and as shown in FIGS. 30 D and 30J, the clock DCK output to the clock line DKL31 is sampled, is adjusted in phase at the phase adjust circuit 333-4, and then is supplied as the sample-and-hold pulse SHP334 to the sampling switch 334-4. Due to this, the sampling switch 334-4 enters the ON state in response to the sample-and-hold pulse SHP334, and the video signals VDO input through the video line VDL31 are sampled and supplied to the signal line SGNL34 of the pixel portion 31.

Next, at the third shift stage 331-3 into which the shift pulse SFTP234 is shifted from the fourth shift stage 331-4, in synchronization with the horizontal clocks HCK and HCKX having inverse phases, as shown in FIG. 30H, the shift pulse SFTP333 having the same pulse width as the periods of the horizontal clocks HCK and HCKX is output to the sampling switch 332-3. Further, the shift pulse SFTP333 is shifted to the second shift stage 331-2 from the third shift stage 331-3. The sampling switch 332-3 corresponding to the third shift stage 331-3 enters the ON state in response to the shift pulse SFTP333, and as shown in FIGS. 30E and 30K, the clock DCKX output to the clock line DKLX31 is sampled, is adjusted in phase at the phase adjust circuit 333-3, and then is supplied as the sample-and-hold pulse SHP333 to the sampling switch 334-3. Due to this, the sampling switch 334-3 enters the ON state in response to the sample-and-hold pulse SHP333, and the video signals VDO input through the video line VDL31 are sampled and supplied to the signal line SGNL33 of the pixel portion 31.

Next, at the second shift stage 331-2 into which the shift pulse SFTP333 is shifted from the third shift stage 331-3, in synchronization with the horizontal clocks HCK and HCKX having inverse phases, the shift pulse SFTP332 having the same pulse width as the periods of the horizontal clocks HCK and HCKX is output to the sampling switch 332-2. Further, the shift pulse SFTP332 is shifted to the first shift stage 331-1 from the second shift stage 331-2. The sampling switch 332-2 corresponding to the second shift stage 331-2 enters the ON state in response to the shift pulse SFTP332, and the clock DCK output to the clock line DKL31 is sampled, is adjusted in phase at the phase adjust circuit 333-2, and then is supplied as the sample-and-hold pulse SHP332 to the sampling switch 334-2. Due to this, the sampling switch 334-2 enters the ON state in response to the sample-and-hold pulse SHP332, and the video signals VDO input through the video line VDL31 are sampled and supplied to the signal line SGNL32 of the pixel portion 31.

Next, at the first shift stage 331-1 into which the shift pulse SFTP332 is shifted from the second shift stage 331-2, in synchronization with the horizontal clocks HCK and HCKX having inverse phases, as shown in FIG. 30H, the shift pulse SFTP331 having the same pulse width as the periods of the horizontal clocks HCK and HCKX is output to the sampling switch 332-1. Further, the shift pulse SFTP331 is shifted to the shift stage 351 of the second monitor circuit 35 from the first shift stage 331-1. The sampling switch 332-1 corresponding to the first shift stage 331-1 enters the ON state in response to the shift pulse SFTP331, and, as shown in FIGS. 30E and 30L, the clock DCKX output to the clock line DKXL31 is sampled, is adjusted in phase at the phase adjust circuit 333-1, and then is supplied as the sample-and-hold pulse SHP331 to the sampling switch 334-1. Due to this, the sampling switch 334-1 enters the ON state in response to the sample-and-hold pulse SHP331, and the video signals VDO input through the video line VDL31 are sampled and supplied to the signal line SGNL31 of the pixel portion 31.

Next, at the shift stage 351 of the second monitor circuit 35 into which the shift pulse SFTP331 is shifted from the first shift stage 331-1, in synchronization with the horizontal clocks HCK and HCKX having inverse phases, as shown in FIG. 30I, the shift pulse SFTP351 having the same pulse width as the periods of the horizontal clocks HCK and HCKX is output to the sampling switch 352. The sampling switch 352 corresponding to the shift stage 351 enters the ON state in response to the shift pulse SFTP351, and as shown in FIGS. 30D and 30M, the clock DCK output to the clock line DKL31 is sampled, is adjusted in phase at the phase adjust circuit 353, and then is supplied as the sample-and-hold pulse SHP351 to the sampling switch 354. Due to this, the sampling switch 354 enters the ON state in response to the sample-and-hold pulse SHP351, the monitor line MNTL31 pulled up by the pull-up resistor R31 on the outside of the liquid crystal display panel is pulled to the ground level, and the level change information is input via the buffer BF31 to the feedback control circuit 37.

The feedback control circuit 37 monitors the change of the phase from the initial state from the timing when the sampling switch 354 of the second monitor circuit 35 at the time of the inverse scanning operation becomes conductive and the monitor line MNTL31 shifts to the ground level. At the feedback control circuit 37, the amount of change of the monitored phase is fed back to the clocks HCK, HCKX, etc. of the panel input and the suitable timing is set. Due to this, the generation of a ghost due to the drift of the sample-and-hold pulse SHP from the initial state thereof is prevented.

As described above, at the time of the inverse scanning operation, in the horizontal scanner 33, at switches 332-4 to 332-1 of the clock sampling switch group 332, when the shift pulses SFTP334 to SFTP331 are given from the shift stage 331-4 to 331-1 of the shift register 331, these switches sequentially enter the ON state in response to these shift pulses SFTP334 to SFTP331 and thereby alternately sample the clocks DCK and DCKX having inverse phases to each other, and the clocks DCK and DCKX adjusted in phase at the phase adjust circuit group 333 are given as the sample-and-hold pulses SHP334 to SHP331. Further, at the sampling switches 334-4 to 334-1 of the sampling switch group 334, when the sample-and-hold pulses SHP334 to SHP331 are given, these switches sequentially enter the ON state in response to these sample-and-hold pulses SHP334 to SHP331, and the video signals VDO input through the video line VDL31 are sequentially sampled and supplied to the signal lines SGNL34 to SGNL31 of the pixel portion 31. Further, the clock DCK different from the first shift stage is sampled as the continuous operation at the second monitor circuit 35 located in the last stage, is adjusted in phase at the phase adjust circuit 353, and then is supplied as the sample-and-hold pulse SHP351 to the sampling switch 344, and the sampling switch 354 enters the ON state. That is, the sample-and-hold pulse SHP331 of the first shift stage of the horizontal scanner 33 and the sample-and-hold pulse SHP351 of the second monitor circuit 35 are generated at substantially the same timing as the relationships of the other sample-and-hold pulses SHP334 to SHP332, and the image is displayed without a problem. That is, even if the phase of the clock changes at the time of the left/right inversion of the scanning operation, pulses having uniform phases of output can be obtained.

As explained above, according to the third embodiment, the first monitor circuit 34 and the second monitor circuit 35 are arranged close at the two side portions of the horizontal scanner 33. At the time of the first scanning operation (usual scanning operation), the horizontal start pulse HST is supplied to the shift stage 331-1 of the initial stage of the horizontal scanner, the scanning operation from the initial stage to the last stage is carried out, and, when the signal from the last shift stage 331-4 of the horizontal scanner is shifted in, the shift pulse SFTP341 is output in synchronization with the horizontal clock signal HCK and the inverse clock signal HCKX in the first monitor circuit 34, the switch 342 samples the signal DCKX different from the signal DCK sampled by the last shift stage 331-4 between the clock signal DCK and the inverted clock signal DCKX in response to the shift pulse and outputs the same as the sample-and-hold pulse SHP341, and the sampling switch 344 sets the potential of the pulled up monitor line MNTL31 to the ground-potential in response to the sample-and-hold pulse. At the time of the second scanning operation (inverse scanning operation), the horizontal start pulse HST is supplied to the shift stage 331-4 of the last stage of the horizontal scanner and, when the scanning operation from the last stage to the initial stage is carried out, the signal by the initial stage shift stage 331-1 of the horizontal scanner is shifted in, the shift pulse SFTP351 is output in synchronization with the horizontal clock signal HCK and the inverse clock signal HCKX at the second monitor circuit 35, the signal DCK different from the signal DCKX sampled by the initial stage shift stage 331-1 between the clock signal DCK and the inverse clock signal DCKX is sampled at the switch 352 in response to the shift pulse and output as the sample-and-hold pulse SHP351, and the sampling switch 354 sets the potential of the pulled up monitor line MNTL31 to the ground potential in response to the sample-and-hold pulse. Therefore, the following effects can be obtained. That is, even in a horizontal scanner (even number of shift stages) in which the phase of the clock is inverted in scanning direction inversion, monitoring is possible with a high precision and a high precision image display can be realized without the image ending up shifting by half no matter which the scanning direction of operation without any change of the phase of the output potential change.

Further, at the horizontal scanner 33, the shift pulses SFTP331 to SFTP334 sequentially output from the shift register 331 are not used as the sample-and-hold pulses, but the clocks DCKX and DCK having inverse phases to each other are alternately sampled in synchronization with the shift pulses SFTP331 to SFTP334, and these clocks DCKX and DCK are used as the sample-and-hold pulses SHP331 to SHP334 via the phase adjust circuit. Due to this, fluctuation of the sample-and-hold pulses SHP331 to SHP334 can be suppressed. As a result, a ghost due to the fluctuation of the sample-and-hold pulses SHP331 to SHP334 can be eliminated.

In addition, at the horizontal scanner 33, the horizontal clocks HCKX and HCK serving as reference the shift operation of the shift register 331 are not sampled and used as the sample-and-hold pulses, but the clocks DCKX and DCK having the same period as the horizontal clocks HCKX and HCK and having a small duty ratio are separately generated, and these clocks DCKX and DCK are sampled and used as the sample-and-hold pulses SHP331 to SHP334. Therefore, at horizontal driving, completely non-overlapping sampling between the sampling pulses can be realized, therefore the generation of vertical stripes due to the overlapping sampling can be suppressed.

Note that, in the present embodiment, an explanation was given of the case where the present invention was applied to a liquid crystal display device mounting an analog interface driving circuit for receiving as input analog video signals, sampling them, and driving the pixels by the point sequence, but the present invention can be similarly applied to also a liquid crystal display device mounting a digital interface driving circuit for receiving as input digital video signals, latching them and converting them to the analog video signals, sampling these analog video signals, and driving the pixels by the point sequence. Further, in the present embodiment, the explanation was given by taking as an example the case where the present invention was applied to an active matrix type liquid crystal display device using liquid crystal cells as display elements (electro-optic elements) of the pixels, but the application is not limited to a liquid crystal display device. The present invention can be applied to all active matrix type liquid crystal display devices of the point sequential drive system employing the clock drive method for the horizontal drive circuit such as an active matrix type EL display device using electroluminescence (EL) elements as the display elements of the pixels.

In the point sequential drive system, other than the well known 1H inversion drive system and dot inversion drive system, there is the so-called "dot line inversion drive system" for simultaneously writing video signals having inverse polarities to each other at pixels of two rows separated by an odd number of rows between adjacent pixel columns, for example upper and lower rows, so that the polarities of the pixels become the same between adjacent left and right pixels and become the inverse polarities between upper and lower pixels in the pixel array after writing the video signals.

Fourth Embodiment

Figure 31:
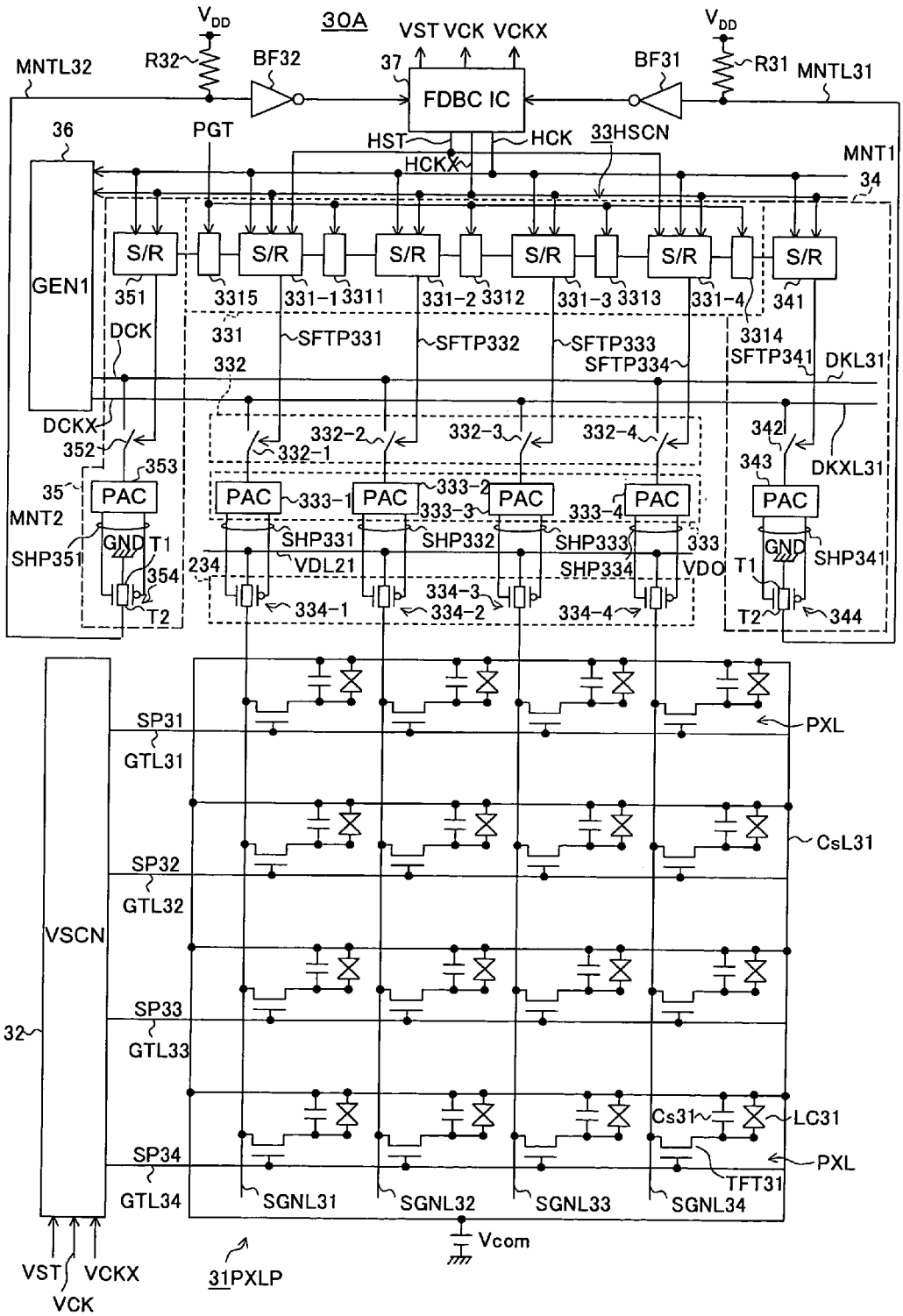
FIG. 31 is a circuit diagram of an example of the configuration of an active matrix type liquid crystal display device of the point sequential drive system according to a fourth embodiment of the present invention.

FIG. 31 is a circuit diagram of an example of the configuration of an active matrix type liquid crystal display device of the point sequential drive system according to a fourth embodiment of the present invention.

The difference of the fourth embodiment from the third embodiment resides in that the monitor line for propagating the output pulses of the first monitor circuit 34 and the second monitor circuit 35 to the feedback control circuit 37 is not shared, but the individual first monitor line MNTL31 and second monitor line MNTL32 are interconnected.

In this case, the output of the first monitor circuit 34 is connected to the first monitor line MNTL31, and the output of the second monitor circuit 35 is connected to the second monitor line MNTL32. Further, the first monitor line MNTL31 is pulled up by the pull-up resistor R31, and the other end side is connected to the first input terminal of the feedback control circuit 37 via the buffer BF31. In the same way, the second monitor line MNTL32 is pulled up by the pull-up resistor R32, and the other end side is connected to the second input terminal of the feedback control circuit 37 via the buffer BF32.

According to the fourth embodiment, in addition to the effects of the third embodiment, there are the advantages that the first monitor line MNTL31 and the second monitor line MNTL32 can be formed to substantially the same length as the interconnects, monitor error etc. due to the propagation delay difference etc. can be prevented, and monitoring of a higher precision can be realized.

Fifth Embodiment

In the fifth embodiment, an explanation will be given of an example of the configuration of a projection type liquid crystal display device (liquid crystal projector) which can use the active matrix type liquid crystal display device of the point sequential drive system of FIG. 11, FIG. 17, FIG. 26 or FIG. 31 as the display panel (LCD).

The active matrix type liquid crystal display devices of the point sequential drive system according to the first to fourth embodiments can be used as the display panel of the projection type liquid crystal display device (liquid crystal projector), that is, the liquid crystal display (LCD) panel.

Figure 32:
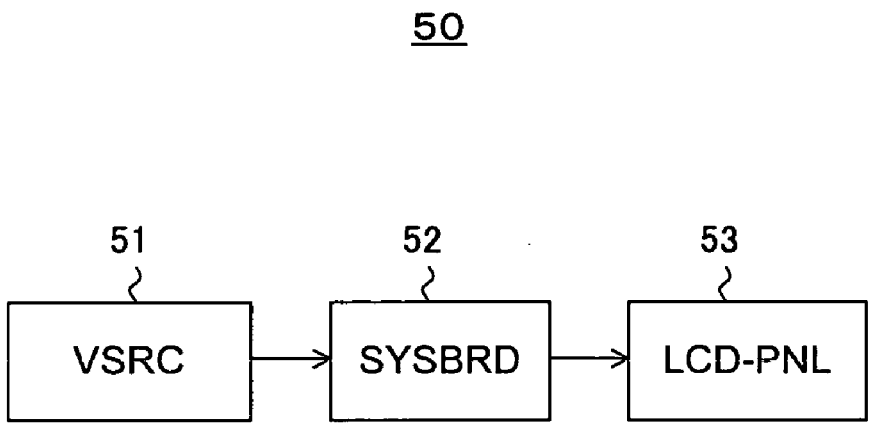
FIG. 32 is a block diagram of the system configuration of a projection type liquid crystal display device which can use the active matrix type liquid crystal display device of the point sequential drive system according to the present invention as a display panel (LCD)

FIG. 32 is a block diagram of the system configuration of a projection type liquid crystal display device which can use an active matrix type liquid crystal display device of the point sequential drive system according to the present invention as the display panel (liquid crystal display).

A projection type liquid crystal display device 50 according to the present example has a video signal source (VSRC) 51, a system board (SYSBRD) 52, and an LCD panel (PNL) 53. In this system configuration, at the system board 52, signal processing such as the previously mentioned adjustment of the sample-and-hold position is carried out with respect to the video signals output from the video signal source 51. On the system board 52, a feedback control circuit including the timing generator of is mounted. Further, as the liquid crystal display panel 53, use is made of an active matrix type liquid crystal display device of the point sequential drive system according to the above embodiments. Further, in the case of color, LCD panels 53 are provided corresponding to R (red), G (green), and B (blue).

Figure 33:
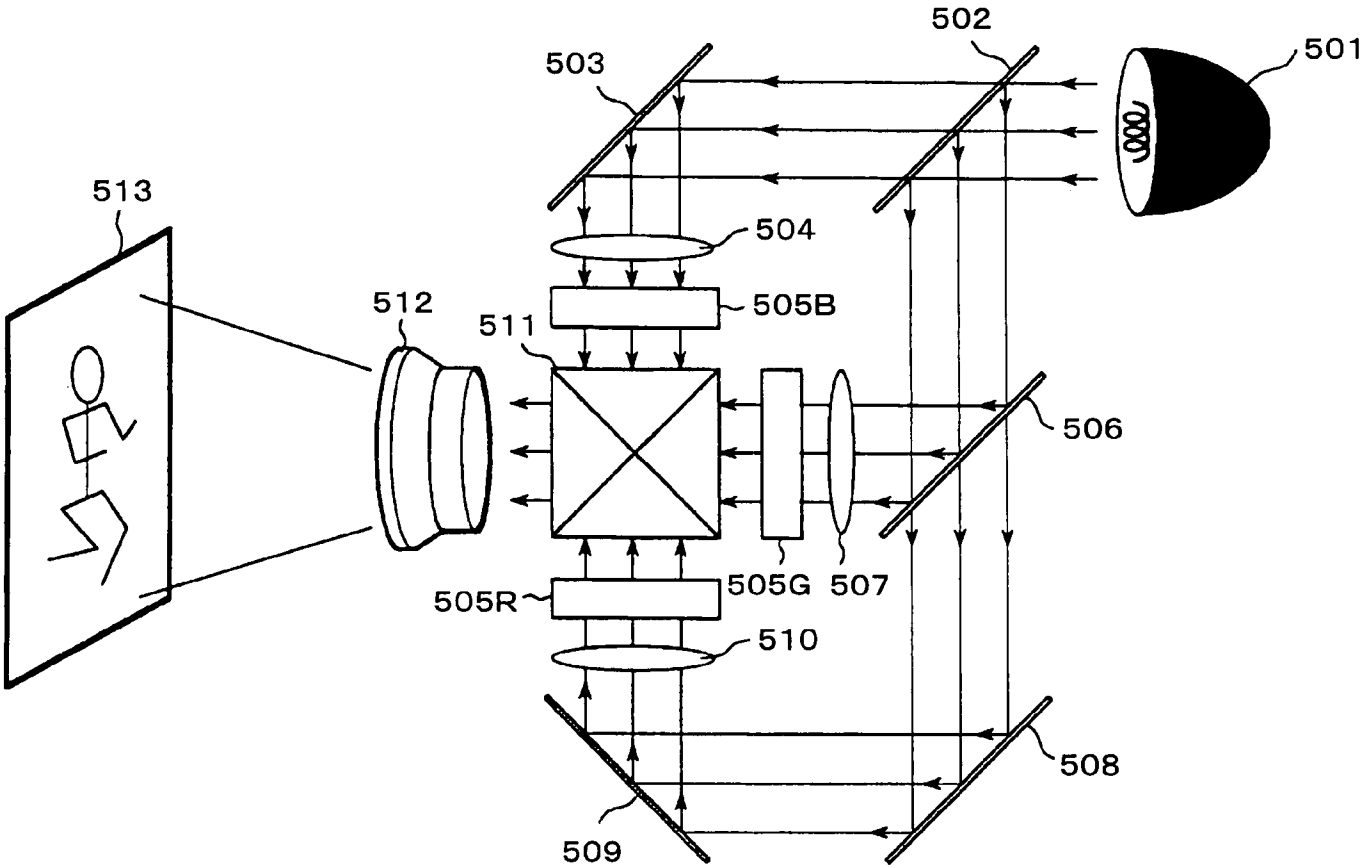
FIG. 33 is a schematic view of the configuration of an example of an optical system of a projection color liquid crystal display device which can use the active matrix type liquid crystal display of the point sequential drive system according to the present invention as a display panel (LCD).

FIG. 33 is a view of the schematic configuration showing an example of the optical system of a projection type clock liquid crystal display device.

In an optical system 500 of the projection type color liquid crystal display device of FIG. 33, white color light emitted from a light source 501 is passed at a first beam splitter 502 in only a specific color component, for example, the light component of B (blue) having the shortest wavelength. The light components of the remaining colors are reflected. The light component of B passed through the first beam splitter 502 is changed in optical path at a mirror 503 and strikes an LCD panel 505B of B through a lens 504. For the light components reflected at the first beam splitter 502, a second beam splitter 506 reflects the light component of for example G (green) and passes the light component of R (red). The light component of G reflected at the second beam splitter 506 is irradiated to an LCD panel 505G of G through a lens 507. The light component of R passed through the second beam splitter 506 is changed in optical path at mirrors 508 and 509 and strikes an LCD panel 505R of R through a lens 510. Each of the LCD panels 505R, 505G, and 505B has a first substrate formed so that a plurality of pixels are arranged in a matrix, a second substrate arranged facing the first substrate with a predetermined interval, a liquid crystal layer held between these substrates, and a filter layer corresponding to each color. The lights of R, G, and B passed through these liquid crystal display panels 505R, 505G, and 505B are optically combined at a cross prism 511. Further, the combined light emitted from this cross prism 511 is projected to a screen 513 by a projection prism 512.

In the projection type liquid crystal display device having the above configuration, active matrix type liquid crystal display devices of the point sequential drive system according to the above embodiments are used as the liquid crystal display panels 505R, 505G, and 505B. The scanning direction switch signals RGT are supplied to the liquid crystal display panels 505R and 505B at the high level and supplied to the liquid crystal display panel 505G at the low level so that for example the liquid crystal display panels 505R and 505B perform the first scanning operation (usual scanning operation) and the liquid crystal display panel 505G performs the second scanning operation (inverse scanning operation). Due to this, even if the phase of the clock changes at the time of the left/right inversion of the scanning operation, pulses having the uniform phases of output can be obtained from monitor circuit of any of the liquid crystal display panels 505R, 505G, and 505B. That is, even in a horizontal scanner (even number of shift stages) in which the phase of the clock is inverted in scanning direction inversion, monitoring is possible with a high precision and a high precision image display can be realized without the image ending up shifting by half no matter which the scanning direction of operation without any change of the phase of the output potential change. Further, completely non-overlapping sampling is realized in the horizontal driving system in the liquid crystal display according to the present embodiment, therefore the generation of vertical stripes due to overlapping sampling can be suppressed and, at the same time, the margin against ghosts can be raised, so a higher grade image display can be realized.

Note that projection type liquid crystal displays includes rear types and front types. In general, rear type projection type liquid crystal display devices have been used as projection TVs for moving picture images, while front type projection type liquid crystal display devices have been used as data projectors, but the active matrix type liquid crystal display device of the point sequential drive system according to the above embodiments can be applied to both types. Further, here, the explanation was given by taking as an example the case where the present invention was applied to a color projection type liquid crystal display device, but the present invention can also be applied to a monochrome projection type liquid crystal display device in the same way.

While the invention has been described with reference to specific embodiments chosen for purpose of illustration, it should be apparent that numerous modifications could be made thereto by those skilled in the art without departing from the basic concept and scope of the invention.

What is claimed is:

1. A display device comprising:

a pixel portion in which a plurality of pixels are arrayed in a matrix and signal lines are laid for every pixel column;

a monitor line held at a first potential;

a control circuit for generating at least a clock signal and an inverse clock signal having inverse phases to each other and serving as reference of a horizontal scan, monitoring the potential change of the monitor line, and correcting the timings of generation of at least said clock signal and inverse clock signal based on the change of the timing of the potential change;

a horizontal scanner; and a monitor circuit, wherein said horizontal scanner includes:

a shift register, in which a plurality of shift stages are cascade connected, which is able to switch between a first scanning operation for sequentially shifting from a first stage to a last stage and a second scanning operation for sequentially shifting from the last stage to the first stage in accordance with the switch signal and sequentially outputs shift pulses from the shift stages in synchronization with said clock signal and inverse clock signal at the time of said first scanning operation or the time of said second scanning operation, a first switch group for alternately sequentially sampling said clock signal and inverse clock signal in response to said shift pulses output from the corresponding shift stages of said shift register and outputting them as sample-and-hold pulses, and a second switch group for sequentially sampling video signals-in response to the sample-and-hold pulses from the switches of said first switch group and supplying them to the corresponding signal lines of said pixel portion, and said monitor circuit includes:

a selector portion for receiving said switch signal, sampling signals different from the signal sampled by the first shift stage of the shift register in said horizontal scanner among said clock signal and inverse clock signal when the switch signal indicates said first scanning operation and sampling signals different from the signal sampled by the last shift stage of the shift register in said horizontal scanner among said clock signal and inverse clock signal when the switch signal indicates said second scanning operation, and outputting the same as the sample-and-hold pulses, and a third switch for setting the potential of said monitor line at a second potential in response to the sample-and-hold pulses from said selector portion.

2. A display device as set forth in claim 1, wherein said selector portion comprises:

a fourth switch for receiving a select pulse and sampling said clock signal and outputting the same as the sample-and-hold pulse to said third switch, a fifth switch for receiving said select pulse and sampling said inverse clock signal and outputting the same as the sample-and-hold pulse to said third switch, and a selector for receiving said switch signal, outputting said select pulse to said fourth switch when the switch signal indicates said first scanning operation, and outputting said select pulse to said fifth switch when the switch signal indicates said second scanning operation.

3. A display device as set forth in claim 2, wherein:

said first scanning operation and said second scanning operation are started by receiving the horizontal start pulse, the horizontal start pulse is supplied to the initial shift stage of said shift register and said monitor circuit at the time of said first scanning operation, supplied to the last shift stage of said shift register and said monitor circuit at the time of said second scanning operation, and the selector of said monitor circuit supplies said horizontal start pulse as said select pulse to said fourth switch or fifth switch in accordance with said switch signal.

4. A display device as set forth in claim 3, wherein said selector comprises:

a first transfer line for transferring said horizontal start pulse as said select pulse to said fourth switch, a second transfer line for transferring said horizontal start pulse as said select pulse to said fifth switch, a first select switch for connecting said first transfer line to the supply line of said horizontal start pulse when said switch signal indicates said first scanning operation, a second select switch for connecting said second transfer line to the supply line of said horizontal start pulse when said switch signal indicates said second scanning operation, and a potential setting means for retaining said first transfer line or said second transfer line in a nonconnection state with the supply line of said horizontal start pulse at a potential able to hold said fourth switch or said fifth switch to which the first transfer line or said second transfer line is connected in a nonconductive state.

5. A display device as set forth in claim 1, wherein the number of the shift stages in the shift register-of said horizontal scanner is even.

6. A display device as set forth in claim 2, further comprising:

a clock generating means for generating, based on the clock signal and the inverse clock signal generated at said control circuit, a second clock signal and a second inverse clock signal having the same period as the clock signal and inverse clock signal and having a small duty ratio and supplying the same to said horizontal scanner and monitor circuit, and wherein each switch of the first switch group of said horizontal scanner and the fourth switch or the fifth switch of said monitor circuit samples the second clock signal or second inverse clock signal from said clock generating means.

7. A display device as set forth in claim 1, wherein the display element of said pixels is a liquid crystal cell.

8. A display device comprising:

a pixel portion in which a plurality of pixels are arrayed in a matrix and signal lines are laid for every pixel column;

a monitor line held at a first potential;

a control circuit for generating at least a first clock signal and a first inverse clock signal having inverse phases to each other and serving as reference of a horizontal scan, monitoring the potential change of said monitor line, and correcting the timings of generation of at least said clock signal and inverse clock signal based on the change of the timing of the potential change;

a clock generation circuit for generating a second clock signal and a second inverse clock signal having the same period as the first clock signal and first inverse clock signal and having a small duty ratio based on said first clock signal and first inverse clock signal generated at said control circuit;

a horizontal-scanner; and a monitor circuit, wherein said horizontal scanner includes:

a shift register, in which a plurality of shift stages are cascade connected, which is able to switch between a first scanning operation for sequentially shifting from a first stage to a last stage and a second scanning operation for sequentially shifting from the last stage to the first stage in accordance with the switch signal and sequentially outputs shift pulses from the shift stages in synchronization with said clock signal and inverse clock signal at the time of said first scanning operation or the time of said second scanning operation, a first switch group for alternately sequentially sampling said second clock signal and second inverse clock signal in response to said shift pulses output from the corresponding shift stages of said shift register and outputting them as sample-and-hold pulses, and a second switch group for sequentially sampling video signals in response to the sample-and-hold pulses from the switches of said first switch group and supplying them to the corresponding signal lines of said pixel portion, and said monitor circuit includes:

a selector portion for receiving said switch signal, sampling signals having different phases from that of the signal sampled by the first shift stage of the shift register in said horizontal scanner between said first clock signal and first inverse clock signal when the switch signal indicates said first scanning operation and sampling signals having different phases from that of the signal sampled by the last shift stage of the shift register in said horizontal scanner between said first clock signal and first inverse clock signal when the switch signal indicates said second scanning operation, and outputting the same as the sample-and-hold pulses, and a third switch for setting the potential of said monitor line at a second potential in response to the sample-and-hold pulses from said selector portion.

9. A display device as set forth in claim 8, wherein said selector portion comprises:

a fourth switch for receiving a select pulse and sampling said clock signal and outputting the same as the sample-and-hold pulse to said third switch, a fifth switch for receiving said select pulse and sampling said inverse clock signal and outputting the same as the sample-and-hold pulse to said third switch, and a selector for receiving said switch signal, outputting said select pulse to said fourth switch when the switch signal indicates said first scanning operation, and outputting said select pulse to said fifth switch when the switch signal indicates said second scanning operation.

10. A display device as set forth in claim 9, wherein:

said first scanning operation and said second scanning operation are started by receiving the horizontal start pulse, the horizontal start pulse is supplied to the initial shift stage of said shift register and said monitor circuit at the time of said first scanning operation, supplied to the last shift stage of said shift register and said monitor circuit at the time of said second scanning operation, and the selector of said monitor circuit supplies said horizontal start pulse as said select pulse to said fourth switch or fifth switch in accordance with said switch signal.

11. A display device as set forth in claim 10, wherein said selector has:

a first transfer line for transferring said horizontal start pulse as said select pulse to said fourth switch, a second transfer line for transferring said horizontal start pulse as said select pulse to said fifth switch, a first select switch for connecting said first transfer line to the supply line of said horizontal start pulse when said switch signal indicates said first scanning operation, a second select switch for connecting said second transfer line to the supply line of said horizontal start pulse when said switch signal indicates said second scanning operation, and a potential setting means for retaining said first transfer line or said second transfer line in a nonconnection state with the supply line of said horizontal start pulse at a potential able to hold said fourth switch or said fifth switch to which the first transfer line or said second transfer line is connected in a nonconductive state.

12. A display device as set forth in claim 8, wherein the number of the shift stages in the shift register of said horizontal scanner is even.

13. A display device as set forth in claim 8, wherein the display element of said pixels is a liquid crystal cell.

14. A display device comprising:

a pixel portion in which a plurality of pixels are arrayed in a matrix and signal lines are laid for every pixel column;

a monitor line held at a first potential;

a control circuit for generating at least a clock signal and an inverse clock signal having inverse phases to each other and serving as reference of a horizontal scan, monitoring the potential change of said monitor line, and correcting the timings of generation of at least said clock signal and inverse clock signal based on the change of the timing of the potential change;

a horizontal scanner;

a first monitor circuit; and a second monitor circuit, wherein said horizontal scanner includes:

a shift register, in which a plurality of shift stages are cascade connected, which is able to switch between a first scanning operation for sequentially shifting from a first stage to a last stage and a second scanning operation for sequentially shifting from the last stage to the first stage in accordance with the switch signal and sequentially outputs shift pulses from the shift stages in synchronization with said clock signal and inverse clock signal at the time of said first scanning operation or the time of said second scanning operation, a first switch group for alternately sequentially sampling said clock signal and inverse clock signal in response to said shift pulses output from the corresponding shift stages of said shift register and outputting them as sample-and-hold pulses, and a second switch group for sequentially sampling video signals in response to the sample-and-hold pulses from the switches of said first switch group and supplying them to the corresponding signal lines of said pixel portion, said first monitor circuit includes:

a shift stage which is connected to the last shift stage of the shift register in said horizontal scanner at the time of said first scanning operation and outputs the shift pulses in synchronization with said clock signal and inverse clock signal when performing shift-in of the signal by the last shift stage, a third switch for sampling signals-different from the signal sampled from said last shift stage among said clock signal and inverse clock signal in response to said shift pulse output from said shift stage and outputting the same as the sample-and-hold pulses, and a fourth switch for setting the potential of said monitor line at a second potential in response to the sample-and-hold pulses from said third switch, and said second monitor circuit includes:

a shift stage which is connected to the initial shift stage of the shift register in said horizontal scanner at the time of said second scanning operation-and outputs the shift pulses in synchronization with said clock signal and inverse clock signal when performing the shift-in of the signal by the initial shift stage, a fifth switch for sampling signals different from that of the signal sampled from said initial shift stage among said clock signal and inverse clock signal in response to said shift pulses output from said shift stage and outputting the same as the sample-and-hold pulses, and a sixth switch for setting the potential of said monitor line at the second potential in response to the sample-and-hold pulses from said fifth switch.

15. A display device as set forth in claim 14, wherein said first scanning operation and said second scanning operation are started by receiving the horizontal start pulse, and the horizontal start pulse is supplied to the initial shift stage of said shift register at the time of said first scanning operation, supplied to the last shift stage of said shift register at the time of said second scanning operation, and not supplied to said first monitor circuit and said second monitor circuit.

16. A display device as set forth in claim 14, wherein:

said first monitor circuit is arranged in the vicinity of the arrangement position of the last shift stage of said horizontal scanner, and said second monitor circuit is arranged in the vicinity of the arrangement position of the initial shift stage of said horizontal scanner.

17. A display device as set forth in claim 14, wherein said monitor line is shared by said first monitor circuit and said second monitor circuit.

18. A display device as set forth in claim 14, wherein said monitor line is individually formed as a first monitor line connected to said first monitor circuit and as a second monitor line connected to said second monitor circuit.

19. A display device as set forth in claim 14, wherein the number of shift stages in the shift register of said horizontal scanner is even.

20. A display device as set forth in claim 14, further comprising:

a clock generating means for generating, based on the clock signal and the inverse clock signal generated at said control circuit, a second clock signal and a second inverse clock signal having the same period as the clock signal and inverse clock signal and having a small duty ratio and supplying the same to said horizontal scanner, first monitor circuit, and the second monitor circuit, and wherein each switch of the first switch group of said horizontal scanner, the third switch of said first monitor circuit, and the fifth switch of said second monitor circuit samples the second clock signal or second inverse clock signal from said clock generating means.

21. A display device as set forth in claim 14, wherein the display element of said pixels is a liquid crystal cell.

22. A projection type display device comprising:

a monitor line held at a first potential;

a control circuit for generating at least a clock signal and an inverse clock signal having inverse phases to each other and serving as reference of a horizontal scan, monitoring the potential change of said monitor line, and correcting at least the timings of generation of said clock signal and inverse clock signal based on the change of the timing of the potential change;

a display panel including a pixel portion in which a plurality of pixels are arrayed in a matrix and signal lines are laid for every pixel column, a horizontal scanner, and a monitor circuit;

an irradiating means for irradiating the light to said display panel; and a projecting means for projecting light passing through said display panel, wherein the horizontal scanner of said display panel includes:

a shift register in which a plurality of shift stages are cascade connected, which is able to switch between a first scanning operation for sequentially shifting from a first stage to a last stage and a second scanning operation for sequentially shifting from the last stage to the first stage in accordance with the switch signal and sequentially outputs shift pulses from the shift stages in synchronization with said clock signal and inverse clock signal at the time of said first scanning operation or the time of said second scanning operation, a first switch group for alternately sequentially sampling said clock signal and inverse clock signal in response to said shift pulses output from the corresponding shift stages of said shift register and outputting them as sample-and-hold pulses, and a second switch group for sequentially sampling video signals in response to the sample-and-hold pulses from the switches of said first switch group and supplying them to the corresponding signal lines of said pixel portion, and the monitor circuit of said display panel includes:

a selector portion for receiving said switch signal, sampling signals different from the signal sampled by the first shift stage of the shift register in said horizontal scanner among said clock signal and inverse clock signal when the switch signal indicates said first scanning operation and sampling signals different from the signal sampled by the last shift stage of the shift register in said horizontal scanner among said clock signal and inverse clock signal when the switch signal indicates said second scanning operation, and outputting the same as the sample-and-hold pulses, and a third switch for setting the potential of said monitor line at a second potential in response to the sample-and-hold pulses from said selector portion.

23. A projection type display device as set forth in claim 22, wherein said selector portion comprises:

a fourth switch for receiving select a pulse and sampling said clock signal and outputting the same as the sample-and-hold pulse to said third switch, a fifth switch for receiving said select pulse and sampling said inverse clock signal and outputting the same as the sample-and-hold pulse to said third switch, and a selector for receiving said switch signal, outputting said select pulse to said fourth switch when the switch signal indicates said first scanning operation, and outputting said select pulse to said fifth switch when the switch signal indicates said second scanning operation.

24. A projection type display device as set forth in claim 23, wherein:

said first scanning operation and said second scanning operation are started by receiving the horizontal start pulse, the horizontal start pulse is supplied to the initial shift stage of said shift register and said monitor circuit at the time of said first scanning operation, supplied to the last shift stage of said shift register and said monitor circuit at the time of said second scanning operation, and the selector of said monitor circuit supplies said horizontal start pulse as said select pulse to said fourth switch or fifth switch in accordance with said switch signal.

25. A projection type display device as set forth in claim 24, wherein said selector comprises:

a first transfer line for transferring said horizontal start pulse as said select pulse to said fourth switch, a second transfer line for transferring said horizontal start pulse as said select pulse to said fifth switch, a first select switch for connecting said first transfer line to the supply line of said horizontal start pulse when said switch signal indicates said first scanning operation, a second select switch for connecting said second transfer line to the supply line of said horizontal start pulse when said switch signal indicates said second scanning operation, and a potential setting means for retaining said first transfer line or said second transfer line in a nonconnection state with the supply line of said horizontal start pulse at a potential able to hold said fourth switch or said fifth switch to which the first transfer line or said second transfer line is connected in a nonconductive state.

26. A projection type display device as set forth in claim 22, wherein the number of the shift stages in the shift register of said horizontal scanner is even.

27. A projection type display device as set forth in claim 23, further comprising:

provision is made of a clock generating means for generating, based on the clock signal and the inverse clock signal generated at said control circuit, a second clock signal and a second inverse clock signal having the same period as the clock signal and inverse clock signal and having a small duty ratio and supplying the same to said horizontal scanner and monitor circuit, and wherein each switch of the first switch group of said horizontal scanner and the fourth switch or the fifth switch of said monitor circuit samples the second clock signal or second inverse clock signal from said clock generating means.

28. A projection type display device as set forth in claim 22, wherein the display element of said pixels is a liquid crystal cell.

29. A projection type display device comprising:

a monitor line held at a first potential;

a control circuit for generating at least a clock signal and an inverse clock signal having inverse phases to each other and serving as reference of a horizontal scan, monitoring the potential change of said monitor line, and correcting at least the timings of generation of said clock signal and inverse clock signal based on the change of the timing of the potential change;

a clock generation circuit for generating a second clock signal and a second inverse clock signal having the same period as the first clock signal and first inverse clock signal and having a small duty ratio based on said first clock signal and first inverse clock signal generated at said control circuit;

a display panel including at least a pixel portion in which a plurality of pixels are arrayed in a matrix and signal lines are laid for every pixel column, a horizontal scanner, and a monitor circuit;

an irradiating means for irradiating light to said display panel; and a projecting means for projecting the light passed through said display panel onto a screen, wherein the horizontal scanner of said display panel includes:

a shift register, in which a plurality of shift stages are cascade connected, which is able to switch between a first scanning operation for sequentially shifting from a first stage to a last stage and a second scanning operation for sequentially shifting from the last stage to the first stage in accordance with the switch signal and sequentially outputs shift pulses from the shift stages in synchronization with said clock signal and inverse clock signal at the time of said first scanning operation or the time of said second scanning operation, a first switch group for alternately sequentially sampling said second clock signal and second inverse clock signal in response to said shift pulses output from the corresponding shift stages of said shift register and outputting them as sample-and-hold pulses, and a second switch group for sequentially sampling video signals in response to the sample-and-hold pulses from the switches of said first switch group and supplying them to the corresponding signal lines of said pixel portion, and the monitor circuit of said display panel includes:

a selector portion for receiving said switch signal, sampling signals having different phases from that of the signal sampled by the first shift stage of the shift register in said horizontal scanner between said first clock signal and first inverse clock signal when the switch signal indicates said first scanning operation and sampling signals having different phases from that of the signal sampled by the last shift stage of the shift register in said horizontal scanner between said first clock signal and first inverse clock signal when the switch signal indicates said second scanning operation, and outputting the same as the sample-and-hold pulses, and a third switch for setting the potential of said monitor line at a second potential in response to the sample-and-hold pulses from said selector portion.

30. A projection type display device as set forth in claim 29, wherein said selector portion comprises:

a fourth switch for receiving a select pulse and sampling said clock signal and outputting the same as the sample-and-hold pulse to said third switch, a fifth switch for receiving said select pulses and sampling said inverse clock signal and outputting the same as the sample-and-hold pulse to said third switch, and a selector for receiving said switch signal, outputting said select pulse to said fourth switch when the switch signal indicates said first scanning operation, and outputting said select pulse to said fifth switch when the switch signal indicates said second scanning operation.

31. A projection type display device as set forth in claim 30, wherein:

said first scanning operation and said second scanning operation are started by receiving the horizontal start pulse, the horizontal start pulse is supplied to the initial shift stage of said shift register and said monitor circuit at the time of said first scanning operation and supplied to the last shift stage of said shift register and said monitor circuit at the time of said second scanning operation, and the selector of said monitor circuit supplies said horizontal start pulse as said select pulse to said fourth switch or fifth switch in accordance with said switch signal.

32. A projection type display device as set forth in claim 31, wherein said selector comprises:

a first transfer line for transferring said horizontal start pulse as said select pulse to said fourth switch, a second transfer line for transferring said horizontal start pulse as said select pulse to said fifth switch, a first select switch for connecting said first transfer line to the supply line of said horizontal start pulse when said switch signal indicates said first scanning operation, a second select switch for connecting said second transfer line to the supply line of said horizontal start pulse when said switch signal indicates said second scanning operation, and a potential setting means for holding said first transfer line or said second transfer line in a nonconnection state with the supply line of said horizontal start pulse at a potential able to hold said fourth switch or said fifth switch to which the first transfer line or said second transfer line is connected in a nonconductive state.

33. A projection type display device as set forth in claim 29, wherein the number of the shift stages in the shift register of said horizontal scanner is even.

34. A projection type display device as set forth in claim 29, wherein the display element of said pixels is a liquid crystal cell.

35. A projection type display device comprising:

a monitor line held at a first potential;

a control circuit for generating at least a clock signal and an inverse clock signal having inverse phases to each other and serving as reference of a horizontal scan, monitoring the potential change of said monitor line, and correcting at least the timings of generation of said clock signal and inverse clock signal based on the change of the timing of the potential change;

a display panel including a pixel portion in which a plurality of pixels are arrayed in a matrix and signal lines are laid for every pixel column, a horizontal scanner, a first monitor circuit, and a second monitor circuit;

an irradiating means for irradiating light to said display panel; and a projecting means for projecting the light passed through said display panel onto a screen, wherein the horizontal scanner of said display panel includes:

a shift register, in which a plurality of shift stages are cascade connected, which is able to switch between a first scanning operation for sequentially shifting from a first stage to a last stage and a second scanning operation for sequentially shifting from the last stage to the first stage in accordance with the switch signal and sequentially outputs shift pulses from the shift stages in synchronization with said clock signal and inverse clock signal at the time of said first scanning operation or the time of said second scanning operation, a first switch group for alternately sequentially sampling said clock signal and inverse clock signal in response to said shift pulses output from the corresponding shift stages of said shift register and outputting them as sample-and-hold pulses, and a second switch group for sequentially sampling video signals in response to the sample-and-hold pulses from the switches of said first switch group and supplying them to the corresponding signal lines of said pixel portion, the first monitor circuit of said display panel includes:

a shift stage which is connected to the last shift stage of the shift register in said horizontal scanner at the time of said first scanning operation and outputs the shift pulses in synchronization with said clock signal and inverse clock signal when performing the shift-in of the signal by the last shift stage, a third switch for sampling signals different from the signal sampled from said last shift stage among said clock signal and inverse clock signal in response to said shift pulse output from said shift stage and outputting the same as the sample-and-hold pulses, and a fourth switch for setting the potential of said monitor line at a second potential in response to the sample-and-hold pulses from said third switch, and the second monitor circuit of said display panel includes:

a shift stage which is connected to the initial shift stage of the shift register in said horizontal scanner at the time of said second scanning operation and outputs the shift pulses in synchronization with said clock signal and inverse clock signal when performing the shift-in of the signal by the initial shift stage, a fifth switch for sampling signals different from that of the signal sampled from said initial shift stage among said clock signal and inverse clock signal in response to said shift pulses output from said shift stage and outputting the same as the sample-and-hold pulses, and a sixth switch for setting the potential of said monitor line at the second potential in response to the sample-and-hold pulses from said fifth switch.

36. A projection type display device as set forth in claim 35, wherein said first scanning operation and said second scanning operation are started by receiving the horizontal start pulse, and the horizontal start pulse is supplied to the initial shift stage of said shift register at the time of said first scanning operation, supplied to the last shift stage of said shift register at the time of said second scanning operation, and not supplied to said first monitor circuit and said second monitor circuit.

37. A projection type display as set forth in claim 35, wherein:

said first monitor circuit is arranged in the vicinity of the arrangement position of the last shift stage of said horizontal scanner, and said second monitor circuit is arranged in the vicinity of the arrangement position of the initial shift stage of said horizontal scanner.

38. A projection type display device as set forth in claim 35, wherein said monitor line is shared by said first monitor circuit and said second monitor circuit.

39. A projection type display device as set forth in claim 35, wherein said monitor line is individually formed as a first monitor line connected to said first monitor circuit and as a second monitor line connected to said second monitor circuit.

40. A projection type display device as set forth in claim 35, wherein the number of shift stages in the shift register of said horizontal scanner is even.

41. A projection type display device as set forth in claim 35, further comprising:

a clock generating means for generating, based on the clock signal and the inverse clock signal generated at said control circuit, a second clock signal and a second inverse clock signal having the same period as the clock signal and inverse clock signal and having a small duty ratio and supplying the same to said horizontal scanner, first monitor circuit, and the second monitor circuit, and wherein each switch of the first switch group of said horizontal scanner, the third switch of said first monitor circuit, and the fifth switch of said second monitor circuit samples the second clock signal or second inverse clock signal from said clock generating means.

42. A projection type display device as set forth in claim 35, wherein the display element of said pixels is a liquid crystal cell.

* * * * *

UNITED STATES PATENT AND TRADEMARK OFFICE

CERTIFICATE OF CORRECTION

PATENT NO. : 7,151,538 B2
APPLICATION NO. : 10/781782
DATED : December 19, 2006
INVENTOR(S) : Junichi Yamashita It is certified that error appears in the above-identified patent and that said Letters Patent is hereby corrected as shown below:

Column 59:
Line 26, "operation-and" should read -- operation and --.

Column 61:
Line 1, "select a" should read -- a select --.

Signed and Sealed this

Eighteenth Day of March, 2008

JON W. DUDAS
*Director of the United States Patent and Trademark Office*